US007101445B2

(12) United States Patent
Kami et al.

(10) Patent No.: US 7,101,445 B2
(45) **Date of Patent: *Sep. 5, 2006**

(54) COLD ROLLED STEEL SHEET AND GALVANIZED STEEL SHEET HAVING STRAIN AGE HARDENABILITY AND METHOD OF PRODUCING THE SAME

(75) Inventors: Chikara Kami, Chiba (JP); Akio Tosaka, Chiba (JP); Takuya Yamazaki, Chiba (JP)

(73) Assignee: JFE Steel Corporation, (JP)

( * ) Notice: Subject to any disclaimer, the term of this patent is extended or adjusted under 35 U.S.C. 154(b) by 115 days.

This patent is subject to a terminal disclaimer.

(21) Appl. No.: 10/654,775

(22) Filed: Sep. 4, 2003

(65) Prior Publication Data

US 2004/0055672 A1 Mar. 25, 2004

Related U.S. Application Data

(62) Division of application No. 10/031,426, filed as application No. PCT/JP01/01004 on Feb. 14, 2001, now abandoned.

(30) Foreign Application Priority Data

| | | |
|---|---|---|
| May 26, 2000 | (JP) | 2000-156274 |
| Jun. 28, 2000 | (JP) | 2000-193717 |
| Oct. 27, 2000 | (JP) | 2000-328924 |
| Nov. 2, 2000 | (JP) | 2000-335803 |

(51) Int. Cl.
*C22C 38/06* (2006.01)
*C22C 38/02* (2006.01)
*C22C 38/04* (2006.01)

(52) U.S. Cl. ..... 148/320; 148/330; 148/333; 420/128

(58) Field of Classification Search ..... 148/320, 148/330, 333–336; 420/128
See application file for complete search history.

(56) References Cited

U.S. PATENT DOCUMENTS

| | | | | |
|---|---|---|---|---|
| 4,838,955 | A | 6/1989 | Edelman et al. | |
| 5,123,969 | A | 6/1992 | Chou | |
| 5,405,463 | A | 4/1995 | Shimomura et al. | |
| 5,582,658 | A | 12/1996 | Masui et al. | |
| 5,690,755 | A | 11/1997 | Yoshinaga et al. | |
| 6,702,904 | B1 * | 3/2004 | Kami et al. | 148/320 |
| 6,902,632 | B1 * | 6/2005 | Kami et al. | 148/320 |

FOREIGN PATENT DOCUMENTS

| | | |
|---|---|---|
| EP | 0 429 094 A1 | 5/1991 |
| EP | 0 510 718 A2 | 10/1992 |
| EP | 0 608 430 | 8/1994 |

(Continued)

*Primary Examiner*—Deborah Yee
(74) *Attorney, Agent, or Firm*—DLA Piper Rudnick; Gray Cary US LLP

(57) ABSTRACT

An object of the present invention is to provide a cold-rolled steel sheet and an alloyed hot-dip galvanized steel sheet in which tensile strength is effectively increased by press forming and heat treatment while maintaining excellent deep drawability in press forming. Specifically, a steel composition contains less than 0.01% of C, 0.005 to 1.0% of Si, 0.01 to 1.0% of Mn, 0.005 to 0.050% of Nb, 0.005 to 0.030% of Al, 0.005 to 0.040% of N, 0.0005 to 0.0015% of B, 0.05% or less of P, and 0.01% or less of S, the balance substantially composed of Fe, in which the following equations (1) and (2) are satisfied:

$$N\,\% \geqq 0.0015 + 14/93 \cdot Nb\,\% + 14/27 \cdot Al\,\% + 14/11 \cdot B\,\% \quad (1)$$

$$C\,\% \leqq (12/93) \cdot Nb\,\%. \quad (2)$$

2 Claims, 4 Drawing Sheets

FOREIGN PATENT DOCUMENTS

| | | | |
|---|---|---|---|
| EP | 0 608 430 | A1 | 8/1994 |
| EP | 0 612 857 | A1 | 8/1994 |
| EP | 0 659 890 | A2 | 6/1995 |
| EP | 0 769 565 | A1 | 4/1997 |
| EP | 0 943 696 | A1 | 9/1999 |
| EP | 1 002 884 | A1 | 5/2000 |
| JP | 55 141526 | | 11/1980 |
| JP | 3 56-023229 | A | 3/1981 |
| JP | 58042753 | | 3/1983 |
| JP | 60 052528 | | 3/1985 |
| JP | 60 145355 | | 7/1985 |
| JP | 61016682 | | 1/1986 |
| JP | 61 272323 | | 12/1986 |
| JP | 3 63-007336 | A | 1/1988 |
| JP | 04 074824 | | 3/1992 |
| JP | 06102816 | | 4/1994 |
| JP | 07034136 | | 2/1995 |
| JP | 07 090482 | | 4/1995 |
| JP | 08035039 | | 2/1996 |
| JP | 11279691 | | 10/1999 |

* cited by examiner

COLD ROLLED STEEL SHEET AND GALVANIZED STEEL SHEET HAVING STRAIN AGE HARDENABILITY AND METHOD OF PRODUCING THE SAME

This application is a divisional of application Ser. No. 10/031,426, filed Jan. 18, 2002 now abandoned, which is a §371 of PCT/JP01/01004, filed Feb. 14, 2001, which claims benefit of Japanese Patent Application Nos. 2000-156274, filed May 26, 2000, 2000-193717, filed Jun. 28, 2000, 2000-328924, filed Oct. 27, 2000, and 2000-335803, filed Nov. 2, 2000, incorporated herein by reference.

TECHNICAL FIELD

The present invention relates to a cold-rolled steel sheet, an electro-galvanized steel sheet, a hot-dip galvanized steel sheet, and an alloyed hot-dip galvanized steel sheet, which are suitable as raw material steel sheets for molded parts, automobile structural parts, etc., which ate used at positions required to have structural strength, particularly strength and/or stiffness in deformation, and which are subjected to heat treatment for increasing strength after processing such as pressing or the like, and a method of producing these steel sheets.

1. In the present invention, "excellent strain age hardenability" means that in aging under conditions of holding at a temperature of 170° C. for 20 min. after pre-deformation with a tensile strain of 5%, the increment in deformation stress (represented by the amount of BH=yield stress after aging−pre-deformation stress before aging) after aging is 80 MPa or more, and the increment in tensile strength (represented by ΔTS=tensile strength after aging−tensile strength before pre-deformation) after strain aging (pre-deformation+aging) is 40 MPa or more.

BACKGROUND ART

In producing a press-molded product of a thin steel sheet, a process of coating and baking at lower than 200° C. is used as a method in which a material having low deformation stress before press forming to facilitate press forming, and then hardened after press forming to increase the strength of a part. As a steel sheet for such coating and baking, a BH steel sheet has been developed.

For example, Japanese Unexamined Patent Application Publication No. 55-141526 discloses a method in which Nb is added according to the contents of C, N and Al of steel, Nb/(dissolved C+dissolved N) by at % is limited in a specified range, and the cooling rate after annealing is controlled to adjust dissolved C and dissolved N in a steel sheet. Also, Japanese Examined Patent Application Publication No. 61-45689 discloses a method in which baking hardenability is improved by adding Ti and Nb.

However, in order to improve deep drawability, strength of the raw material sheets of the above-described steel sheets is decreased, and thus the steel sheets are not always sufficient as structural materials.

Japanese Unexamined Patent Application Publication No. 5-25549 discloses a method in which baking hardenability is improved by adding W, Cr and Mo to steel singly or in a combination.

In the above-described conventional techniques, strength is increased by bake-hardening due to the functions of small amounts of dissolved C and dissolved N in a steel sheet, and it is well known that a BH (Bake-Hardening) steel sheet is used for increasing only the yield strength of a material, not for increasing tensile strength. Therefore, the conventional techniques have only the effect of increasing the deformation start stress of a part, and the effect of increasing stress (tensile strength after forming) required for deformation over the entire deformation region from the deformation start to the deformation end is not said to be sufficient.

As a cold-rolled steel sheet having tensile strength increased after forming, for example, Japanese Unexamined Patent Application Publication No. 10-310847 discloses an alloying ho-dip galvanized steel sheet having tensile strength increased by 60 MPa or more by heat treatment in the temperature region of 200 to 450° C.

This steel sheet contains, by mass %, 0.01 to 0.08% of C, and 0.01 to 3.0% of Mn, and at least one of W, Cr, and Mo in a total of 0.05 to 3.0%, and further contains at least one of 0.005 to 0.1% of Ti, 0.005 to 0.1% of Nb and 0.005 to 0.1% of V according to demand, and the microstructure of the steel is composed of ferrite or mainly composed of ferrite.

However, this technique comprises forming a fine carbide in the steel sheet by heat treatment after forming to effectively propagate a dislocation of stress applied during pressing, thereby increasing the amount of strain. Therefore, heat treatment must be performed in the temperature range of 220 to 370° C. There is thus the problem of a necessary heat treatment temperature higher than general bake-hardening temperatures.

Furthermore, it is a very important problem that the body weight of an automobile is decreased in relation to the recent regulation of exhaust gases due to global environmental problems. In order to decrease the body weight of an automobile, it is effective to increase the strength of the used steel sheet, i.e., use a high-tensile-strength steel sheet, thinning the steel sheet used.

An automobile part using a high-tensile-strength thin steel sheet must exhibit a sufficient property according to its function. The property depends upon the part, and examples of the property include dent resistance, static strength against deformation such as bending, twisting, or the like, fatigue resistance, impact resistance, etc. Namely, the high-tensile-strength steel sheet used for an automobile part is required to be excellent in such a property after forming. The properties are related to the strength of a steel sheet after forming, and thus the lower limit of strength of the high-tensile-strength steel sheet used must be set for achieving thinning.

On the other hand, in the process for forming an automobile part, a steel sheet is press-molded. If the steel sheet has excessively high strength in press forming, the steel sheet causes the following problems (1) deteriorating shape fixability; (2) deteriorating ductility to cause cracking, necking, or the like, during forming; and (3) deteriorating dent resistance (resistance to a dent produced by a local compressive load) when the sheet thickness is decreased. These problems thus inhibit the extension of application of the high-tensile-strength steel sheet to automobile bodies.

As a means for overcoming the problems, a steel sheet composed of ultra-low-carbon steel is known as a raw material, for example, for a cold-rolled steel sheet for an external sheet panel, in which the content of C finally remaining in a solid solution state is controlled to an appropriate range. This type of steel sheet is kept soft during press forming to ensure shape fixability and ductility, and its yield stress is increased by utilizing the strain aging phenomenon which occurs in the step of coating and baking at 170° C. for about 20 minutes after press forming, to ensure dent resistance. This steel sheet is soft during press forming because C is dissolved in steel, while dissolved C is fixed to a dislocation introduced in press forming in the coating and baking step after press forming to increase the yield stress.

However, in this type of steel sheet, the increase in yield stress due to strain age hardening is kept down from the viewpoint of prevention of the occurrence of stretcher strain causing a surface defect. This causes the fault that the steel sheet actually less contributes to a reduction in weight of a part.

On the other hand, a steel sheet composed of dissolved N to further increase the amount of bake-hardening, and a steel sheet provided with a composite structure composed of ferrite and martensite to further improve baking hardenability have been proposed for applications in which the appearance is not so important.

For example, Japanese Unexamined Patent Application Publication No. 60-52528 discloses a method of producing a high-strength steel thin sheet having good ductility and spot weldability, in which steel containing 0.02 to 0.15% of C, 0.8 to 3.5% of Mn, 0.02 to 0.15% of P, 0.10% or less of Al, and 0.005 to 0.025% of N is hot-rolled by coiling at a temperature of 550° C. or less, cold-rolled, and then annealed by controlled cooling and heat treatment. A steel sheet produced by the technique disclosed in Japanese Unexamined Patent Application Publication No. 60-52528 has a mixed structure comprising a low-temperature transformation product phase mainly composed of ferrite and martensite, and having excellent ductility, and high strength is achieved by utilizing strain aging due to positively added N during coating baking.

Although the technique disclosed in Japanese Unexamined Patent Application Publication No. 60-52528 greatly increases yield stress YS due to strain age hardening, the technique less increases tensile strength TS. Also, this technique causes large variations in the increment in yield stress YS to cause large variations in mechanical properties, and thus it cannot be expected that a steel sheet can be sufficiently thinned for contributing to a reduction in weight of an automobile part, which is currently demanded.

Japanese Examined Patent Application Publication No. 5-24979 discloses a high-tensile-strength cold-rolled steel thin sheet having baking hardenability which has a composition comprising 0.08 to 0.20% of C, 1.5 to 3.5% of Mn, and the balance composed of Fe and inevitable impurities, and a structure composed of homogeneous bainite containing 5% or less of ferrite, or bainite partially containing martensite. The cold-rolled steel sheet disclosed in Japanese Examined Patent Application Publication No. 5-24979 is produced by quenching in the temperature range of 200 to 400° C. in the cooling process after continuous annealing, and then slowly cooling to obtain a structure mainly composed of bainite and having a large amount of bake-hardening which is not obtained by a conventional method.

However, in the steel sheet disclosed in Japanese Examined Patent Application Publication No. 5-24979, yield strength is increased after coating and baking to obtain a large amount of bake-hardening which is not obtained a conventional method, while tensile strength cannot be increased. Therefore, in application to a strength member, improvements in fatigue resistance and impact resistance after forming cannot be expected. Therefore, there is a problem in which the steel sheet cannot be used for applications greatly required to have fatigue resistance and impact resistance, etc.

Also, Japanese Examined Patent Application Publication No. 61-12008 discloses a method of producing a high-tensile-strength steel sheet having a high r value. This method is characterized by annealing ultra-low-C steel used as a raw material in a ferrite-austenite coexistence region after cold rolling. However, the resultant steel sheet has a high r value and a high degree of baking hardenability (BH property), but the obtained BH amount is about 60 MPa at most. Also, the yield point of the steel sheet is increased after strain aging, but TS is not increased, thereby causing the problem of limiting application to parts.

Furthermore, the above-described steel sheet exhibits excellent strength after coating and baking in a simple tensile test, but produces large variations in strength during plastic deformation under actual pressing conditions. Therefore, it cannot be said that the steel sheet is sufficiently applied to parts required to have reliability.

With respect of a hot-rolled steel sheet among coating baked steel sheets for press molded products, for example, Japanese Examined Patent Application Publication No. 8-23048 discloses a method of producing a hot-rolled steel sheet which is soft during processing, and has tensile strength increased by coating and baking after processing to be effective to improve fatigue resistance.

In this technique, steel contains 0.02 to 0.13 mass % of C, and 0.0080 to 0.0250 mass % of N, and the finisher deliver temperature and the coiling temperature are controlled to leave a large amount of dissolved N in the steel, thereby forming a composite structure as a metal structure mainly composed of ferrite and martensite. Therefore, an increase of 100 MPa or more in tensile strength is achieved at the heat treatment temperature of 170° C. after forming.

Japanese Unexamined Patent Application Publication No. 10-183301 discloses a hot-rolled steel sheets having excellent baking hardenability and natural aging resistance, in which the C and N contents are limited to 0.01 to 0.12 mass % and 0.0001 to 0.01 mass %, respectively, and the average crystal grain diameter is controlled to 8 μm or less to ensure a BH amount of as high as 80 MPa or more, and suppress the AI amount to 45 MPa or less.

However, this steel sheet is a hot-rolled sheet, and is thus difficult to obtain a high r value because the ferrite aggregation texture is made random due to austeniste-ferrite transformation. Therefore, the steel sheet cannot be said to have sufficient deep drawability.

Furthermore, even if the hot-rolled steel sheet obtained by this technique is used as a starting material for cold rolling and recrystallization annealing, the increase in tensile strength obtained after forming and heat treatment is not always equivalent to a hot-rolled steel sheet, and a BH amount of as high as 80 MPa or more cannot be always obtained. This is because the microstructure of the cold-rolled steel becomes different from that of hot-rolled one due to cold rolling and recrystallization annealing, and strain greatly accumulates during cold rolling to easily form a carbide, a nitride or a carbonitride, thereby changing the states of dissolved C and dissolved N.

In consideration of the above-described present conditions, an object of the present invention is to provide a cold-rolled steel sheet and a hot-dip galvanized steel sheet (including an alloyed steel sheet) for deep drawing, which have excellent deep drawability, TS×r value≧750 MPa, and excellent strain aging hardenability (BH≧80 MPa and ΔTS≧40 MPa), and an effective method of producing these steel sheets.

Another object of the present invention is to solve the above problems of the conventional techniques and provide a high-tensile-strength cold-rolled steel sheet which is suitable for automobile parts required to have high moldability, softness and high moldability, and stable material properties, and which can easily be molded to an automobile part having a complicated shape without producing shape defects such as spring back, twisting, and curving, and cracking, etc., and which has sufficient strength as an automobile part after heat treatment of a molded automobile part to permit sufficient contribution to a reduction in body weight of an automobile, a high r value of 1.2 or more, and excellent strain age hardenability. A further object of the present invention is to provide an industrial production method capable of producing the steel sheet at low cost without disturbing its shape.

DISCLOSURE OF INVENTION

In order to achieve the objects, the inventors produced various steel sheets having different compositions under various production conditions, and experimentally evaluated various material properties. As a result, it was found that both moldability and hardenability after forming can be improved by using as a strengthening element N, which has not be positively used before in a field requiring high processability, and effectively using the great strain age hardening phenomenon manifested by the action of the strengthening element.

The inventors also found that in order to advantageously use the strain age hardening phenomenon due to N, the strain age hardening phenomenon due to N must be advantageously combined with a condition for coating and baking an automobile, or further positively combined with a heat treatment condition after forming. It was thus found to be effective to appropriately control the hot rolling condition, the cold rolling and the cold rolling annealing condition to control the microstructure of a steel sheet and the amount of dissolved N in certain ranges. It was also found that in order to stably manifest the strain age hardening phenomenon due to N, it is important to control the Al content of the composition according to the N content.

The inventors further found that in order to obtain a high r value, the C content is decreased, continuous annealing is performed in the ferrite-austenite two-phase temperature region, and subsequent cooling is controlled to form a structure containing an acicular ferrite phase at an area ratio of 5% or more in the ferrite phase. Such a combination of the microstructure and the appropriate amount of dissolved N was found to enable the achievement of a cold-rolled steel sheet having a high r value, excellent press moldability, and excellent strain age hardenability. This was also found to permit sufficient use of N without causing the problem of natural aging deterioration, which is the problem of a conventional bake-hardening steel sheet.

Namely, the inventors found that by suing N as a strengthening element, controlling the Al content according to the N content in an appropriate range, and appropriately controlling the hot rolling condition and the cold rolling annealing condition to appropriately control the microstructure and dissolved N, it is possible to obtain a steel sheet having a high r value and excellent moldability as compared with conventional solid-solution strengthening-type C—Mn steel sheets and precipitation strengthening-type steel sheets, and strain age hardenability, which is not possessed by the conventional steel sheets.

A steel sheet of the present invention exhibits higher strength after coating and baking in a simple tensile test, as compared with a conventional steel sheet, and exhibits small variations in strength in plastic deformation under actual pressing conditions and stable part strength, thereby enabling application to parts required to have reliability. For example, a portion where large strain is applied to decrease the thickness has higher hardenability than other portions, and is considered homogeneous when being evaluated based on a surcharge load ability of (thickness)×(strength), thereby stabilizing strength as a part.

As a result of further intensive research for achieving the objects, the inventors found the following:

1) In order to increase tensile strength after forming and heat treatment, a new dislocation must be introduced for progressing tensile deformation. The movement of the dislocation introduced by pre-deformation must be prevented by interaction between the dislocation introduced by forming and an interstitial element or a precipitate even when upper yield stress is attained.

2) In order to obtain the above interaction by forming a carbide, a nitride or a carbonitride of W, Cr, Mo, Ti, Nb, Al or the like, the heat treatment temperature after forming must be increased to 200° C. or more. Therefore, it is more advantageous to positively use the interstitial element or a Fe carbide or Fe nitride because the heat treatment temperature after forming is decreased.

3) Of interstitial elements, dissolved N has the higher interaction with a dislocation introduced by forming than dissolved C even when the heat treatment temperature after forming is decreased, and thus a dislocation introduced by pre-deformation less moves when upper yield stress is attained.

4) Although dissolved N is present in crystal grains and crystal grain boundaries in steel, the increase in strength after forming and heat treatment increases as the area of the crystal grain boundaries increases. Namely, the smaller crystal grain diameter is advantageous.

5) In order to increase the crystal grain boundary area, it is advantageous to add a combination of Nb and B and cool immediately after the end of hot rolling, suppressing normal grain growth of ferrite grains after the end of hot rolling and suppressing grain growth by recrystallization annealing after cold rolling.

The present invention has been achieved based on the above findings. The findings were obtained from the experiment described below.

Experiment 1

A sheet bar (thickness: 30 mm) having a composition containing, by mass %, 0.0015% of C, 0.0010% of B, 0.015 of Si, 0.5% of Mn, 0.03% of P, 0.08% of S and 0.011% of N, 0.005 to 0.05% of Nb and 0.005 to 0.03% of Al, and the balance composed of Fe and inevitable impurities was uniformly heated at 1150° C., hot-rolled by three passes so that the temperature of the final pass was 900° C. higher than the $Ar_3$ transformation point, and then cooled with water for 0.1second. Then, the sheet bar was subjected to heat treatment corresponding to coiling at 500° C. for 1 hour.

The thus-obtained hot-rolled sheet having a thickness of 4 mm was cold-rolled with a rolling reduction ratio of 82.5%, recrystallized and annealed at 800° C. for 40 seconds, and then temper-rolled with a rolling reduction ratio of 0.8%. Then, a tensile test specimen of JIS No. 5 was obtained from the resultant cold-rolled sheet in the rolling direction, and tensile strength was measured with a strain rate of 0.02/s by using a general tensile testing machine. Also, tensile strain of 10% was applied to a tensile test specimen of JIS No. 5 separately obtained from the cold-rolled sheet in the rolling direction, and then the specimen was subjected to a normal tensile test after heat treatment at 120° C. for 20 minutes. The difference between the tensile strength of the specimen obtained from the cold-rolled sheet and the tensile strength of the specimen heat treated at 120° C. for 20 minutes after application of 10% tensile strain was considered as the increase in tensile strength after forming (ΔTS).

FIG. 1 shows the results of measurement of the relation between the steel compositions (N %—14/93·Nb %—14/27·Al %—14/11·B %) and ΔTS.

The figure indicates that ΔTS becomes 60 MPa or more when the value of (N %—14/93·Nb %—14/27·Al %—14/11·B %), satisfies 0.0015 mass Experiment 2

A sheet bar (thickness: 30 mm) having a composition containing, by mass %, 0.0010% of C, 0.02 of Si, 0.6% of Mn, 0.01% of P, 0.009% of S and 0.012% of N, 0.01% of Al, 0.015% of Nb, 0.00005 to 0.0025% of B, and the balance composed of Fe and inevitable impurities was uniformly heated at 1100° C., hot-rolled by three passes so that the temperature of the final pass was 920° C. higher than the $Ar_3$ transformation point, and then cooled with water for 0.1 second. Then, the sheet bar was subjected to heat treatment corresponding to coiling at 450° C. for 1 hour.

The thus-obtained hot-rolled sheet having a thickness of 4 mm was cold-rolled with a rolling reduction ratio of 82.5%, recrystallized and annealed at 820° C. for 40 seconds, and then temper-rolled with a rolling reduction ratio of 0.8%. Then, a tensile test specimen of JIS No. 5 was obtained from the resultant cold-rolled sheet in the rolling direction, and tensile strength was measured with a strain rate of 0.02/s by using a general tensile testing machine. Also, tensile strain of 10% was applied to a tensile test specimen of JIS No. 5 separately obtained from the cold-rolled sheet in the rolling direction, and then the specimen was subjected to a normal tensile test after heat treatment at 120° C. for 20 minutes.

FIG. 2 shows the results of measurement of the relation between the B content of steel and ΔTS. This figure indicates that with a B content of 0.0005 to 0.0015 mass %, a high ΔTS of 60 MPa or more can be obtained.

As a result of observation of the microstructure, it was also found that by adding a combination of Nb and B to make fine crystal grains, a high ΔTS can be obtained.

Namely, with a B content of less than 0.0005 mass %, the effect of making fine crystal grains by adding a combination with Nb is small. On the other hand, with a B content of over 0.0015 mass %, the amount of B segregated in the grain boundaries and the vicinities thereof is increased to decrease the amount of effective dissolved N because of the strong interaction between B atoms and N atoms, thereby possibly decreasing ΔTS.

Experiment 3

A sheet bar (thickness: 30 mm) of each of steel A having, a composition containing, by mass %, 0.0010% of C, 0.012% of N, 0.0010% of B, 0.01% of Si, 0.5% of Mn, 0.03% of P, 0.008% of S, 0.014% of Nb, 0.01% of Al, and the balance composed of Fe and inevitable impurities, and steel B having a composition containing, by mass %, 0.010% of C, 0.0012% of N, 0.0010% of B, 0.01% of Si, 0.5% of Mn, 0.03% of P, 0.008% of S, 0.014% of Nb, 0.01% of Al, and the balance composed of Fe and inevitable impurities was uniformly heated at 1150° C., hot-rolled by three passes so that the temperature of the final pass was 910° C. higher than the $Ar_3$ transformation point, and then cooled with a gas for 0.1 second. Then, each of the sheet bars was subjected to heat treatment corresponding to coiling at 600° C. for 1 hour.

Each of the thus-obtained hot-rolled sheets having a thickness of 4 mm was cold-rolled with a rolling reduction ratio of 82.5%, recrystallized and annealed at 880° C. for 40 seconds, and then temper-rolled with a rolling reduction ratio of 0.8%.

Then, a tensile test specimen of JIS No. 5 was obtained from each of the resultant cold-rolled sheets in the rolling direction, and tensile strength was measured with a strain rate of 0.02/s by using a general tensile testing machine. Also, tensile strain of 10% was applied to a tensile test specimen of JIS No. 5 separately obtained from each of the cold-rolled sheets in the rolling direction, and then the specimen was subjected to a normal tensile test after heat treatment at various temperatures for 20 minutes.

FIG. 3 shows the results of measurement of the influence of the heat treatment temperature after forming on ΔTS. This figure indicates that in the relatively low temperature region of heat treatment temperatures of 200° C. or less after forming, the ultra-low carbon steel A having a high N content exhibits higher ΔTS than the semi-ultra low carbon steel B having a low N content, and while in the high temperature region, both steel materials exhibit substantially the same ΔTS. There experimental results reveal that in order to ensure ΔTS in the low temperature region, it is effective to use dissolved N.

FIG. 4 shows the results of measurement of the influences of the crystal grain diameter d and steel compositions (N %—14/93·Nb %—14/27·—Al %—14/11·B %) on a decrease (ΔEl) in elongation by natural aging and an increase in tensile strength (ΔTS) after forming. The decrease (ΔEl) in elongation was evaluated by the difference between the total elongation measured with the test specimen of JIS NO. 5 obtained from each of the cold-rolled sheets in the rolling direction, and the total elongation measured with the separately obtained test specimen after holding at 100° C. for 8 hours for accelerating natural aging.

FIG. 4 indicates that when the value of (N %—14/93·Nb %—14/27·Al %—14/11·B %) is 0.0015 mass % or more, and the crystal grain diameter d is 20 μm or less, both high ΔTS and low ΔEl can be achieved.

Experiment 4

A sheet bar of steel containing 0.0015% of C, 0.30 of Si, 0.8% of Mn, 0.03% of P, 0.005% of S and 0.012% of N, and 0.02 to 0.08% of Al was uniformly heated at 1050° C., hot-rolled by seven passes so that the temperature of the final pass was 670° C., and then recrystallized and annealed at 700° C. for 5 hours. The thus-obtained hot-rolled sheet having a thickness of 4 mm was cold-rolled with a rolling reduction ratio of 82.5%, recrystallized, and annealed at 875° C. for 40 seconds, and then temper-rolled with a rolling reduction of 0.8%. Then, a tensile test specimen of JIS No. 5 was obtained from the resultant cold-rolled sheet in the rolling direction, and TS×r value and ΔTS were measured with a strain rate of $3\times10^{-3}$/s by using a general tensile testing machine. The results are shown in FIG. 5. In this figure, when N/Al≧0.03 is satisfied, TS×r value 750 and ΔTS≧40 MPa are achieved. It was also confirmed that when N/Al≧0.03, BH≧80 MPa is attained.

Experiment 5

A sheet bar of steel containing 0.0015% of C, 0.0010% of B, 0.01 of Si, 0.5% of Mn, 0.03% of P, 0.008% of S and 0.011% of N, 0.005 to 0.05% of Nb, and 0.005 to 0.03% of Al was uniformly heated at 1000° C., hot-rolled by seven passes so that the temperature of the final pass was 650° C., and then recrystallized and annealed at 800° C. for 60 seconds. The thus-obtained hot-rolled sheet having a thickness of 4 mm was cold-rolled with a rolling reduction ratio of 82.5%, recrystallized and annealing at 880° C. for 40 seconds, and then temper-rolled with a rolling reduction ratio of 0.8%. Then, a tensile test specimen of JIS No. 5 was obtained from the resultant cold-rolled sheet in the rolling direction, and TS×r value, BH and ΔTS were measured with a strain rate of $3\times10^{-3}$/s by using a general tensile testing machine. The relations between the measured values and N/(Al+Nb+B) are shown in FIG. 5. In this experiment, steel containing 0.005 to 0.05% of Nb and 0.0010% of B was used. This figure indicates that in the range of N/(Al+Nb+B)≧0.30, BH≧80 MPa, ΔTS≧60 MPa, and TS×r value≧850 are achieved.

Experiment 6

A sheet bar of steel containing 0.0010% of C, 0.02 of Si, 0.6% of Mn, 0.01% of P, 0.009% of S and 0.015% of N, 0.01% of Al, 0.015% of Nb and 0.0001 to 0.0025% of B was uniformly heated at 1050° C., hot-rolled by seven passes so that the temperature of the final pass was 680° C., and then recrystallized and annealed at 850° C. for 5 hours. The thus-obtained hot-rolled sheet having a thickness of 4 mm was cold-rolled with a rolling reduction ratio of 82.5%, recrystallized and annealed at 880° C. for 40 seconds, and then temper-rolled with a rolling reduction ratio of 0.8%. Then, a tensile test specimen of JIS No. 5 was obtained from the resultant cold-rolled sheet in the rolling direction, and TS×r value, BH and ΔTS were measured with a strain rate of $3\times10^{-3}$/s by using a general tensile testing machine. The relations between the measured values and the B content are shown in FIG. 6.

This figure indicates that in the B content range of 0.0003 to 0.0015%, BH≧80 MPa, ΔTS≧60 MPa, which is higher than the case of B<0.0003%, and TS×r value≧850 are achieved. As a result of observation of the microstructure it was also confirmed that in this B range, crystal grains are significantly made fine.

The results shown in FIGS. 5 and 6 indicate that in the range of N/(Al+Nb+B)≧0.30 wherein B≧0.0003%, the crystal grains are further made fine by combining Nb, and ΔTS and the level of TS×r value are further improved. When B<0.00.03%, the effect of making fine crystal grains by combining Nb is not exhibited. On the other hand, when B>0.0015%, properties further deteriorate. This is possibly due to the fact that the amount of B segregated in the grain boundaries and the vicinities thereof is increased to decrease the amount of effective dissolved N due to the strong interaction between B and N atoms. The same research as described above was carried out for the case in which Ti and V were added in place of Nb, and it was confirmed that the same effect as Nb could be obtained. The present invention has been achieved based on the above-described findings, and the gist of the invention was follows.

In a first aspect of the present invention, a cold-rolled steel sheet having excellent strain age hardenability comprises a composition, by mass %, comprising:

C: 0.15% or less;

Si: 1.0% or less;

Mn: 2.0% or less;

P: 0.1% or less;

S: 0.01% or less;

Al: 0.005 to 0.030%; and

N: 0.0050 to 0.0400%;

wherein N/Al is 0.30 or more, the amount of dissolved N is 0.0010% or more, and the balance is composed of Fe and inevitable impurities.

In the first aspect of the present invention, the above-described composition preferably comprises the compositions in the following ranges. Namely, a cold-rolled steel sheet having excellent strain age hardenability comprises a composition, by mass %, comprising:

C: less than 0.01%;

Si: 0.005 to 1.0%;

Mn: 0.01 to 1.5%;

P: 0.1% or less;

S: 0.01% or less;

Al: 0.005 to 0.030%; and

N: 0.005 to 0.040%;

wherein N/Al is 0.30 or more, the amount of dissolved N is 0.0010% or more, and the balance is composed of Fe and inevitable impurities.

In the first aspect of the present invention, the composition, by mass %, preferably further comprises:

B: 0.0001 to 0.0030%; and

Nb: 0.005 to 0.050%;

wherein the ranges of B and Nb satisfy the following equations (1) and (2):

$$N\ \% \geqq 0.0015+14/93\cdot Nb\ \%+14/27\cdot Al\ \%+14/11\cdot B\ \% \quad (1)$$

$$C\ \% \leqq 0.5\cdot(12/93)\cdot Nb\ \% \quad (2)$$

In the first aspect of the present invention, the above composition, by mass %, preferably further comprises at least one of Cu, Ni and Mo in a total of 1.0% or less according to demand.

In the first aspect of the present invention, the steel sheet preferably has A crystal grain diameter of 20 μm or less.

In the first aspect of the present invention, strength after forming is preferably increased by 60 MPa or more by heat treatment in the low temperature region of 120 to 200° C.

In the first aspect of the present invention, the surface of the cold-rolled steel sheet may be coated by electro-galvanization, hot-dip galvanization, or alloying hot-dip galvanization.

In a second aspect of the present invention, a method of producing a cold-rolled steel sheet having excellent strain age hardenability comprises hot-rolling a steel slab under conditions in which the slab is cooled immediately after the end of finish rolling and coiled at a coiling temperature of 400 to 800° C., cold-rolling the hot-rolled sheet with a rolling reduction ratio of 60 to 95%, and then performing recrystallization annealing at a temperature of 650 to 900° C., wherein the steel slab has a composition, by mass %, comprising:

C: less than 0.01%;

Si: 0.005 to 1.0%;

Mn: 0.01 to 1.5%;

P: 0.1% or less;

S: 0.01% or less;

Al: 0.005 to 0.030%; and

N: 0.005 to 0.040%;

wherein N/Al is 0.30 or more, and the balance is substantially composed of Fe.

In the second aspect of the present invention, the composition, by mass %, preferably further comprises:

B: 0.0001 to 0.0030%; and

Nb: 0.005 to 0.050%;

wherein the ranges of B and Nb satisfy the following equations (1) and (2):

$$N\ \% \geqq 0.0015+14/93\cdot Nb\ \%+14/27\cdot Al\ \%+14/11\cdot B\ \% \quad (1)$$

$$C\ \% \leqq 0.5\cdot(12/93)\cdot Nb\ \% \quad (2)$$

In the second aspect of the present invention, in the heating-up step in recrystallization annealing, the temperature is preferably increased at a rate off 1 to 20° C./s in the temperature region from 500° C. to the recrystallization temperature.

In the second aspect of the present invention, hot-dip galvanization and heat alloying may be performed after the recrystallization annealing.

In a third aspect of the present invention, a cold-rolled deep drawing steel sheet having excellent strain age hardenability comprises a composition, by mass %, comprising:

C: 0.01% or less;
Si: 1.0% or less;
Mn: 0.01 to 1.5%;
P: 0.1% or less;
S: 0.01% or less;
Al: 0.005 to 0.020%; and
N: 0.0050 to 0.040%;

wherein N/Al is 0.30 or more, the amount of dissolved N is 0.0010% or more, the balance is composed of Fe and inevitable impurities, and Ts×r value is 750 MPa or more.

In the third aspect of the present invention, the composition, by mass %, preferably further comprises:

B: 0.0001 to 0.0030%; and
Nb: 0.005 to 0.050%;

wherein the ranges of B and Nb satisfy the following equations (1) and (2):

$$N\,\% \geqq 0.0015+14/93\cdot Nb\,\%+14/27\cdot Al\,\%+14/11\cdot B\,\% \quad (1)$$

$$C\,\% \leqq 0.5\cdot(12/93)\cdot Nb\,\% \quad (2)$$

In the third aspect of the present invention, the composition, by mass %, preferably further comprises at least one of the following:

B: 0.0001 to 0.0030%;
Nb: 0.005 to 0.050%;
Ti: 0.005 to 0.070%; and
V: 0.005 to 0.10%;

wherein N/(Al+Nb+Ti+V+B) is 0.30 or more, and the amount of dissolved N is 0.0010% or more.

In a fourth aspect of the present invention, a method of producing a cold-rolled deep drawing steel sheet having excellent strain age hardenability comprises heating a steel raw material to 950° C. or more, roughly rolling the raw material so that the finisher delivery temperature is $Ar_3$ to 1000° C., finish-rolling the material while lubricating it in the temperature region of 600° C. to $Ar_3$, coiling the rolled sheet in which the total reduction ratio by rolling starting from rough rolling to finish rolling is 80% or more, recrystallizing and annealing the hot-rolled sheet, cold-rolling the rolled sheet with a rolling reduction ratio of 60 to 95%, and then recrystallizing and annealing the resultant cold-rolled sheet, wherein the steel raw material has a composition, by mass %, comprising:

C: 0.01% or less;
Si: 0.005 to 1.0%;
Mn: 0.01 to 1.0%;
P: 0.1% or less;
S: 0.01% or less;
Al: 0.005 to 0.030%;
N: 0.005 to 0.040%; and
at least one of the following:
B: 0.0003 to 0.0030%;
Nb: 0.005 to 0.050%;
Ti: 0.005 to 0.070%; and
V: 0.005 to 0.10%;

wherein N/(Al+Nb+Ti+V+B) is 0.30 or more.

In a fifth aspect of the present invention, a high-tensile-strength cold-rolled steel sheet having excellent, moldability, strain age hardenability and natural aging resistance comprises a composition, by mass %, comprising:

C: 0.0015 to 0.025%;
Si: 1.0% or less;
Mn: 2.0% or less;
P: 0.1% or less;
S: 0.02% or less;
Al: 0.02% or less;
N: 0.0050 to 0.0250%; and
one or both of the following:
B: 0.0005 to 0.0050%; and
Nb: 0.002 to 0.050%;

wherein N/Al is 0.30 or more, the amount of dissolved N is 0.0010% or more, the balance is composed of Fe and inevitable impurities, the structure is composed of an acicular ferrite phase at an area ratio of 5% or more and a ferrite phase having an average crystal grain diameter of 20 μm or less, and the r value is 1.2 or more.

In the fifth aspect of the present invention, the composition preferably further comprises at least one of the following groups a to c:

Group a: at least one of Cu, Ni, Cr and Mo in a total of 1.0% or less;

Group b: one or both of Ti and V in a total of 0.1% or less; and

Group c: one or both of Ca and REM in a total of 0.0010 to 0.010%.

In a sixth aspect of the present invention, a method of producing a high-tensile-strength cold-rolled steel sheet having a r value of 1.2 or more, and excellent moldability, strain age hardenability and natural aging resistance comprises:

the hot-rolling step of roughly rolling a steel slab by heating to a slab heating temperature of 1000° C. or more to form a sheet bar, finish-rolling the sheet bar so that the finisher delivery temperature is 800° C. or more, and coiling the finish-rolled sheet at a coiling temperature of 650° C. or less to form a hot-rolled sheet;

the cold rolling step of pickling and cold-rolling the hot-rolled sheet to form a cold-rolled sheet; and the cold-rolled sheet annealing step of continuously annealing the cold-rolled sheet at a temperature in the ferrite-austenite two-phase region, and cooling the annealed sheet to the temperature region of 500° C. or less at a cooling rate of 10 to 300° C./s;

wherein the steel slab has a composition, by mass %, comprising at least one of:

C: 0.0015 to 0.025%;
Si: 1.0% or less;
Mn: 2.0% or less;
P: 0.1% or less;
S: 0.02% or less;
Al: 0.02% or less;
N: 0.0050 to 0.0250%;
B: 0.0003 to 0.0050%; and
Nb: 0.0021 to 0.050%;

wherein N/Al is 0.30 or more.

In the sixth aspect of the present invention, the composition preferably further comprises, by mass %, at least one of the following groups a to c:

Group a: at least one of Cu, Ni, Cr and Mo in a total of 1.0% or less;

Group b: one or both of Ti and V in a total of 0.1% or less; and

Group c: one or both of Ca and REM in a total of 0.0010 to 0.010%.

In a seventh aspect of the present invention, a high-tensile-strength cold-rolled steel sheet having a high r value and excellent strain age hardenability and natural aging resistance comprises a composition, by mass %, comprising:

C: 0.025 to 0.15%;

Si: 1.0% or less;

Mn: 2.0% or less;

P: 0.08% or less;

S: 0.02% or less;

Al: 0.02% or less; and

N: 0.0050 to 0.0250%;

wherein N/Al is 0.30 or more, the amount of dissolved N is 0.0010% or more, the balance is composed of Fe and inevitable impurities, the structure is composed of a ferrite phase having an average crystal grain diameter of 10 μm or less at an area ratio of 80% or more and a martensite phase as a second phase at an area ratio of 2% or more, and the revalue is 1.2 or more.

In the seventh aspect of the present invention, the composition preferably further comprises at least one of the following groups d to g:

Group d: at least one of Cu, Ni, Cr and Mo in a total of 1.0% or less;

Group e: at least one of Nb, Ti and V in a total of 0.1% or less;

Group f: 0.0030% or less of B; and

Group g: one or both of Ca and REM in a total of 0.0010 to 0.010%.

In an eighth aspect of the present invention, a method of producing a high-tensile-strength cold-rolled steel sheet having a r value of as high as 1.2 or more, and excellent strain age hardenability and natural aging resistance comprises:

the hot-rolling step of roughly rolling a steel slab by heating to a slab heating temperature of 1000° C. or more to form a sheet bar, finish-rolling the sheet bar so that the finisher delivery temperature is 800° C. or more, and coiling the finish-rolled sheet at a coiling temperature of 650° C. or less to form a hot-rolled sheet;

the cold rolling step of pickling and cold-rolling the hot-rolled sheet to form a cold-rolled sheet; and the cold-rolled sheet annealing step of box-annealing the cold-rolled sheet at an annealing temperature of the recrystallization temperature to 800° C., then continuously annealing the annealed sheet at an annealing temperature of $Ac_1$ transformation point to ($Ac_3$ transformation point 20° C.), and then cooling the sheet to the temperature region of 500° C. or less at a cooling rate of 10 to 300° C./s;

wherein the steel slab has a composition, by mass %, comprising at least one of:

C: 0.025 to 0.15%;

Si: 1.0% or less;

Mn: 2.0% or less;

P: 0.08% or less;

S: 0.02% or less;

Al: 0.02% or less; and

N: 0.0050 to 0.0250%;

wherein N/Al is 0.30 or more.

In the eighth aspect of the present invention, over aging after the cooling step of the continuous annealing is preferably carried out in the temperature range of 350° C. or more for a residual time of 20 seconds or more.

In the eighth aspect of the present invention, the composition preferably further comprises, by mass %, at least one of the following groups d to g:

Group d: at least one of Cu, Ni, Cr and Mo in a total of 1.0% or less;

Group e: at least one of Nb, Ti and V in a total of 0.1% or less;

Group f: 0.0030% or less of B; and

Group g: one or both of Ca and REM in a total of 0.0010 to 0.010%.

BEST MODE FOR CARRYING OUT THE INVENTION

Figure 1:
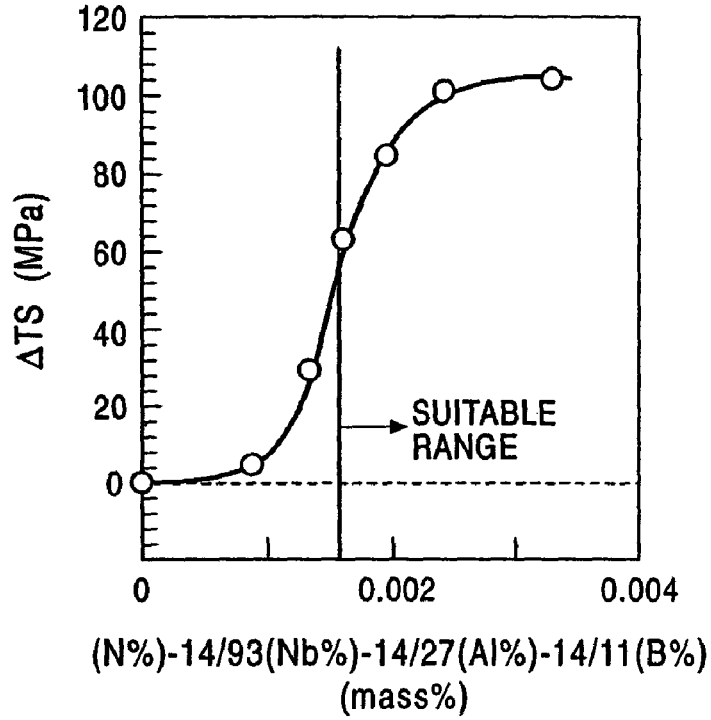
FIG. 1 shows the relation between steel compositions, (N %—14/93·Nb %—14/27·Al %—14/11·B %) and the increase in tensile strength (ΔTS) after forming.
Figure 2:
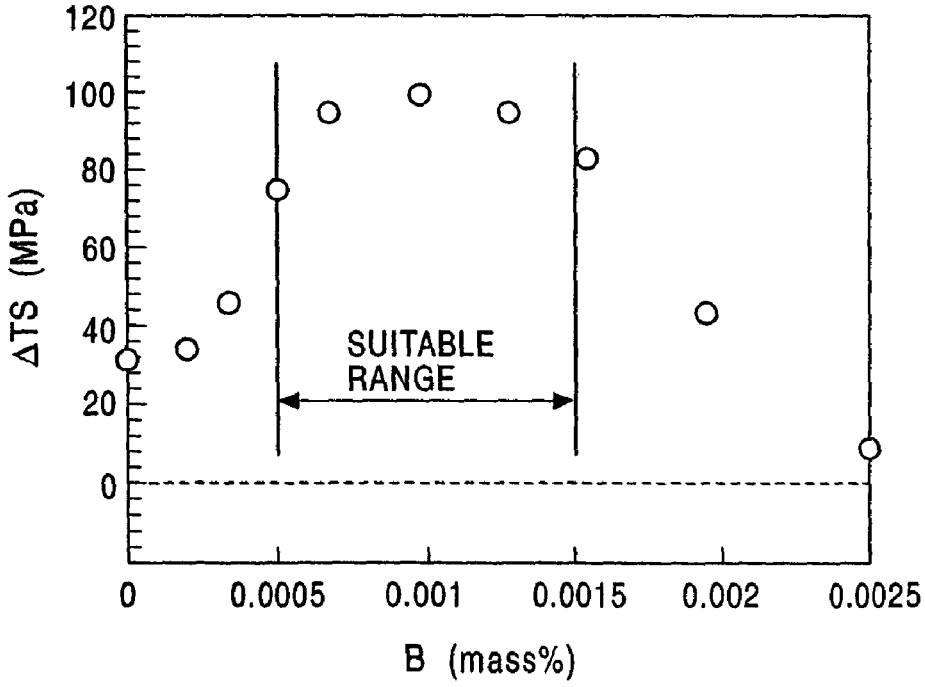
FIG. 2 shows the relation between the B content and ΔTS of steel containing a combination Nb and B.
Figure 3:
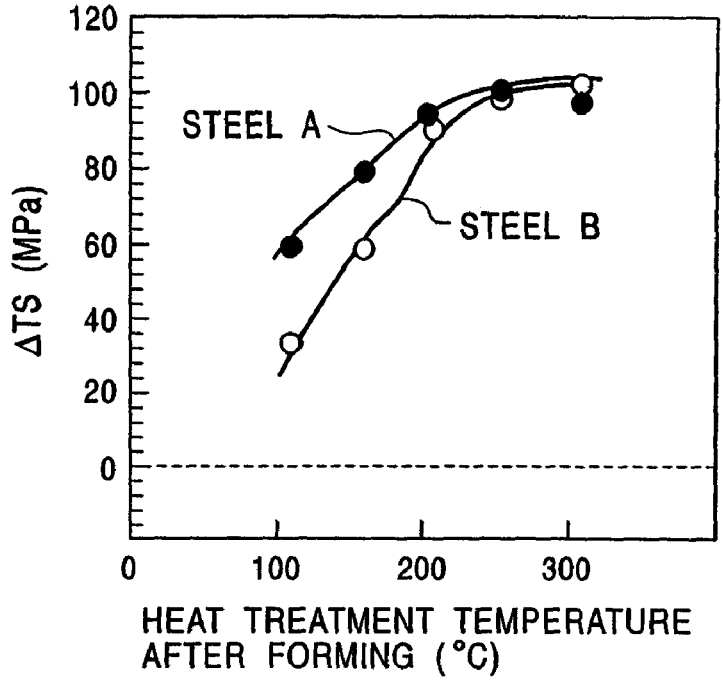
FIG. 3 shows comparison of the difference in increase in tensile strength by heat treatment after forming in a low temperature region between steel B (conventional steel) containing a large amount of dissolved C and steel A (steel of this invention) containing a large amount of dissolved N.

Description will now be made of the reasons for limiting compositions to the ranges below in accordance with a first embodiment of the present invention.

C: Less Than 0.01 Mass %

From the viewpoint of excellent deep drawability and press moldability, C is advantageously as small as possible. Also, redissolution of NbC proceeds in the annealing step after cold rolling to increase the amount of dissolved C in crystal grains, thereby easily causing deterioration in natural aging resistance. Therefore, the C amount is preferably suppressed to less than 0.01 mass %, more preferably 0.0050 mass % or less, and most preferably 0.0030 mass % or less.

Si: 0.005 to 1.0 Mass %

Si is a useful composition for suppressing a decrease in elongation, and improving strength. However, with a Si content of less than 0.005 mass %, the effect of addition of Si is insufficient, while with a Si content of over 1.0 mass %, surface properties deteriorate to deteriorate ductility. Therefore, the Si content is limited to the range of 0.005 to 1.0 mass %, and preferably the range of 0.01 to 0.75 mass , %.

Mn: 0.01 to 1.5 Mass %

Mn not only is useful as a strengthening composition for steel, but also has the function to suppress embrittlement with S due to the formation of MnS. However, with a Mn content of less than 0.01 mass %, the effect of addition of Mn is insufficient, while with a Mn content of over 1.5 mass %, surface properties deteriorate to deteriorate ductility. Therefore, the Mn content is limited to the range of 0.01 to 1.5 mass %, and preferably the range of 1.10 to 0.75 mass %.

P: 0.01 Mass % or Less

P is a solid solution strengthening element which effectively contributes to reinforcement of steel. However, with a P content of over 0.01 mass %, deep drawability deteriorates due to the formation of phosphide such as $(FeNb)_xP$ or the like. Therefore, P is limited to 0.10 mass % or less.

S: 0.01 Mass % or Less

With a high S content, the amount of inclusions is increased to deteriorate ductility. Therefore, contamination with S is preferably prevented as much as possible, but an S content up to 0.01 mass % is allowable.

Al: 0.005 to 0.030 Mass %

Al is added as a deoxidizer for improving the yield of carbonitride forming components. However, with an Al content of less than 0.005 mass %, the effect is insufficient, while with an Al content of over 0.030 mass %, the amount of N to be added to steel is increased to easily cause slab defects during steel making. Therefore, Al is contained in the range of 0.005 to 0.030 mass %.

N: 0.005 to 0.040 Mass %

In the present invention, N is an important element which plays the role of imparting strain age hardenability to a steel sheet. However, with an N content of less than 0.005 mass %, a sufficient strain age hardenability cannot be obtained, while with an N content of as high as over 0.040 mass %, press moldability deteriorates. Therefore, N is contained in the range of 0.005 to 0.040 mass %, and preferably in the range of 0.008 to 0.015 mass %.

B: 0.0001 to 0.003 Mass %

B is added in a combination with Nb to exhibit the function to effectively make fine the hot-rolled structure and the cold-rolled recrystallized annealed structure and to improve cold-work embrittlement resistance. However, with a B content of less than 0.0001 mass %, the sufficient effect of making fine the structures cannot be obtained, while with a B content of over 0.003 mass %, the amount of BN precipitate is increased, and dissolution in the slab heating step is hindered. Therefore, B is contained in the range of 0.0001 to 0.003 mass %, preferably in the range of 0.0001 to 0.0015 mass %, and more preferably in the range of 0.0007 to 0.0012 mass Nb: 0.005 to 0.050 Mass %

Nb is added in a combination with B to contribute to refinement of the hot-rolled structure and the cold-rolled recrystallized annealed structure, and have the function to fix dissolved C as NbC. Furthermore, Nb forms a nitride NbN to contribute to refinement of the cold-rolled recrystallized annealed structure. However, with a Nb content of less than 0.005 mass %, not only it becomes difficult to precipitate and fix dissolved C, but also the hot-rolled structure and the cold-rolled, recrystallized, annealed structure are not sufficiently made fine, while with a Nb content of over 0.050 mass %, ductility deteriorates. Therefore, Nb is contained in the range of 0.005 to 0.050 mass %, and preferably 0.010 to 0.030 mass %.

As described above, Nb has the function to fix dissolved C as NbC, and forms a nitride NbN. Similarly, Al and B form AlN and BN, respectively. Therefore, in order to ensure the sufficient amount of dissolved N and sufficiently decrease the amount of dissolved C, it is important to satisfy the following relations (I) and (2):

$$N\ \% \geqq 0.0015 + 14/93 \cdot Nb\ \% + 14/27 \cdot Al\ \% + 14/11 \cdot B\ \% \quad (1)$$

$$C\ \% \leqq 0.5 \cdot (12/93) \cdot Nb\ \% \quad (2)$$

In the present invention, in order to obtain a high strain aging property and prevent aging deterioration, the crystal grain diameter is preferably decreased.

Figure 4:
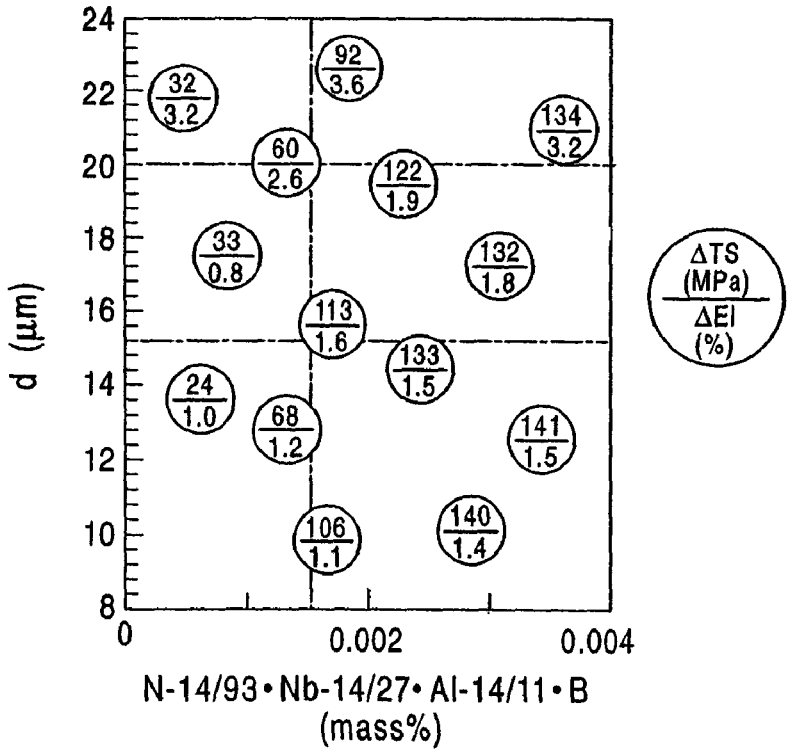
FIG. 4 shows the influence of the crystal grain diameter d and steel compositions (N %—14/93·Nb %—14/27·Al %—14/11·B %) on the decrease in elongation (ΔEl) due to na aging and the increase in tensile strength (ΔTS) after forming.
Figure 5:
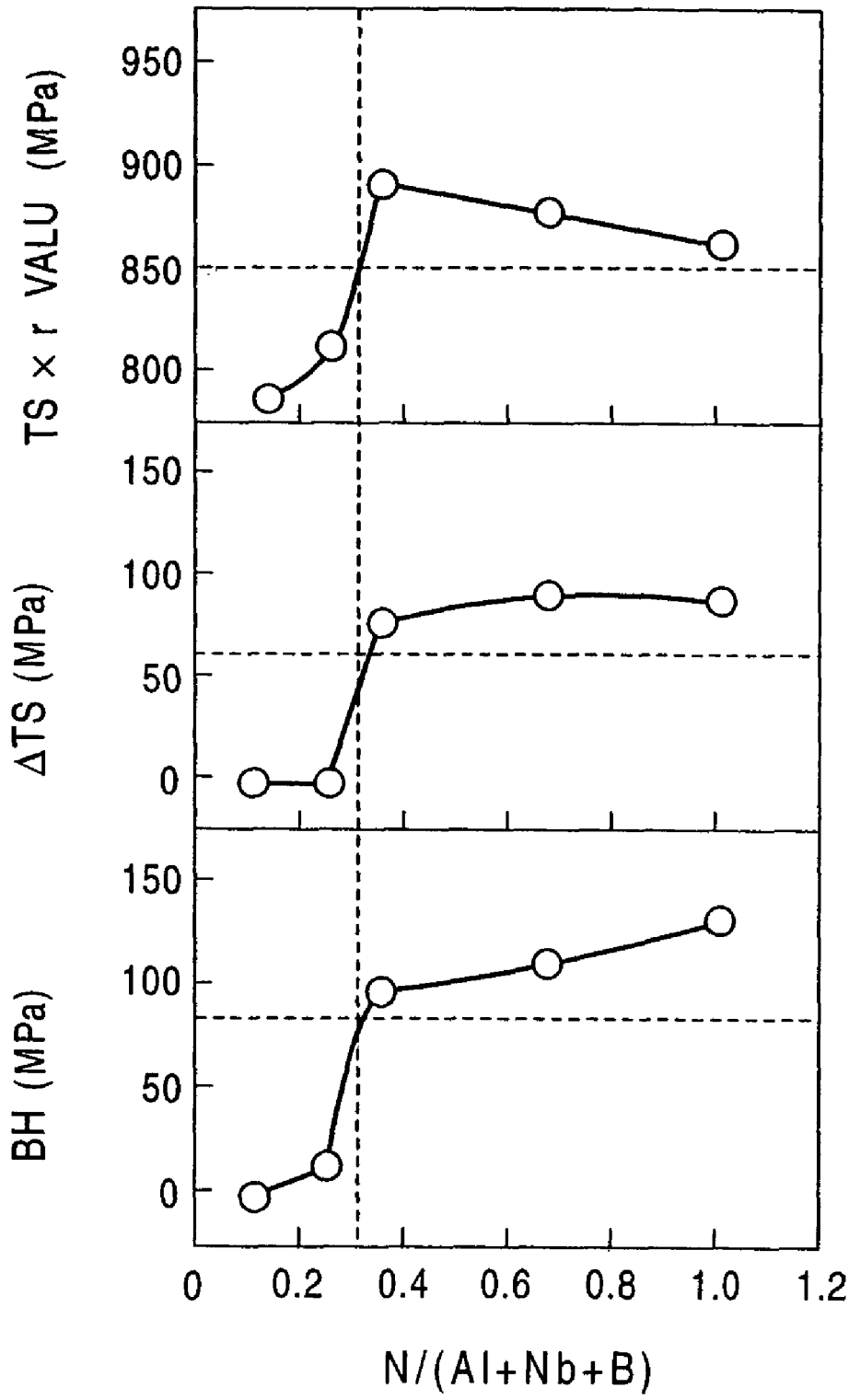
FIG. 5 shows the relations between Ts×r value, BH, ΔTS and N/(Al+Nb+B).
Figure 6:
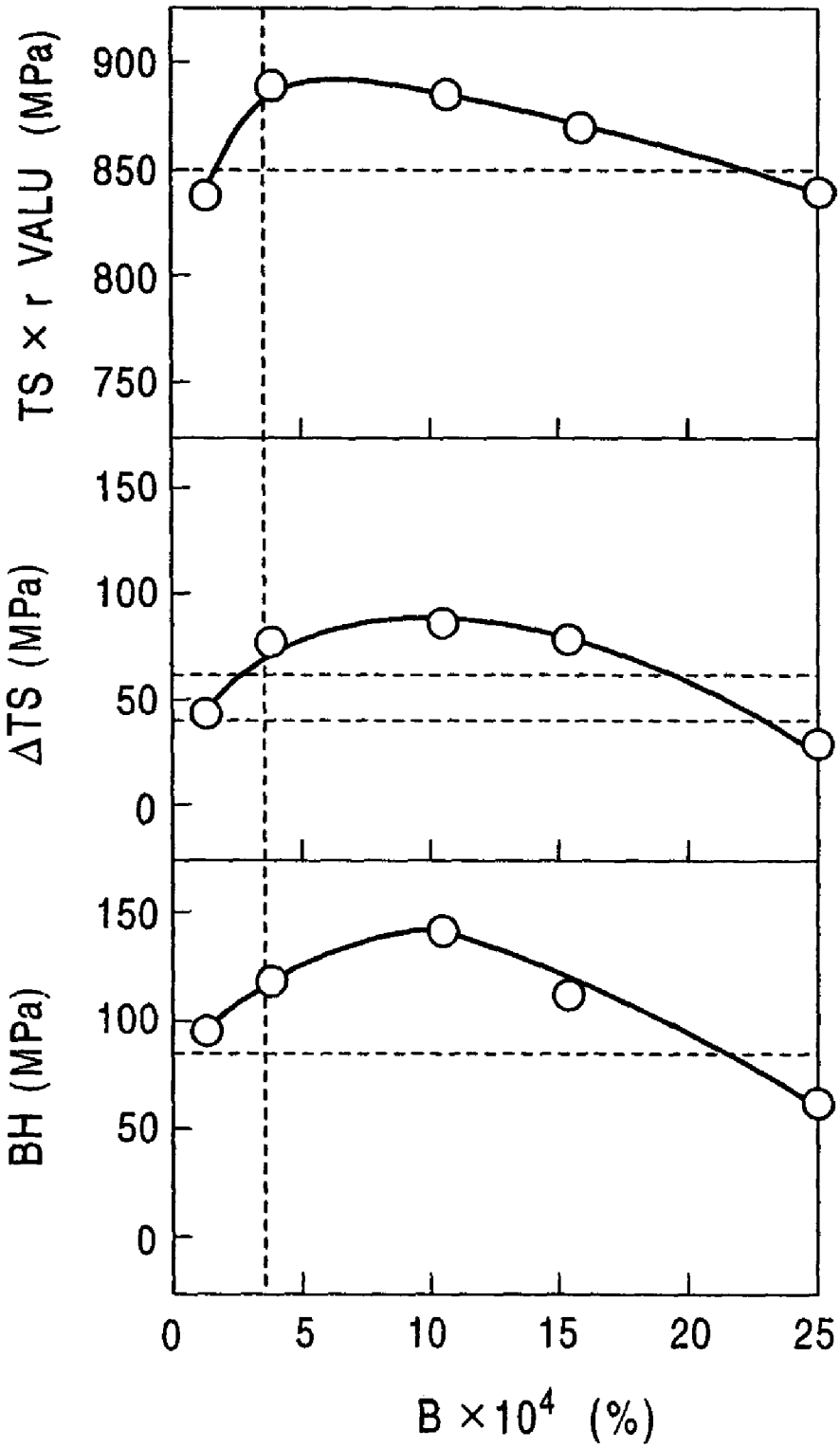
FIG. 6 shows the relations between Ts×r value, BH, ΔTS and the B amount.

Namely, as described above with reference to FIG. 4, even when (N %—14/93·Nb %—14/27·Al %—14/11·B %)≧0.0015 mass %, i.e., when a relatively large amount of dissolved N is contained, ΔEl can be suppressed to 2.0% or less by decreasing the crystal grain diameter d to 20 μm or less. The crystal grain diameter d is more preferably decreased to 15 μm or less. This is because, as shown in FIG. 4, ΔEl can be suppressed to 2.0% or less by decreasing the crystal grain diameter d to 15 μm or less.

The production conditions according to a second embodiment of the present invention will be described.

Steel having the above-described suitable composition is melted by a known melting method such as a converter or the like, and a steel slab is formed by an ingot making method or a continuous casting method.

Then, the steel slab is heated and soaked, and then hot-rolled to form a hot-rolled sheet. In the present invention, the heating temperature of hot rolling is not specified, but the heating temperature of hot rolling is preferably set to 1300° C. or less. This is because it is advantageous to fix and precipitate dissolved C as a carbide in order to improve deep drawability. In order to further improve processability, the heating temperature is preferably set to 1150° C. or less. However, with a heating temperature of less than 900° C., improvement in processability is saturated to conversely increase the rolling load in hot rolling, thereby increasing the danger of causing a rolling trouble. Therefore, the lower limit of the heating temperature is preferably 900° C.

The total rolling reduction ratio of hot rolling is preferably 70% or more. This is because with a toal rolling reduction ratio of less than 70%, the crystal grains of the hot-rolled sheet are not sufficiently made fine.

During hot rolling, finish rolling is preferably finished in the temperature region of 650 to 960° C., and the finishing temperature of hot-rolling may be in the γ region above the $Ar_3$ transformation point, or the a region below the $Ar_3$ transformation pint. With the finishing temperature in hot-rolling process over 960° C., the crystal grains of the hot-rolled sheet are coarsened to deteriorate deep drawability after cold rolling and annealing. On the other hand, with a temperature of less than 650° C., deformation resistance is increased to increase the hot-rolling load, causing difficulties in rolling.

Preferably, cooling is started immediately after the end of final rolling in hot-rolling process to prevent normal grain growth and suppress AlN precipitation in the cooling step.

Although the cooling condition is not limited, the starting time of the cooling step is preferably within 1.5 seconds, more preferably 1.0 second, and most preferably 0.5 second, after the end of finish rolling. This is because when cooling is performed immediately after the end of rolling, a large amount of ferrite nuclei is produced due to an increase in the degree of over cooling with accumulated strain to promote ferrite transformation and suppress the diffusion of dissolved N in the γ phase into the ferrite grains, thereby increasing the amount of dissolved N present in the ferrite grain boundaries.

The cooling rate is preferably 10° C./s or more in order to ensure dissolved N. Particularly, when the finishing temperature of hot-rolling is the $Ar_3$ transformation point or more, the cooling rate is preferably 50° C./s or more in order to ensure dissolved N.

Then, the hot-rolled sheet is coiled. In order to coarsen a carbide, the coiling temperature is advantageously as high as possible. However, with a coiling temperature of over 800° C., the scale formed on the surface of the hot-rolled sheet is thickened to increase the load of the work of removing the scale, and progress the formation of a nitride, causing a change in the amount of dissolved N in the coil length direction. On the other hand, with a coiling temperature of less than 400° C., the coiling work becomes difficult. Therefore, the coiling temperature of the hot-rolled sheet must be in the range of 400 to 800° C.

Then, the hot-rolled sheet is cold-rolled, but the rolling reduction ratio of cold rolling must be 60 to 95%. This is because with a rolling reduction ratio of cold rolling of less than 60%, a high r value cannot be expected, while with a rolling reduction ratio of over 95%, the r value is decreased.

The cold-rolled sheet subjected to cold rolling is then recrystallized and annealed. Although the annealing method may be either continuous annealing or batch annealing, continuous annealing is advantageous. The continuous annealing may be performed either in a normal continuous annealing line or in a continuous hot-dip galvanization line.

The preferable annealing conditions include 650° C. or more for 5 seconds or more. This is because with an annealing temperature of less than 650° C., and an annealing condition of less than 5 seconds, recrystallization is not completed to decrease deep drawability. In order to improve deep drawability, annealing is preferably performed in the ferrite single phase region at 800° C. or more for 5 seconds or more.

Annealing in the high-temperature $\alpha+\gamma$ two-phase region partially produces $\alpha\rightarrow\gamma$ transformation to improve the r value due to the development of the {111} aggregation structure. However, when $\alpha\rightarrow\gamma$ transformation completely proceeds, the aggregation structure is made random to decrease the r value, thereby deteriorating deep drawability.

The upper limit of the annealing temperature is preferably 900° C. This is because with an annealing temperature of over 900° C., redissolution of a carbide proceeds to excessively increase the amount of dissolved C, thereby deteriorating the natural aging property. When $\alpha\rightarrow\gamma$ transformation occurs, the aggregation structure is made random to decrease the r value, deteriorating deep drawability.

Furthermore, in the heating-up step in recrystallization annealing, slow heating is performed in the temperature region from 500° C. to the recrystallization temperature to sufficiently precipitate AlN, and the like, thereby effectively decreasing the crystal grain diameter of the steel sheet.

The temperature region in which controlled heating must be performed is 500° C., at which AlN or the like starts to precipitate, to the recrystallization temperature The heating rate is preferably in the range of 1 to 20° C./s because with a heating rate of over 20° C./s, the sufficient amount of precipitates cannot be obtained, while with a heating rate of less than 1° C./s, precipitates are coarsened to weaken the effect of suppressing grain growth.

After the recrystallization annealing, temper rolling of 10% or less may be performed for correcting the shape and controlling surface roughness.

The cooling rate after soaking in recrystallization annealing is preferably 10 to 50° C./s. This is because with a cooling rate of 10° C./s or less, grains are grown during cooling to coarsen the crystal grains, thereby deteriorating the strain aging property and natural aging property. While with a cooling rate of 50° C./s or more dissolved N does not sufficiently diffuse into the grain boundaries, deteriorating the natural aging property. The cooling rate is preferably 10 to 30° C./s.

After the recrystallization annealing, hot-dip galvanization and alloying by heating are performed to form a galvannealed steel sheet as occasion demands.

The hot-dip galvanization and alloying are not limited, and may be performed according to a conventional known method.

With a steel sheet subjected to surface treatment generally used for steel thin sheets, such as a steel sheet (a dull-finished steel sheet, a bright-finished steel sheet, or a steel sheet having a specified roughness pattern formed on the surface thereof), which is produced by temper-rolling the alloyed hot-dip galvanized steel sheet, for improving processability and the appearance after processing, a steel sheet having an oil film layer of antirust oil or lubricating oil formed on the surface thereof, or the like, the effect of the present invention can be sufficiently exhibited in the composition range of the prevent invention.

Therefore, a cold-rolled steel sheet and a galvannealed steel sheet can be obtained, which have excellent deep drawability and excellent strain age hardenability, that tensile strength increased by press forming and heat treatment.

A description will now be made of the reasons for limiting the components of a steel sheet in the above ranges according to a third embodiment of the present invention.

C: Less Than 0.01 Mass %

From the viewpoint of excellent deep drawability and press moldability, C is advantageously as small as possible. Also, redissolution of NbC proceeds in the annealing step after cold rolling to increase the amount of dissolved C in crystal grains, thereby easily causing deterioration in natural aging resistance. Therefore, the C amount is preferably suppressed to less than 0.01 mass %, more preferably 0.0050 mass % or less, and most preferably 0.0030 mass % or less. In order to ensure strength and prevent coarsening of crystal grains, the C content is preferably 0.0005% or more.

Si: 0.005 to 1.0 Mass %

Si is a useful component for suppressing a decrease in elongation, and improving strength. However, with a Si content of less than 0.005 mass %, the effect of addition of Si is insufficient, while with a Si content of over 1.0 mass %, the deterioration of surface properties induce a decrease in elongation. Therefore, the Si content is limited to the range of 0.005 to 1.0 mass %, and preferably the range of 0.01 to 0.75 mass %

Mn: 0.01 to 1.5 Mass %

Mn not only is useful as a strengthening component for steel, but also has the function to suppress embrittlement with S due to the formation of MnS. However, with a Mn content of less than 0.01 mass %, the effect of addition of Mn is insufficient, while with a Mn content of over 1.5 mass % the deterioration of surface properties induce a decrease in elongation. Therefore, the Mn content is limited to the range of 0.01 to 1.5 mass %, and preferably the range of 0.10 to 0.75 mass %

P: 0.01 Mass % or Less

P is a solid solution strengthening element which effectively contributes to strengthening of steel. However, with a P content of over 0.01 mass %, deep drawability deteriorates due to the formation of phosphide such as $(FeNb)_xP$ or the like. Therefore, P is limited to 0.10 mass % or less.

S: 0.01 Mass % or Less

With a high S content, the amount of inclusions is increased to deteriorate ductility. Therefore, contamination with S is preferably prevented as much as possible, but an S content up to 0.01 mass % is allowable.

Al: 0.005 to 0.030 Mass %

Al is added as a element for deoxidization for improving the yield of the elements forming carbonitride. However, with an Al content of less than 0.005 mass %, the effect is insufficient, while with an Al content of over 0.030 mass %, the amount of N to be added to steel is increased to easily cause slab defects during steel making. Therefore, Al is contained in the range of 0.005 to 0.030 mass %.

N: 0.005 to 0.040 Mass %

In the present invention, N is an important element which plays the role of imparting strain age hardenability to a steel sheet. However, with an N content of less than 0.005 mass %, a sufficient strain age hardenability cannot be obtained, while with an N content of as high as over 0.040 mass % press moldability deteriorates. Therefore, N is contained in the range of 0.005 to 0.040 mass %, and preferably in the range of 0.008 to 0.015 mass %.

B: 0.0001 to 0.003 Mass %

B is added in a combination with Nb to exhibit the function to effectively make fine the micro structure of the hot-rolled steel and the cold-rolled steel, annealed for recrystallization, and to improve cold-work embrittlement resistance. However, with a B content of less than 0.0001 mass %, the sufficient effect of making fine the structures cannot be obtained, while with a B content of over 0.003 mass %, the amount of BN precipitate is increased, and dissolution in the slab heating step is hindered. Therefore, B is contained in the range of 0.0001 to 0.003 mass %, preferably in the range of 0.0001 to 0.0015 mass %, and, more preferably in the range of 0.0007 to 0.0012 mass %.

Nb: 0.005 to 0.050%, Ti: 0.005 to 0.070%, V: 0.005 to 0.10%

Nb, Ti and V are added in a combination with B to contribute to refinement of the the micro structure of the hot-rolled steel and the cold-rolled steel, annealed for recrystallization, and have the function to precipitate dissolved C as NbC, Tic and VC, respectively. Therefore, these elements are added together with B according to demand, but less than 0.005% each of the elements does not sufficiently exhibit the function. On the other hand, over 0.050% of Nb, over 0.070% of Ti and over 0.10% of V cause deterioration in ductility. Therefore, Nb, Ti and V are added in the ranges of 0.005 to 0.050%, 0.005 to 0.070%, and 0.005 to 0.10%, respectively.

Furthermore, as described above, Nb has the function to fix dissolved C as NbC, and forms a nitride NbN. Similarly, Al and B form AlN and NB, respectively. Therefore, in order to ensure the sufficient amount of dissolved N and sufficiently decrease the amount of dissolved C, it is important to satisfy the following relations (1) and (2):

$$N\,\% \geqq 0.0015+14/93\cdot Nb\,\%+14/27\cdot Al\,\%+14/11\cdot B\,\% \quad (1)$$

$$C\,\% \leqq 0.5\cdot(12/93)\cdot Nb\,\% \quad (2)$$

N/Al or N/(Al+Nb+Ti+V+B): 0.30 or More

Al forms AlN to decrease the amount of dissolved N. In order to ensure an appropriate amount of dissolved N, N/Al must be 0.30 or more. When Al is added in a combination with Nb, Ti, V or B, these elements also respectively form NbN, TiN, VN and BN to decrease the amount of dissolved N. Therefore, in order to ensure an appropriate amount of dissolved N, (Al+Nb+Ti+V+B) must be 0.30 or more.

Dissolved N: 0.0010% or More

In order to increase the strain age hardenability of the steel sheet, the content of dissolved N must be 0.0010% or more.

The amount of dissolved N is determined by subtracting the amount of precipitated N from the total N amount of steel. As a result of research of comparison between various analysis methods, the inventors found that an electrolytic extraction method using a constant-potential electrolytic method is effective as the method of analyzing the amount of precipitated N. As a method of dissolving ferrite used for extraction analysis, an acid digestion method, a halogen method, or an electrolysis method can be used. Of these methods, the electrolysis method can stably dissolve only ferrite without decomposing very unstable precipitates such as a carbide, a nitride, etc. As the electrolyte, an acetylacetone system is used for electrolysis at a constant potential. In the present invention, the results of measurement of the amount of precipitated N by constant-potential electrolysis showed best correspondence with the actual strength of parts.

Therefore, in the present invention, the residue after extraction by constant-potential electrolysis is chemically analyzed to determine the amount of N in the residue. The thus-determined value is considered as the amount of precipitated N.

In order to obtain higher BH and ΔTS, the amount of dissolved N is preferably 0.0015% or more, more preferably 0.0020% or more, and most preferably 0.0030% or more.

The cold-rolled steel sheet of the present invention is a cold-rolled deep drawing steel sheet having excellent strain age hardenability and the above-described composition, wherein TS×r value ≧750 MPa.

A steel sheet having a Ts×r value of less than 750 MPa cannot be widely applied to members comprising structural member components. In order to extend the application range, the TS×r value is preferably 850 MPa or more.

Conventional coating and baking conditions include 170° C. for 20 min as standards. When a strain of 5% is applied to the steel sheet of the present invention, which contains a large amount of dissolved N, hardening can be achieved even by slow (low temperature) processing. In other words, the range of aging conditions can be widened. In order to attain a sufficient amount of hardening, generally, retention at a higher temperature for a longer time is advantageous as long as softening does not occurs by over aging.

Specifically, in the steel sheet of the present invention, the lower limit of the heating temperature at which hardening significantly takes place after pre-deformation is about 100° C. On the other hand, with the heating temperature of over 300° C., hardening peaks, thereby causing the tendency to soften and significantly causing thermal strain and temper color. With the retention time of about 30 seconds or more, hardening can be sufficiently achieved at a heating temperature of about 200° C. In order to obtain more stable hardening, the retention time is preferably 60 seconds or more. However, retention for over 20 mines is practically disadvantageous because further hardening cannot be expected, and the production efficiency significantly deteriorates.

Therefore, in the present invention, the conventional coating and baking conditions, i.e., the heating temperature of 170° C. and the retention time of 20 minutes, are set as the aging conditions. With the steel sheet of the present invention, hardening can be stably achieved even under the aging conditions of a low heating temperature and a short retention time, which fail to achieve sufficient hardening in a conventional bake-hardening steel sheet. The heating method is not limited, and atmospheric heating with a furnace, which is generally used for coating and baking, and other methods such as induction heating, heating with a nonoxidation flame, a laser, plasma, or the like, etc. can be preferably used. Alternatively, only a portion in which strength is desired to be increased may be selectively heated.

The strength of an automobile part must be sufficient to resist an external complicated stress load, and thus not only strength in a low strain region but also strength in a high strain region are important for a raw material steel sheet. In consideration of this point, in the steel sheet of the present invention used as a raw material for automobile parts, BH is 80 MPa or more, and ΔTS is 40 MPa or more. More preferably, BH is 100 MPa or more, and ΔTS is 50 MPa or more. In order to further increase BH and ΔTS, the heating temperature in aging may be set to a higher temperature, and/or the retention time may be set to a longer time.

The steel sheet of the present invention has the advantage that even when the steel sheet not molded is allowed to stand at room temperature for about one year, natural aging deterioration does not occur, unlike a conventional steel sheet.

In the present invention, the cold-rolled steel sheet may be coated by hot-dip galvanization or alloying hot-dip galvanization without any problem, and TS, BH and ΔTS are equivalent to those before plating. Besides hot-dip galvanization and alloying hot-dip galvanization, electro-galvanization, electro-tinning, electric chromium plating, electro-nickeling, and the like may be preferably used.

The production conditions according to a fourth embodiment of the present invention will be described.

First, steel having the composition, by mass %, comprising less than 0.01% of C, 0.0050 to 0.04% of N, 0.005 to 0.03% of Al, 0.005 to 1.0% of Si, 0.01 to 1.5% of Mn, 0.1% or less of P, and 0.01% or less of S, or further comprising 0.0001 to 0.003% of B, and at least one of 0.005 to 0.050% of Nb, 0.005 to 0.070% of Ti, and 0.005 to 0.10% of V, wherein N/(Al+Nb+Ti+V+B) is 0.30 or more, is melted by a conventional melting method such as a converter or the like, and then solidified by an ingot making method or a continuous casting method to form a steel raw material.

The steel raw material is heated and soaked, and then hot-rolled to form a hot-rolled sheet. With an excessively low heating temperature (SRT), the effect of improving processability is saturated, and the rolling load in hot rolling is increased to cause a trouble in rolling, and insufficient homogeneity of dissolved N. Therefore, SRT is preferably 950° C. or more. In order to improve deep drawability, it is advantageous to fix dissolved C and precipitate it as a carbide. Therefore, SRT is preferably 1300° C. or less. In order to further improve processability, SRT is preferably 1150° C. or less.

When the total rolling reduction ratio of hot rolling starting from rough rolling to finish rolling is less than 80%, the crystal grains of the hot-rolled sheet are not sufficiently made fine. Therefore, the total rolling reduction ratio is preferably 80% or more.

With the rough rolling temperature of over 1000° C., $\gamma \rightarrow \alpha$ transformed grains are coarsened to decrease the r value, while with the rough rolling temperature of less than $Ar_3$ transformation point, a grains are recrystallized and coarsened or grown to decrease the r value. Therefore, rough rolling is preferably performed in the temperature region of the $Ar_3$ transformation point to 1000° C.

On the other hand, when finish rolling is completed in the temperature region of over the $Ar_3$ transformation point, the aggregation structure is made random by $\gamma \rightarrow \alpha$ transformation to fail to obtain excellent deep drawability. When finish rolling is completed in the temperature region of less than the $Ar_3$ transformation point, a further improvement in deep drawability cannot be expected, but the rolling load is increased. Therefore, finish rolling is preferably performed in the temperature region of 600° C. to the $Ar_3$ transformation point.

If lubrication rolling is not performed in finish rolling, an additional shear force acts on the surface of the steel sheet due to frictional force between a roll and the steel sheet to preferentially form {110} orientation undesirable for deep drawing in the surface of the steel sheet, deteriorating deep drawability. Therefore, finish rolling is preferably performed under lubrication.

Then, the hot-rolled sheet is coiled. The processed material after the coiling step is referred to as a "coil". The higher coiling temperature (CT) of the hot-rolled sheet is advantageous for coarsening of the carbide. However, with the coiling temperature of over 800° C., the scale formed on the surface of the hot-rolled sheet is thickened to increase the load of a scale removing work, and progress the formation of a nitride, thereby causing a variation in amount of dissolved N in the longitudinal direction of the coil. On the other hand, with the coiling temperature of less than 400° C., the coiling work is difficult. Therefore, CT is preferably 400 to 800° C. Then, the thus-obtained hot-rolled sheet is recrystallized and annealed by continuous annealing or batch annealing. The annealing (hot-rolled sheet annealing) is carried out for recrystallizing the rolled aggregation structure formed by hot rolling in the α-phase region in finish rolling to obtain a recrystallized aggregation structure.

Then, the hot-rolled sheet is cold-rolled to form a cold-rolled sheet. When the rolling reduction ratio of cold rolling is less than 60%, a high r value cannot be expected. On the other hand, while a rolling reduction ratio of over 95%, the r value is decreased. Therefore, the rolling reduction ratio is preferably 60 to 95%.

Next, the cold-rolled sheet is recrystallized and annealed. The annealing is preferably carried out in either a continuous annealing line or a continuous hot-dip galvanization line. The preferable annealing conditions include the annealing temperature of 650° C. or more and the retention time of 5 seconds or more. When either of the annealing temperature of 650° C. or more and the retention time of 5 seconds or more is not satisfied, recrystallization is not completed to deteriorate deep drawability. In order to obtain excellent deep drawability, the annealing temperature of 800° C. or more and the retention time of 5 seconds or more are preferred. However, with the annealing temperature of over 900° C., redissolution of the carbide proceeds to excessively increase the amount of dissolved C, thereby deteriorating the natural aging property (decreasing elongation by natural aging). Furthermore, when $\gamma \rightarrow \alpha$ transformation occurs, the aggregation structure becomes random to decrease the r value, deteriorating deep drawability. Therefore, the annealing temperature is preferably 900° C. or less.

The cold-rolled annealed sheet obtained by recrystallizing and annealing the cold-rolled steel sheet is further coated by hot-dip galvanization or alloyed. In this case, in plating, the cooling rate during the time between the completion of recrystallization annealing and the start of plating is 5° C./s or more, and the sheet temperature in hot-dip galvanization is preferably 400 to 600° C. In alloying, the processing temperature is preferably 400 to 600° C., and the processing time is preferably 5 to 40 seconds.

The cold-rolled steel sheet after recrystallization annealing or the hot-dip galvanized steel sheet may be temper-rolled for correcting the shape and controlling surface roughness. The reduction ratio of temper rolling is preferably 10% or less. This is because with a rolling reduction ratio of over 10%, the r value is decreased.

Description will now be made of the reasons for limiting the composition of a high-tensile-strength cold-rolled steel sheet according to a fifth embodiment of the present invention.

C: 0.0015 to 0.025%

In the present invention, in order to control the structure to a homogeneous fine structure, and ensure a sufficient amount of an acicular ferrite phase, the C content must be 0.0015% or more. With a C content of over 0.025%, the ratio of the carbide in the steel sheet is excessively increased to significantly deteriorate ductility, the r value and moldability. Therefore, the C content is limited in the range of 0.0015 to 0.025%. From the viewpoint of improvement in moldability, the C content is preferably 0.020% or less, more preferably 0.010% or less. Particularly, from the viewpoint of stabilization of the BH amount and material properties, the C content preferably exceeds (12/93) Nb (%) (wherein Nb represents the Nb content (%)).

Si: 1.0% or Less

Si is a useful component capable of increasing the strength of the steel sheet without significantly deteriorating ductility of steel. Particularly, when high strength is required, the Si content is preferably 0.10% or more. On the other hand, Si is an element which greatly changes the transformation point during hot rolling to cause difficulties in ensuring quality and the shape, or adversely affects surface properties, chemical conversion properties, and the like, particularly the beauty of the surface of the steel sheet, and adversely affects plating properties. In the present invention, therefore, the Si content is limited to 1.0% or less. However, the above-described adverse effects can be kept down as long as Si is 1.0% or less. Particularly, in applications required for the steel sheet to have surface beauty, Si is preferably 0.5% or less.

Mn: 2.0% or Less

Mn is an element effective to prevent hot cracking with S, and Mn is preferably added according to the amount of S contained. Mn also has the great effect of making fine crystal grains, and is preferably added for improving material properties. In order to stably fix S, the Mn content is preferably 0.1% or more. Mn is also an element for increasing the strength of the steel sheet, and is preferably added in an amount of 0.5% or more when higher strength is required. The Mn content is more preferably 0.8% or more.

With the Mn content increased to this level, there is the advantage that variations in the mechanical properties of the steel sheet with respect to variations in the hot-rolling conditions, particularly strain age hardenability, are significantly improved. However, with the excessively high Mn content of over 2.0%, the deformation resistance at elevated temperatures tends to increase to deteriorate weldability and weld moldability. The detailed mechanism of this is not known. Furthermore, the formation of ferrite is significantly suppressed, and the r value is significantly decreased. Therefore, the Mn content is limited to 2.0% or less. In applications required to have good corrosion resistance and moldability, the Mn content is preferably 1.5% or less.

P: 0.1% or Less

P is a useful element as a solid solution strengthening element for steel, and is preferably added in an amount of 0.002% or more from the viewpoint of an increase in strength. Particularly, when high strength is required, the P content is preferably 0.02% or more. On the other hand, when P is excessively added, steel is embrittled, and stretch-flanging properties of the steel sheet deteriorate. Also, P is liable to strongly segregate in steel, thereby causing embrittlement of a weld. Therefore, P is limited to 0.1% or less. In applications in which elongated flange processability and weld toughness are considered as important, P is preferably 0.08% or less, more preferably 0.06% or less.

S: 0.02% or Less

S is present as an inclusion in the steel sheet, decreases ductility of the steel sheet, and causes deterioration in corrosion resistance. Therefore, the Si content is as low as possible, and in the present invention, the Si content is limited to 0.02% or less. Particularly, in applications required to have good processability, S is preferably 0.015% or less. Particularly, in applications required to have excellent stretch-flanging properties, S is preferably 0.010% or less. Although the detailed mechanism is not known, in order to stably maintain the strain age hardenability of the steel sheet in a high level, it is effective to decrease the S content to 0.008% or less.

Al: 0.02% or Less

Al is an element functioning as a element for deoxidation for improving cleanliness of steel, and making fine the structure of the steel sheet. In the present invention, the Al content is preferably 0.001% or more. In the present invention, dissolved N is used as a strengthening element, but aluminum killed steel containing Al in a suitable range has mechanical properties superior to those of conventional rimmed steel not containing Al. On the other hand, with an excessively high Al content, the surface properties of the steel sheet deteriorate, and the amount of dissolved N is significantly decreased to cause difficulties in obtaining a large amount of strain age hardening, which is the main object of the present invention. Therefore, in the present invention, Al is limited to 0.02% or less. From the viewpoint of stability of material quality, Al is more preferably 0.001 to 0.015%. Although a decrease in the Al content possibly causes coarsening of crystal grains, in the present invention, the amounts of other alloy elements are appropriately determined, and the annealing conditions are set in appropriately ranges, thereby effectively preventing coarsening.

N: 0.0050 to 0.0250 Mass %

N is an element for increasing the strength of the steel sheet by solid solution strengthening and strain age hardening, and in the present invention, N is the most important element. In the present invention, an appropriate amount of N is contained, the Al content is controlled to the appropriate value, and production conditions such as the hot-rolling conditions, and the annealing conditions are controlled to ensure necessary and sufficient dissolved N it a cold-rolled product or a coated product. This exhibits the sufficient effect of increasing strength (yield stress and tensile strength) by solid solution strengthening and strain age hardening, to stably obtain the target values of the mechanical properties of the steel sheet of the present invention, such as a tensile strength of 340 MPa or more, an amount (BH amount) of bake-hardening of 80 MPa or more, and an increase is tensile strength ΔTS of 40 MPa or more after strain aging. Since N also has the function to decrease the transformation point, N is effective for rolling of a thin material for which rolling at a temperature greatly over the transformation point is undesirable.

With a N content of less than 0.0050%, the effect of increasing strength is less stably exhibited, while with a N content of over 0.0250%, the rate of occurrence of internal defects in the steel sheet is increased, and slab cracking frequently occurs during continuous casting. Therefore, N is limited to the range of 0.0050 to 0.0250%. From the viewpoint of improvement in stability of material properties and yield over the entire production process, N is preferably in the range of 0.0070 to 0.0200%, and more preferably in the range of 0.0100 to 0.0170%. With the N amount in the range of the present invention, there is no adverse effect on weldability, and the like.

Dissolved N: 0.0010% or More

In order to ensure sufficient strength of a cold-rolled product, and effectively exhibit strain age hardening with N, it is necessary that the content of dissolved N (solid solution N) in the steel sheet is at least 0.0010% or more.

The amount of dissolved N is determined by subtracting the amount of precipitated N from the total N amount of steel. As a result of comparison research of various methods, the inventors found that electrolytic extraction analysis using constant-potential electrolysis is effective as the method of analyzing the amount of precipitated N. As the method of dissolving ferrite used for extraction analysis, an acid digestion method, a halogen method, or an electrolysis method can be used. Of these methods, the electrolysis method can stably dissolve only ferrite without decomposing very unstable precipitates such as a carbide, a nitride, etc. As the electrolyte, an acetyl-acetone system is used for electrolyzing at a constant potential. In the present invention, the results of measurement of the amount of precipitated N by constant-potential electrolysis showed best correspondence with changes in actual material properties.

Therefore, in the present invention, the residue after extraction by constant-potential electrolysis is chemically analyzed to determine the amount of N in the residue. The thus-determined value is considered as the amount of precipitated N.

In order to obtain higher BH and ΔTS, the amount of dissolved N is preferably 0.0020% or more. In order to obtain further high values, the amount of dissolved N is preferably 0.0030% or more. Although the upper limit of the amount of dissolved N is not limited, the mechanical properties less deteriorate even when the all amount of N remains.

N/Al (the Content Ratio of N to Al): 0.3 or More

In order to cause 0.0010% or more of dissolved N to stably remain in a product state, the amount of Al which is an element for strongly binding to N, must be limited. As a result of research of steel sheets in which the combination of the N content (0.0050 to 0.0250%) and the Al content (0.02% or less) were widely changed in the composition range of the present invention, it was found that With N/Al of 0.3 or more, the amount of dissolved N of a cold-rolled product or coated product can be stably set to 0.0010% or more. Therefore, N/Al is limited to 0.3 or more. In order to stably increase the strain age hardenability, N/Al is preferably 0.6 or more, and more preferably 0.8 or more.

Nb: 0.002 to 0.050%

Nb effectively functions to form an acicular ferrite phase in combination with B. In the present invention, the Nb content must be 0.002% or more. On the other hand, a Nb content of over 0.050%, the effect is saturated, and deformation resistance at elevated temperatures is significantly increased to cause difficulties in hot rolling. Therefore, Nb is limited in the range of 0.002 to 0.050%, and preferably 0.005 to 0.040%.

B: 0.0001 to 0.0050%

B effectively functions to form an acicular ferrite phase in combination with Nb. In the present invention, the B content must be 0.001% or more. On the other hand, a B content of over 0.0050%, the amount of dissolved N contributing strain age hardenability is decreased. Therefore, B is limited in the range of 0.0001 to 0.0050%, and preferably 0.0003 to 0.0030%.

In the present invention, the above composition preferably further contains at least one of the following groups a to c:

Group a: at least one of Cu, Ni, Cr and Mo in a total of 1.0% or less;

Group b: one or both of Ti and V in a total of 0.1% or less; and

Group c: one or both of Ca and REM in a total of 0.0010 to 0.010%.

Element of Group a: Cu, Ni, Cr and Mo are all contribute to an increase in strength of the steel sheet, and can be contained singly or in a combination according to demand. The effect is recognized by containing 0.01% or more each of Cu, Ni, Cr and Mo. However, with an excessively high content, deformation resistance at elevated temperatures in hot rolling is increased, or chemical conversion properties and surface treatment properties in a wide sense deteriorate, and a welded portion is hardened to deteriorate weld moldability.

Therefore, Cu, Ni, Cr, and Mo are preferably contained singly at 1.0% or less, 1.0% or less, 0.5% or less, and 0.2% or less, respectively, and preferably contained in a combination at a total of 1.0% or less.

Element of Group b: Both Ti and V are elements contributing refinement and homogenization of crystal grains, and may be added singly or in a combination according to demand. The effect can be recognized by containing 0.005% or more each of Ti and V. However, with an excessively high content, deformation resistance at elevated temperatures in hot rolling is increased, or chemical conversion properties and surface treatment properties in a wide sense deteriorate. Furthermore, there is the adverse effect of decreasing the amount of dissolved N. Therefore, Ti and V are preferably contained singly at 1.0% or less and 1.0% or less, respectively, and preferably contained in a combination at a total of 0.1% or less.

Elements of Group c: Both Ca and REM are elements useful for controlling the form of inclusions. Particularly, when the stretch flanging property is required, these elements are preferably added singly or in a combination. When the total of the elements of group d is less than 0.0010%, the effect of controlling the form of inclusions is insufficient, while when the total exceeds 0.010%, surface defects significantly occur. Therefore, the total of the elements of group d is preferably limited to the range of 0.0010 to 0.010%. This permits improvement in the stretch flanging property without causing surface defects.

The structure of the steel sheet of the present invention is described below.

The steel sheet of the present invention has the structure composed of an acicular ferrite phase at an area ratio of 5% or more and a ferrite phase having an average crystal grain diameter of 20 μm or less.

The Area Ratio of the Acicular Ferrite Phase: 5% or More

The cold-rolled steel sheet of the present invention contains the acicular ferrite phase at an area ratio of 5% or more. The presence of the acicular ferrite phase at 5% or more permits the achievement of good ductility and a larger amount of strain age hardening. Although the detailed mechanism is not known, it is thought that strain is effectively accumulated in the steel sheet during pre-strain processing before aging by the presence of the acicular ferrite phase. Furthermore, the presence of the acicular ferrite phase improves natural aging deterioration at room temperature to be effective to obtain natural non-aging properties. In order to obtain a good balance of strength and ductility, and higher strength, the area ratio of the acicular ferrite phase is preferably 10% or more. The presence of a large amount of acicular ferrite phase of over 20% has the problem of deteriorating the r value. Therefore, the area ratio of the acicular ferrite phase is 5% or more, and preferably 10% to 20%.

In the present invention, "the acicular ferrite phase" is a low-temperature transformation phase peculiar to ultra low carbon steel having the composition of the present invention, in which no carbide is contained therein. This phase can be clearly discriminated from normal polygonal ferrite by observation on an optical microscope, and is harder than the polygonal ferrite phase because of the high internal dislocation density.

According to observation on an optical microscope, the acicular ferrite phase has a distribution of any one of (1) crystal grains having irregularly angular boundaries, (2) crystal grains present along crystal grains of precipitates or the like, and (3) crystal grains or crystal grain groups (many sub-boundaries are observed in relatively second phase grains) having a scratch-like pattern, singly or in a combination. This acicular ferrite can be clearly distinguished from general polygonal ferrite. The color tone of the corroded insides of the grains is different from martensite and bainite, and substantially the same as ordinary polygonal ferrite, and thus acicular ferrite can be clearly distinguished from martensite and bainite. According to observation on a transmission electron microscope, the acicular ferrite phase has a very high density of dislocation in the vicinities of the crystal grains, and/or in the grains, and particularly the above form (3) comprises a layer having a very high dislocation density and a layer having a relatively low dislocation density.

The cold-rolled steel sheet of the present invention is directed to use as an automobile steel sheet required to have high moldability, and comprises a ferrite phase other than the acicular ferrite phase in order to ensure ductility. When the area ratio of the ferrite phase is less than 80%, it is difficult to ensure ductility and a high r value which are necessary for the automobile steel sheet required to have processability. When further improved ductility is required, the area ratio of the ferrite phase is 80% or more, and preferably 85% or more. In the present invention, ferrite means so-called polygonal ferrite in which no strain remains.

Average Crystal Grain Diameter of Ferrite Phase: 20 μm or Less

In the present invention, the value used as the average crystal grain diameter is a higher one of the value calculated from a photograph of a sectional structure by a quadrature method defined by ASTM, and the nominal value determined by an intercept method defined by ASTM (refer to, for example, Umemoto et al.: Heat Treatment, 24 (1984), p334).

The cold-rolled steel sheet of the present invention maintains a predetermined amount of dissolved N in the product step. However, as a result of experiment and research conducted by the inventors, it was found that variations in strain age hardenability occur in steel sheets containing the same amount of dissolved N, and one of the main causes of the variations is a crystal grain diameter. In the structure of the present invention, in order to stably obtain a high BH amount and ΔTS, the average crystal grain diameter is at least 20 μm or less, and preferably 15 μm or less. Although the detailed mechanism is not known, this is supposed to be related to the segregation and precipitation of alloy elements in the crystal grain boundaries, and the influences of processing and heat history on the segregation and precipitation.

Therefore, in order to achieve stability of strain-age hardenability, the average crystal grain diameter of the ferrite phase is 20 μm or less, and preferably 15 μm or less.

The cold-rolled steel sheet of the present invention, which has the above-described composition and structure, has a tensile strength (TS) of about 340 MPa to 590 MPa, a r value of as high as 1.2 or more, an excellent strain age hardenability. The steel sheet having TS of less than 340 MPa cannot be widely applied to members each comprising a structural component. In order to extend the application range, TS is preferably 400 MPa or more. With a r value of less than 1.2, the steel sheet cannot be applied to a wide range of press-molded products. The preferred range of the r value is 1.3 or more.

The conventional coating and baking conditions include 170° C. and 20 min as standards. When a strain of 5% or more is applied to the steel sheet of the present invention containing a large amount of dissolved N, hardening can be achieved even by aging at low temperature. In other words, the aging conditions can be selected from a wide range. Generally in order to earn the amount of hardening, it is advantageous to hold the steel sheet at a higher temperature for a longer time as long as softening does not occur due to over aging.

Specifically, in the steel sheet of the present invention, the lower limit of the heating temperature at which hardening significantly takes place after pre-deformation is about 100° C. On the other hand, with the heating temperature of over 300° C., hardening peaks, thereby causing the tendency to soften and significantly causing thermal strain and temper color. With the retention time of about 30 seconds or more, hardening can be sufficiently achieved at a heating temperature of about 200° C. In order to obtain more stable hardening, the retention time is preferably 60 seconds or more. However, retention for over 20 minutes is practically disadvantageous because further hardening cannot be expected, and the production efficiency significantly deteriorates.

Therefore, in the present invention, the conventional coating and baking conditions, i.e., the heating temperature of 170° C. and the retention time of 20 minutes, are set as the aging conditions. With the steel sheet of the present invention, hardening can be stably achieved even under the aging conditions of a low heating temperature and a short retention time, which fail to achieve sufficient hardening in a conventional bake-hardening steel sheet. The heating method is not limited, and atmospheric heating with a furnace, which is generally used for coating and baking, and other methods such as induction heating, heating with a nonoxidation flame, a laser, plasma, or the like, etc. can be preferably used.

The strength of an automobile part must be sufficient to resist an external complicated stress load, and thus not only strength in a low strain region but also strength in a high strain region are important for a raw material steel sheet. In consideration of this point, in the steel sheet of the present invention used as a raw material for automobile parts, BH is 80 MPa or more (corresponding to strength in a relatively low strain region), and ΔTS is 40 MPa or more (corresponding to strength in a relatively high strain region). More preferably, BH is 100 MPa or more, and ΔTS is 50 MPa or more. In order to further increase BH and ΔTS, the heating temperature in aging may be set to a higher temperature, and/or the retention time may be set to a longer time.

The effect of the present invention is exhibited by a product having a relatively large thickness. However, with a product having a thickness of over 3.2 mm, a sufficient cooling rate necessary for the cold-rolled sheet annealing step cannot be ensured to cause strain aging at the time of continuous annealing, thereby failing to obtain the target strain age hardenability as a product. Therefore, the steel sheet of the present invention preferably has a thickness of 3.2 mm or less.

In the present invention, the surface of the cold-rolled steel sheet may be coated by hot-dip galvanization or alloying hot-dip galvanization without any problem. These coated steel sheets also exhibit TS, BH and ΔTS which are equivalent to those before plating. As the plating type, any one of electro-galvanization, hot-dip galvanization, alloying hot-dip galvanization, electro-tinning, electric chromium plating, electro-nickeling, and the like may be preferably used.

The method of producing a steel sheet according to a sixth embodiment of the present invention is described.

The steel sheet of the present invention is basically produced by performing the hot rolling step in which a steel slab having the above-described composition is heated, and then roughly rolled to form a sheet bar, and the sheet bar is finish-rolled and cooled to form a coiled hot-rolled sheet, the cold rolling step in which the hot-rolled sheet is pickled and cold-rolled to form a cold-rolled sheet, and the cold-rolled sheet annealing step in which the cold-rolled sheet is continuously annealed.

Although the slab used in the production method of the present invention is preferably produced by a continuous casting method in order to prevent macro-segregation of components, an ingot making method or a thin slab casing method may be used. Alternatively, a conventional method comprising cooling the produced slab to room temperature and then again heating the slab, or an energy-saving process of direct rolling, in which a hot slab is charged into a heating furnace without cooling and then rolled, or the slab is rolled directly immediately after being slightly kept warm, may be used without a problem. Particularly, direct rolling is a useful technique for effectively ensuring dissolved N.

Description will be now be made of the reasons for limiting the conditions of the hot rolling step.

Slab Heating Temperature: 1000° C. or More

The slab heating temperature is preferably 1000° C. or more in order to ensure a necessary and sufficient amount of dissolved N in an initial state and satisfy the target amount of dissolved N in a product. Since a loss is increased by an increase in the oxide weight, the heating temperature is preferably 1280° C. or less.

The slab heated under the above condition is roughly rolled to form a sheet bar. The condition of the rough rolling is not defined, and rough rolling may be performed according to a normal method. However, in order to ensure the amount of dissolved N, rough rolling is preferably performed within a as short time as possible. Then, the sheet bar is finish-rolled to form a hot-rolled sheet.

In the present invention, the adjacent sheet bars are preferably bonded together during the time between rough rolling and finish rolling, and then continuously rolled. As the bonding means, a pressure welding method, a laser welding method, an electron beam welding method, or the like is preferably used.

By continuous rolling, so-called non-stationary portions at the front end and the rear end of a coil (processed material) are removed to permit hot rolling over the entire length and the entire width of the coil (processed material) under stable conditions. This is very effective to improve the sectional shape and dimensions of not only the hot-rolled steel sheet but also the cold-rolled steel sheet. When the steel sheet is cooled on a hot run table after rolling, the shape of the steel sheet can be sufficiently maintained because tension can be always applied.

By continuous rolling, the ends of the coil can be stably passed, and it is thus possible to use lubricating rolling, which cannot be easily applied to ordinary single rolling for each sheet bar because of the problem of continuous rolling processes and biting property. Therefore, the rolling load can be decreased, and at the same time, the surface pressure of the roll can be decreased, thereby increasing the life time of the roll.

In the present invention, at the entrance of a finisher between rough rolling and finish rolling, the temperature distributions of the sheet bar in the width direction and the long direction thereof are preferably made uniform by using any one or both of a sheet bar edge heater for heating the ends of the sheet bar in the width direction and a sheet bar heater for heating the ends of the sheet bar in the long direction. This can further decrease the variations in material properties of the steel sheet. The sheet bar edge heater and the sheet bar heater are preferably of an induction heating type.

As the procedure of use of the heaters, preferably, the difference in temperature in the width direction is first corrected by the sheet bar edge heater. Although the heating amount depends upon the steel composition, the temperature distribution in the width direction at the finisher entrance is preferably set in the range of about 20° C. or less. Next, the difference in temperature in the long direction is corrected by the sheet bar heater. At this time, the heating amount is preferably set so that the temperatures at the ends in the long direction are about 20° C. higher than the temperature at the center.

Finisher Delivery Temperature: 800° C. or More

In order to obtain a homogeneous fine hot-rolled base sheet structure, the finisher deliver temperature FDT is 800° C. or more. With a FDT of lower than 800° C., the structure of the steel sheet becomes inhomogeneous, and the processed structure partially remains to leave heterogeneity of the structure after the cold-rolled sheet annealing step. Therefore, the danger of producing various troubles in press forming is increased. When a high coiling temperature is used for avoiding the processed micro structure from remaining, coarse crystal grains are produced to cause the same troubles as described above. With the high coiling temperature, the amount of dissolved N is significantly decreased to cause difficulties in obtaining a target tensile strength of 340 MPa or more. Therefore, the finisher deliver temperature FDT is 800° C. or more. In order to further improve the mechanical properties, the FDT is preferably 820° C. or more. In order to improve the r value, the FDT is preferably the $AC_3$ transformation point or more.

Although the upper limit of FDT is not limited, a scale scar significantly occurs at excessively high FDT. The FDT is preferably up to about Coiling Temperature: 800° C. or Less The strength of the steel sheet is liable to increase as the coiling temperature CT decreases. In order to ensure the target tensile strength TS of 340 MPa or more, the CT is preferably 800° C. or less. With a CT of less than 200° C., the shape of the steel sheet is readily disturbed to increase the danger of causing troubles in a practical operation, thereby deteriorating homogeneity of material properties. Therefore, the CT is preferably 200° C. or more. When the homogeneity of the material properties is required, the CT is preferably 300° C. or more, and more preferably 350° C. or more.

In the present invention, in finish rolling, lubricating rolling may be performed for decreasing the hot rolling load. The lubricating rolling has the effect of further making homogeneous the shape and material properties of the hot-rolled sheet. During the lubricating rolling, the frictional coefficient is preferably in the range of 0.25 to 0.10. By combining lubricating rolling and continuous rolling, the operation of hot rolling is further stabilized.

The hot-rolled sheet subjected to the above-described hot rolling step is then pickled and cold-rolled in the cold rolling step to form a cold-rolled sheet.

The pickling conditions may be the same as conventional known conditions, and are not limited. When the scale of the hot-rolled sheet is extremely small, cold rolling may be immediately after hot rolling without pickling.

The cold rolling conditions may be the same as conventional known conditions, and are not limited. In order to ensure homogeneity of the structure, the reduction ratio of cold rolling is preferably 60% or more. The reasons for limiting the conditions of the cold-rolled sheet annealing step are described below.

The cold-rolled sheet is then subjected to the cold-rolled sheet annealing step comprising continuous annealing and cooling.

Continuous Annealing Temperature: Temperature in the Ferrite-Austenite Two-Phase Coexistence Region By annealing at a temperature in the ferrite-austenite two-phase coexistence region, the acicular ferrite phase is formed. In addition, the (111) aggregation structure is strongly developed in the ferrite phase to obtain a high r value. On the other hand, with a high temperature where an austenite single phase is formed beyond the ferrite-austenite two-phase coexistence region, the aggregation structure of the steel sheet is made random by reverse transformation and transformation to decrease the r value. Therefore, in the present invention, the annealing temperature of continuous annealing is limited to the recrystallization temperature or more in the ferrite-austenite two-phase coexistence region. From the viewpoint of stability of the r value, the temperature is preferably set so that the fraction of austenite is 10% to 50%. With the continuous annealing temperature of less than the recrystallization temperature, ductility deteriorates, and the steel sheet can be applied as an automobile part only to limited special applications. Therefore, the annealing temperature is preferably the recrystallization temperature or more.

The retention time of continuous annealing is preferably as short as possible in order to ensure the production efficiency, the fine structure and the amount of dissolved N. From the viewpoint of stability of the operation, the retention time is preferably 10 seconds or more. Also, in order to ensure the fine structure and the amount of dissolved N, the retention time is preferably 90 seconds or less. From the viewpoint of stability of material properties, the retention time is preferably 20 seconds or more.

Cooling After Continuous Annealing: Cooling to the Temperature Region of 500° C. or Less at a Cooling Rate of 10 to 300° C./s Cooling after soaking by continuous annealing is important for making fine the structure, forming the acicular ferrite phase, and ensuring the amount of dissolved N. In the present invention, cooling is continuously carried out to the temperature region of at least 500° C. or less at a cooling rate of 10° C./s or more. With a cooling rate of less than 10° C./s, a necessary amount of acicular ferrite phase, a homogeneous fine structure and a sufficient amount of dissolved N cannot be obtained. On the other hand, with a cooling rate of over 300° C./s, homogeneity in material properties of the steel sheet in the width direction is insufficient. When the stop temperature of cooling at a cooling rate of 10 to 300° C./s after continuous annealing exceeds 500° C., refinement of the structure cannot be attained.

Temper Rolling or Lever Processing: Elongation of 0.5 to 10%

In the present invention, in order to correct the shape and control roughness, temper rolling or leveler processing may be carried out subsequent to the cold rolling step. When the total elongation of temper rolling or leveler processing is less than 0.5%, the desired purpose of correcting the shape and controlling roughness cannot be achieved. On the other hand, with a total elongation of over 10%, ductility deteriorates. In order to ensure ductility, the elongation is preferably 5% or less. It is confirmed that the processing system of temper rolling is different from that of leveler processing, but the effects of both processes are substantially the same. Temper rolling and leveler processing are effective even after plating.

Description will be now be made of the reasons for limiting the composition of a high-tensile-strength steel sheet according to a seventh embodiment of the present invention.

C: 0.025 to 0.15%

C is an element for increasing the strength of a steel sheet, and 0.025% or more of C must be contained for controlling the structure to a homogeneous fine structure, which is an important requirement of the present invention, and ensuring a sufficient amount of a martensite phase. With a C content of over 0.15%, the ratio of the carbide in the steel sheet is excessively increased to significantly deteriorate ductility and moldability. With a C content of over 0.15%, there is the more important problem of significantly deteriorating spot weldability and arc weldability. Therefore, the C content is limited in the range of 0.025 to 0.15%. From the viewpoint of improvement in moldability, the C content is preferably 0.08% or less. Particularly, when good ductility is required, the C content is preferably 0.05% or less.

Si: 1.0% or Less

Si is a useful component capable of increasing the strength of the steel sheet without significantly deteriorating ductility of steel. The Si content is preferably 0.005% or more, and more preferably 0.10% or more. On the other hand, Si is an element which greatly changes the transformation point during hot rolling to cause difficulties in ensuring quality and the shape, or adversely affects surface properties, chemical conversion properties, and the like, particularly the beauty of the surface of the steel sheet, and adversely affects plating properties. In the present invention, therefore, the Si content is limited to 1.0% or less. However, the above-described adverse effects can be kept down as long as Si is 1.0% or less. Particularly, in applications required for the steel sheet to have a low level of strength and, particularly, surface beauty, Si is preferably 0.5% or less.

Mn: 2.0% or Less

Mn is an element effective to prevent hot cracking with S, and Mn is preferably added according to the amount of S contained. Mn also has the great effect of making fine crystal grains, and is preferably added for improving material properties. Furthermore, Mn is an element effective to stably form martensite during rapid cooling after continuous annealing. In order to stably fix S, the Mn content is preferably 0.2% or more. Mn is also an element for increasing the strength of the steel sheet, and is preferably added in an amount of 1.2% or more when a strength TS of over 500 MPa is required. The Mn content is more preferably 1.5% or more.

With the Mn content increased to this level, there is the advantage that variations in the mechanical properties of the steel sheet with respect to variations in the hot-rolling conditions, particularly strain age hardenability, are significantly improved. However, with the excessively high Mn content of over 2.0%, a high r value, which is an important requirement of the present invention, cannot be easily obtained, and ductility significantly deteriorates. Therefore, the Mn content is limited to 2.0% or less. In applications required to have good corrosion resistance and moldability, the Mn content is preferably 1.7% or less.

P: 0.08% or Less

P is a useful element as a solid solution strengthening element for steel, and is preferably added in an amount of 0.001% or more, and more preferably 0.015% or more, from the viewpoint of an increase in strength. On the other hand, when P is excessively added, steel is embrittled, and stretch-flanging properties of the steel sheet deteriorate. Also, P is liable to strongly segregate in steel, thereby causing embrittlement of a weld. Therefore, P is limited to 0.08% or less. In applications in which elongated flange processability and weld toughness are considered as important, P is preferably 0.04% or less.

S: 0.02% or Less

S is present as an inclusion in the steel sheet, decreases ductility of the steel sheet, and causes deterioration in corrosion resistance. Therefore, the Si content is as low as possible, and in the present invention, the S content is limited to 0.02% or less. Particularly, in applications required to have good processability, S is preferably 0.015% or less. Particularly, in applications required to have excellent stretch-flanging properties, S is preferably 0.008% or less. Although the detailed mechanism is not known, in order to stably maintain the strain age hardenability of the steel sheet in a high level, it is effective to decrease the S content to 0.008% or less.

Al: 0.02% or Less

Al is an element functioning as a deoxidization for improving cleanliness of steel, and making fine the structure of the steel sheet. In the present invention, the Al content is preferably 0.001% or more. In the present invention, dissolved N is used as a strengthening element, but aluminum killed steel containing Al in a suitable range has mechanical properties superior to those of conventional rimmed steel not containing Al. On the other hand, with an excessively high Al content, the surface properties of the steel sheet deteriorate, and the amount of dissolved N is significantly decreased to cause difficulties in obtaining a large amount of strain age hardening, which is the main object of the present invention. Therefore, in the present invention, Al is limited to 0.02% or less. From the viewpoint of stability of material properties, Al is more preferably 0.001 to 0.015%. Although a decrease in the Al content possibly causes coarsening of crystal grains, in the present invention, the amounts of other alloy elements are appropriately determined to appropriately set the annealing conditions, thereby effective preventing coarsening.

N: 0.0050 to 0.0250%

N is an element for increasing the strength of the steel sheet by solid solution strengthening and strain age hardening, and in the present invention, N is the most important element. In the present invention, an appropriate amount of N is contained, the Al content is controlled to the appropriate value, and production conditions such as the hot-rolling conditions, and the annealing conditions are controlled to ensure necessary and sufficient dissolved N in a cold-rolled productor a coated product. This exhibits the sufficient effect of increasing strength (yield stress and tensile strength) by solid solution strengthening and strain age hardening, to stably obtain the target values of the mechanical properties of the steel sheet of the present invention, such as a tensile strength of 440 MPa or more, an amount (BH amount) of bake-hardening of 80 MPa or more, and an increase is tensile strength ΔTS of 40 MPa or more after strain aging. Since N also has the function to decrease the transformation point, N is effective for rolling of a thin material for which rolling at a temperature greatly over the transformation point is undesirable.

With a N content of less than 0.0050%, the effect of increasing strength is less stably exhibited, while with a N content of over 0.0250%, the rate of occurrence of internal defects in the steel sheet is increased, and slab cracking frequently occurs during continuous casting. Therefore, N is limited to the range of 0.0050 to 0.0250%. From the viewpoint of improvement in stability of material properties and yield over the entire production process, N is preferably in the range of 0.0070 to 0.0170%. With the N amount in the range of the present invention, there is no adverse effect on weldability, and the like.

Dissolved N: 0.0010% or More

In order to ensure sufficient strength of a cold-rolled product, and effectively exhibit strain age hardening with N, it is necessary that the content of dissolved N (solid solution N) in the steel sheet is at least 0.0010% or more.

The amount of dissolved N is determined by subtracting the amount of precipitated N from the total N amount of steel. As a result of comparison research of various methods, the inventors found that electrolytic extraction analysis using constant-potential electrolysis is effective as the method of analyzing the amount of precipitated N. As the method of dissolving ferrite used for extraction analysis, an acid digestion method, a halogen method, or an electrolysis method can be used. Of these methods, the electrolysis method can stably dissolve only ferrite without decomposing very unstable precipitates such as a carbide, a nitride, etc. As the electrolyte, an acetyl-acetone system is used for electrolysis at a constant potential. In the present invention, the results of measurement of the amount of precipitated N by constant-potential electrolysis showed best correspondence with changes in actual material properties.

Therefore, in the present invention, the residue after extraction by constant-potential electrolysis is chemically analyzed to determine the amount of N in the residue. The thus-determined value is considered as the amount of precipitated N.

In order to obtain higher BH and ΔTS, the amount of dissolved N is preferably 0.0020% or more, more preferably 0.0020% or more. In order to obtain further high values, the amount of dissolved N is preferably 0.0030% or more. Although the upper limit of the amount of dissolved N is not limited, the mechanical properties less deteriorate even when the all amount of N added remains.

N/Al (The Content Ratio of N to Al): 0.3 or More

In order to cause 0.0010% or more of dissolved N to stably remain in a product state, the amount of Al which is an element for strongly fixing N, must be limited. As a result of research of steel sheets in which the combination of the N content (0.0050 to 0.0250%) and the Al content (0.02% or less) were widely changed in the composition range of the present invention, it was found that with N/Al of 0.3 or more, the amount of dissolved N of a cold-rolled product or coated product can be stably set to 0.0010% or more. Therefore, N/Al is limited to 0.3 or more.

In the present invention, the above component preferably further contains at least one of the following groups d to g:

Group d: at least one of Cu, Ni, Cr and Mo in a total of 1.0% or less;

Group e: at least one of Nb, Ti and V in a total of 0.1% or less;

Group f: 0.00305 of B; and

Group g: one or both of Ca and REM in a total of 0.0010 to 0.010%.

Elements of Group d: Cu, Ni, Cr and Mo are all contribute to an increase in strength of the steel sheet, and can be contained singly or in a combination according to demand. The effect is recognized by containing 0.005% or more each of Cu, Ni, Cr and Mo. However, with an excessively high content, deformation resistance in hot rolling at elevated temperatures is increased, or chemical conversion properties and surface treatment properties in a wide-sense deteriorate, and a welded portion is hardened to deteriorate weld moldability. Also, the r value is liable to decrease. Therefore, the elements of group a are preferably contained in a total of 1.0% or less. With a Mo content of 0.05% or more, the r value is significantly decreased in some cases. In the present invention, therefore, the Mo content is preferably limited to less than 0.05%.

Elements of Group e: All of Nb, Ti and V are elements contributing-refinement and homegenization of crystal grains, and may be added singly or in a combination according to demand. The effect can be recognized by containing 0.005% or more each of Nb, Ti and V. However, with an excessively high content, deformation resistance in hot rolling at elevated temperatures is increased, or chemical conversion properties and surface treatment properties in a wide sense deteriorate. Therefore, the elements in group b are preferably contained at a total of 0.1% or less.

Elements of Group f: B is an element having the effect of improving hardenability of steel, and can be contained for increasing the fraction of a low-temperature transformation phase other than the ferrite phase to increase strength of steel according to demand. This effect is recognized with a B content of 0.0005% or more. However, with an excessively high B content, deformability at elevated temperatures in hot rolling deteriorates to produce BN, decreasing the amount of dissolved N. Therefore, the B content is preferably 0.0030% or less.

Elements in Group g: Both Ca and REM are elements useful for controlling the form of inclusions. Particularly, when the stretch flanging property is required, these elements are preferably added singly or in a combination. When the total of the elements of group d is less than 0.0010%, the effect of controlling the form of inclusions is insufficient, while when the total exceeds 0.010%, surface defects significantly occur. Therefore, the total of the elements of group d is preferably limited to the range of 0.0010 to 0.010%. This permits improvement in the stretch flanging property without causing surface defects.

The structure of the steel sheet of the present invention is described below.

Area Ratio of Ferrite Phase: 80% or More

The cold-rolled steel sheet of the present invention is directed to use as an automobile steel sheet required to have some extent of moldability, and has a structure containing the ferrite phase at an area ratio of 80% or more in order to ensure ductility. With the ferrite phase at an area ratio of less than 80%, it is difficult to ensure ductility required for an automobile steel sheet required to have moldability. When good ductility is required, the area ratio of the ferrite phase is preferably 85% or more. In the present invention, "ferrite" means so-called polygonal ferrite in which no strain remains.

Average Crystal Grain Diameter of Ferrite Phase: 10 μm or Less

In the present invention, the value used as the average crystal grain diameter is a higher value of the value calculated from a photograph of a sectional structure by a quadrature method defined by ASTM, and the nominal value determined by an intercept method defined by ASTM (refer to, for example, Umemoto et al.: Heat treatment, 24 (1984), p 334).

The cold-rolled steel sheet of the present invention maintains a predetermined amount of dissolved N in the product step. However, as a result of experiment and research conducted by the inventors, it was found that variations in strain age hardenability occur in steel sheets containing the same amount of dissolved N, and one of the main causes of the variations is a crystal grain diameter. In the structure of the present invention, in order to stably obtain a high BH amount and ΔTS, the average crystal grain diameter is at least 10 μm or less, and preferably 8 μm or less. Although the detailed mechanism is not known, this is supposed to be related to the segregation and precipitation of alloy elements in the crystal grain boundaries, and the influences of processing and heat history on the segregation and precipitation.

Therefore, in order to achieve stability of strain age hardenability, the average crystal grain diameter of the ferrite phase is 10 μm or less, and preferably 8 μm or less.

In order to ensure ductility of an automobile steel sheet, and stability of strain age hardenability, the structure of the present invention contains the ferrite phase with an average crystal grain diameter of 10 μm or less at an area ratio of 80% or more.

Area Ratio of Martensite Phase: 2% or More

The cold-rolled steel sheet of the present invention contains the martensite phase as a second phase at an area ratio of 2% or more. The presence of 2% or more of the martensite phase can produce good ductility and a large amount of strain age hardening. Although the detailed mechanism is not known, this effect is supposed to be due to the effective accumulation of strain in the steel sheet due to the presence of the martensite phase during pre-strain processing before aging. Furthermore, the presence of the martensite phase is effective to improve aging deterioration. In order to a good balance between strength and ductility and a low yield ratio, the area ratio of the martensite phase is preferably 5% or more. The presence of the martensite phase at an area ratio of over 20% causes the problem of deteriorating ductility. Therefore, the area ratio of the martensite phase is 2% or more, and preferably 5% to 20%.

Besides the above-described martensite phase, pearlite, bainite, residual austenite are present as second phases without causing any problem. However, in the present invention, it is necessary that the fraction of the ferrite phase is 80% or more, and the fraction of the martensite phase is 2% or more. Therefore, the total area ratios of pearlite, bainiate and residual austenite are limited to less than 18%.

The cold-rolled steel sheet of the present invention, which has the above-described composition and structure, has a tensile strength (TS) of 440 MPa to about 780 MPa, a high r value of 1.2 or more obtained by controlling the aggregation structure of the ferrite base phase, and excellent strain age hardenability. A steel sheet having TS of less than 440 MPa cannot be widely applied to members having structural components. Furthermore, in order to extend the application range, TS is preferably 500 MPa or more. With the r value of less than 1.2, the steel sheet cannot be applied to a wide range of press forming parts. The preferable range of the r value is 1.4 or more.

As described above, in the present invention, "excellent strain age hardenability" means that in aging under conditions of holding at a temperature of 170° C. for 20 min. after pre-deformation with a tensile strain of 5%, the increment in deformation stress (represented by the amount of BH=yield stress after aging−pre-deformation stress before aging) after aging is 80 MPa or more, and the increment in tensile strength (represented by ΔTS=tensile strength after aging tensile strength without strain aging) after strain aging (pre-deformation+aging) is 40 MPa or more.

In defining the strain age hardenability, the amount of pre-strain (pre-deformation) is an important factor. As a result of research of the influence of the amount of pre-strain on strain age hardenability, the inventors found that (1) the deformation stress in the above-described deformation system can be referred to as an amount of approximately uniaxial strain (tensile strain) except the case of excessive deep drawing, (2) the amount of uniaxial strain of an actual part exceeds 5%, and (3) the strength of a part sufficiently corresponds to the strength (YS and TS) obtained after strain aging with a pre-strain of 5%. In the present invention, based on these findings, the pre-deformation of strain aging is defined to a tensile strain of 5%.

Conventional coating and baking conditions: include 170° C. and 20 min as standards. When a strain of 5% is applied to the steel sheet of the present invention, which contains a large amount of dissolved N, hardening can be achieved even by aging at low temperature. In other words, the range of aging conditions can be widened. In order to attain a sufficient amount of hardening, generally, retention at a higher temperature for a longer time is advantageous as long as softening does not occurs by over aging.

Specifically, in the steel sheet of the present invention, the lower limit of the heating temperature at which hardening significantly takes place after pre-deformation is about 100° C. On the other hand, with the heating temperature of over 300° C., hardening peaks, thereby causing the tendency to soften and significantly causing thermal strain and temper color. With the retention time of about 30 seconds or more, hardening can be sufficiently achieved at a heating temperature of about 200° C. In order to obtain more stable hardening, the retention time is preferably 60 seconds or more. However, retention for over 20 mines is practically disadvantageous because further hardening cannot be expected, and the production efficiency significantly deteriorates.

Therefore, in the present invention, the conventional coating and baking conditions, i.e., the heating temperature of 170° C. and the retention time of 20 minutes, are set as the aging conditions. With the steel sheet of the present invention, hardening can be stably achieved even under the aging conditions of a low heating temperature and a short retention time, which fail to achieve sufficient hardening in a conventional bake-hardening steel sheet. The heating method is not limited, and atmospheric heating with a furnace, which is generally used for coating and baking, and other methods such as induction heating, heating with a nonoxidation flame, a laser, plasma, or the like, etc. can be preferably used.

The strength of an automobile part must be sufficient to resist an external complicated stress load, and thus not only strength in a low strain region but also strength in a high strain region are important for a raw material steel sheet. In consideration of this point, in the steel sheet of the present invention used as a raw material for automobile parts, BH is 80 MPa or more, and ΔTS is 40 MPa or more. More preferably, BH is 100 MPa or more, and ΔTS is 50 MPa or more. In order to further increase BH and TS, the heating temperature in aging may be set to a higher temperature, and/or the retention time may be set to a longer time.

The steel sheet of the present invention has the advantage that when the steel sheet is allowed to stand at room temperature for about one week without heating after forming, an increase in strength of about 40% of that at the time of complete aging can be expected.

The steel sheet of the present invention also has the advantage that even when it is allowed in an unmolded state at room temperature for a long time, aging deterioration (an increase in YS and a decrease in El (elongation)) does not occurs, unlike a conventional aging steel sheet. In order to prevent the occurrence of a trouble in actual press forming, it is necessary that in aging at room temperature for 3 months before press forming, an increase in YS is 30 MPa or less, a decrease in elongation is 2% or less, and a recovery of yield point elongation is 0.2% or less.

In the present invention, the surface of the cold-rolled steel sheet may be coated by hot-dip galvanization or alloying hot-dip galvanization without any problem, and TS, BH and ΔTS are equivalent to those before plating. As the plating method, electro-galvanization, hot-dip galvanization, alloying hot-dip galvanization, electro-tinning, electric chromium plating, electro-nickeling, and the like may be preferably used.

The method of producing a steel sheet according to an eighth embodiment of the present invention will be described.

The steel sheet of the present invention is basically produced by performing the hot rolling step in which a steel slab having the above-described composition is heated, and then roughly rolled to form a sheet bar, and the sheet bar is finish-rolled and cooled to form a coiled hot-rolled sheet, the cold rolling step in which the hot-rolled sheet is pickled and cold-rolled to form a cold-rolled sheet, and the cold-rolled sheet annealing step in which the cold-rolled sheet is box-annealing and then continuously annealed.

Although the slab used in the production method of the present invention is preferably produced by a continuous casting method in order to prevent macro-segregation of components, an ingot making method or a thin slab casing method may be used. Alternatively, a conventional method comprising cooling the produced slab to room temperature and then again heating the slab, organ energy-saving process of direct rolling comprising charging a hot slab into a heating furnace without cooling and then rolling it, or rolling directly the slab immediately after slightly keeping it warm may be used without a problem. Particularly, direct rolling is a useful technique for effectively ensuring dissolved N.

Description will be now be made of the reasons for limiting the conditions of the hot rolling step.

Slab Heating Temperature: 1000° C. or More

The slab heating temperature is preferably 1000° C. or more in order to ensure a necessary and sufficient amount of dissolved N in an initial state and satisfy the target amount of dissolved N in a product. Since a loss is increased by an increase in the oxide weight, the heating temperature is preferably 1280° C. or less.

The slab heated under the above condition is roughly rolled to form a sheet bar. The condition of the rough rolling is not defined, and rough rolling may be performed according to a normal method. However, in order to ensure the amount of dissolved N, rough rolling is preferably performed within a as short time as possible. Then, the sheet bar is finish-rolled to form a hot-rolled sheet.

In the present invention, the adjacent sheet bars are preferably bonded together during the time between rough rolling and finish rolling, and then continuously rolled. As the bonding means, a pressure welding method, a laser welding method, an electron beam welding method, or the like is preferably used.

By continuous rolling, so-called non-stationary portions at the front end and the rear end of a coil (processed material) are removed to permit hot rolling over the entire length and the entire width of the coil (processed material) under stable conditions. This is very effective to improve the sectional shape and dimensions of not only the hot-rolled steel sheet but also the cold-rolled steel sheet. When the steel sheet is cooled on a hot run table after rolling, the shape of the steel sheet can be sufficiently maintained because tension can be always applied.

By continuous rolling, the ends of the coil can be stably passed, and it is thus possible to use lubricating rolling, which cannot be easily applied to ordinary single rolling for each sheet bar because of the problem of continuous rolling processes and biting property. Therefore, the rolling load can be decreased, and at the same time, the surface pressure of the roll can be decreased, thereby increasing the life time of the roll.

In the present invention, at the entrance of a finisher between rough rolling and finish rolling, the temperature distributions of the sheet bar in the width direction and the long direction thereof are preferably made uniform by using any one or both of a sheet bar edge heater for heating the ends of the sheet bar in the width direction and a sheet bar heater for heating the ends of the sheet bar in the long direction. This can further decrease the variations in material properties of the steel sheet. The sheet bar edge heater and the sheet bar heater are preferably of an induction heating type.

As the procedure of use of the heaters, preferably, the difference in temperature in the width direction is first corrected by the sheet bar edge heater. Although, the heating amount depends upon the steel composition, the temperature distribution in the width direction at the finisher entrance is preferably set in the range of about 20° C. or less. Next, the difference in temperature in the long direction is corrected by the sheet bar heater. At this time, the heating amount is preferably set so that the temperatures at the ends in the long direction are about 20° C. higher than the temperature at the center.

Finisher Delivery Temperature: 800° C. or More

In order to obtain a homogeneous fine hot-rolled base sheet structure, the finisher deliver temperature FDT is 800° C. or more. With a FDT of lower than 800° C., the structure of the steel sheet becomes inhomogeneous, and the processed structure partially remains to leave heterogeneity of the structure after the cold-rolled sheet annealing step. Therefore, the danger of causing various troubles in press forming is increased. When a high coiling temperature is used for avoiding the processed structure from remaining, coarse crystal grains are produced to cause the same troubles as described above. With the high coiling temperature, the amount of dissolved N is significantly decreased to cause difficulties in obtaining a target tensile strength of 440 MPa or more. Therefore, the finisher deliver temperature FDT is 800° C. or more. In order to further improve the mechanical properties, the FDT is preferably 820° C. or more. Although the upper limit of FDT is not limited, a scale scar significantly occurs at excessively high FDT. The FDT is preferably up to about 1000° C.

Although cooling after finish rolling is not strictly limited, the conditions described below are preferable from the viewpoint of homogeneity in material properties of the steel sheet in the long direction and the width direction thereof. In the present invention, cooling is preferably started immediately after (within 0.5 seconds after) finish rolling, and the mean cooling rate in cooling is preferably 40° C./s or more. By satisfying these conditions, the steel sheet can be rapidly cooled in the high temperature region where AlN precipitates to effectively ensure N in a solid solution state. When the starting time of cooling or the cooling rate does not satisfy the above condition, grain growth excessively proceeds to fail to achieve fine crystal grains, and promote AlN precipitation due to stain energy introduced by rolling. Therefore, the amount of dissolved N tends to decrease, and the structure tends to be made inhomogeneous. In order to ensure homogeneity in material properties and shape, the cooling rate is preferably kept at 300° C./s or less.

Coiling Temperature: 800° C. or Less

The strength of the steel sheet is liable to increase as the coiling temperature CT decreases. In order to ensure the target tensile strength TS of 440 MPa or more, the CT is preferably 800° C. or less. With a CT of less than 200° C., the shape of the steel sheet is readily disturbed to increase the danger of causing troubles in a practical operation, thereby deteriorating homogeneity of material properties. Therefore, the CT is preferably 200° C. or more. When the homogeneity of the material properties is required, the CT is preferably 300° C. or more, and more preferably 350° C. or more. In the present invention, in finish rolling, lubricating rolling may be performed for decreasing the hot rolling load. The lubricating rolling has the effect of further making homogeneous the shape and material properties of the hot-rolled sheet. During the lubricating rolling, the frictional coefficient is preferably in the range of 0.25 to 0.10. By combining lubricating rolling and continuous rolling, the operation of hot rolling is further stabilized.

The hot-rolled sheet subjected to the above-described hot rolling step is then pickled and cold-rolled in the cold rolling step to form a cold-rolled sheet.

The pickling conditions may be the same as conventional known conditions, and are not limited. When the scale of the hot-rolled sheet is extremely small, cold rolling may be immediately after hot rolling without pickling.

The cold rolling conditions may be the same as conventional known conditions, and are not limited. In order to ensure homogeneity of the structure, the reduction ratio of cold rolling is preferably 40% or more. The reasons for limiting the conditions of the cold rolling step are described below.

The cold-rolled sheet is then subjected to the cold-rolled sheet annealing step comprising box annealing and continuous annealing.

Box Annealing Temperature: The Recrystallization Temperature to 800° C.

In the present invention, the cold-rolled sheet is subjected to box annealing to control the aggregation structure of the ferrite phase as a base. By controlling the aggregation structure of the ferrite phase, the r value of the produced sheet can be increased. By box annealing, the (111) aggregation structure suitable for increasing the r value is readily formed in the produced sheet.

With the box annealing temperature less than the recrystallization temperature, recrystallization is not completed to fail to control the aggregation structure of the ferrite phase, thereby failing to increase the r value. On the other hand, with the box annealing temperature of over 800° C., surface defects significantly occur in the steel sheet, thereby failing to achieve the initial purpose. Box annealing is preferably performed in an annealing atmosphere containing a nitrogen gas as a main component and 3 to 5% of hydrogen gas. In this case, the heating and cooling rates may be the same as normal box annealing, and are about 300° C./hr. By using 100% hydrogen gas as an annealing atmosphere gas the higher heating and cooling rates may be used.

Continuous Annealing Temperature: $Ac_1$ Transformation Point to ($Ac_3$ Transformation Point −20° C.)

With the continuous annealing temperature of less than the $Ac_1$ transformation point, the martensite phase is not formed after annealing, while with the continuous annealing temperature of over ($Ac_3$ transformation point −20° C.), the desirable aggregation structure formed in box annealing is lost due to transformation; thereby failing to obtain the produced sheet having a high r value. Therefore, the continuous annealing temperature is preferably $Ac_1$ transformation point to ($Ac_3$ transformation point −20° C.). The retention time of continuous annealing is preferably as short as possible in order to ensure the production efficiency, the fine structure and the amount of dissolved N. From the viewpoint of stability of the operation, the retention time is preferably 10 seconds or more. Also, in order to ensure the fine structure and the amount of dissolved N, the retention time is preferably 120 seconds or less. From the viewpoint of stability of material properties, the retention time is preferably 20 seconds or more.

Cooling After Continuous Annealing: Cooling to the Temperature Region of 500° C. or Less at a Cooling Rate of 10 to 300° C./s Cooling after soaking by continuous annealing is, important for making fine the structure, forming the martensite phase, and ensuring the amount of dissolved N. In the present invention, cooling is continuously carried out to the temperature region of at least 500° C. or less at a cooling rate of 10° C./s or more. With a cooling rate of less than 10° C./s, a necessary amount of martensite phase, a homogeneous fine structure and a sufficient amount of dissolved N cannot be obtained. On the other hand, with a cooling rate of over 300° C./s, homogeneity in material properties of the steel sheet in the width direction deteriorates due to a significant increase in the amount of supersaturated dissolved C. When the stop temperature of cooling at a cooling rate of 10 to 300° C./s after continuous annealing exceeds 500° C., refinement of the structure cannot be attained.

Over Aging Condition: Retention in the Temperature Region of 350° C. to the Cooling Stop Temperature for 20 Seconds or More Subsequent to Cooling After Continuous Annealing Over aging may be performed by retention in the temperature region of 350° C. to the cooling stop temperature for 20 seconds or more subsequent to the stop of cooling after soaking by continuous annealing. By over aging, the amount of dissolved C can be selectively decreased, while the amount of dissolved N is maintained. With the retention temperature region of less than 350° C., a long time is required for decreasing the amount of dissolved C to cause a reduction in productivity. Therefore, the temperature region is preferably 350° C. or more.

By retention in the temperature region of 350° C. to the cooling stop temperature for 20 seconds or more, the amount of dissolved C can be decreased to achieve a higher degree of non-aging properties at room temperature. By increasing the retention time, further improvement can be expected, but the effect is saturated with the retention time of about 120 seconds. Therefore, the retention time is preferably 120 second or less.

In order to obtain a larger amount of strain age hardening, it is advantageous to use either of dissolved C and dissolved N. However, by using dissolved C, aging deterioration at room temperature becomes significant, thereby limiting parts to which the steel sheet is applied. Therefore, in order to produce a strain age hardenable steel sheet having versatility, over aging is preferably performed with the sufficient amount of dissolved N being ensured.

In producing a high-tensile-strength cold-rolled coated steel sheet comprising a high-tensile-strength cold-rolled steel sheet and a hot-dip coated layer formed on the surface thereof, continuous annealing after box annealing can be performed in a continuous hot-dip coating line comprising hot-dip galvanization subsequent to cooling after continuous annealing or further alloying to produce a hot-dip galvanized steel sheet.

Temper Rolling or Lever Processing: Elongation of 0.2 to 15%

In the present invention, in order to correct the shape and control roughness, temper rolling or leveler processing may be carried out subsequent to the cold rolling step. When the total elongation of temper rolling or leveler processing is less than 0.2%, the desired purpose of correcting the shape and controlling roughness cannot be achieved. On the other hand, with a total elongation of over 15%, ductility significantly deteriorates. It is confirmed that the processing system of temper rolling is different from that of leveler processing, but the effects of both processes are substantially the same. Temper rolling and leveler processing are effective after plating.

For reference, description will now be made of forming conditions and conditions for subsequent heat treatment for increasing strength when the steel sheet of the present invention is molded, for example, press-molded. When the steel sheet of the present invention is subjected to press working, for example, deep drawing, the strain introduced by press working is several % to several tens %. Although the amount of strain changes with molded parts, a strain of about 5 to 10% is introduced into an inner plate and a structural member in the automobile field.

These automobile parts are heat-treated by coating and baking. However, with the steel sheet of the present invention, strength of a molded product can be effectively increased after heat treatment. In the present invention, as a method of evaluating burning hardenability in a laboratory, a tensile test specimen of JIS No. 5 size is obtained from the steel sheet in the rolling direction, and tensile strain of 10% is applied to the tensile test specimen by a tensile testing machine. Then, the specimen is heat-treated and again subjected to a tensile test. Particularly, when properties are evaluated after heat treatment in a low temperature region, the heat treatment conditions include 120° C. and 20 minutes. In this test, the properties of the completed portion after heat treatment subsequent to press forming are evaluated.

Namely, in the present invention, the difference (ΔTS) between the tensile strength of the specimen after application of tensile strain and heat treatment and the tensile strength of a product is defined as the strength increasing ability of heat treatment.

In order to increase the strength of the molded product, the amount of strain introduced by forming, or the heat treatment temperature after processing is preferably as high as possible.

However, with the steel sheet of the present invention, when the amount of applied strain is about 5 to 10%, the strength can be sufficiently increased even by heat treatment at a temperature lower than conventional heat treatment, i.e., a temperature of 200° C. or less, after forming. However, with a heat treatment temperature of less than 120° C., the strength cannot be sufficiently increased with the low train applied. On the other hand, with the heat treatment temperature of over 350° C. after forming, softening proceeds. Therefore, the temperature of heat treatment after forming is preferably about 120 to 350° C.

The heating method is not limited, and hot gas heating, infrared furnace heating, hot-bath heating, direct current heating, induction heating, and the like can be used. Alternatively, only a portion where strength is desired to be increased is selectively heated.

EXAMPLES

In the examples below, the amount of dissolved N, the microstructure, tensile properties, the r value, strain age hardenability, and aging property were examined. The examination methods were as follows:

(1) Amount of Dissolved N

The amount of dissolved N was determined by subtracting the amount of precipitated N from the total N amount of steel determined by chemical analysis. The amount of precipitated N was determined by an analysis method using a constant-potential electrolytic method.

(2) Microstructure

A test specimen was obtained from each of cold-rolled annealed steel sheets, and the microstructure of a section (C section) perpendicular to the rolling direction was imaged with an optical microscope or a scanning electron microscope. Then, the fraction of the ferrite texture and the type and the structure fraction of a second phase were determined by an image analysis apparatus.

(3) Crystal Grain Diameter

In the present invention, the value used as the average crystal grain diameter was a higher one of the value calculated from a photograph of a sectional structure by a quadrature method defined by ASTM, and the nominal value determined from a photograph of a sectional structure by an intercept method defined by ASTM (refer to, for example, Umemoto et al.: Heat Treatment, 24 (1984), p334).

(4) Tensile Properties

A test specimen of JIS No. 5 was obtained from each of cold-rolled annealed steel sheets in the rolling direction, and a tensile test was carried out with a strain rate of $3\times10^{-3}$/s according to the regulations of JIS Z 2241 to determine yield stress YS, tensile strength TS, and elongation El.

(5) Strain Age Hardenability

A test specimen of JIS No. 5 was obtained from each of cold-rolled annealed steel sheets in the rolling direction, and a tensile strain of 5% was applied as pre-deformation. Then, the specimen was subjected to heat treatment corresponding to coating and baking at 170° C. for 20 minutes, and a tensile test with a strain rate of $3\times10^{-3}$/s was performed to determine the tensile properties (yield stress TSBH, tensile strength TSBH). Then, BH amount=YSBH−YS5%, and ΔTS=TSBH−TS were calculated. YS5% represents deformation stress in 5% pre-deformation of the produced sheet, YSBH and TSBH represent yield stress and tensile strength, respectively, after pre-deformation and heat treatment, and TS represents the tensile strength of the produced sheet.

(6) Measurement of r Value

A test specimen of JIS No. 5 was obtained from each of the cold-rolled annealed steel sheets in each of the rolling direction (L direction), the direction (D direction) at 45° with the rolling direction, and the direction (C direction) at 90° with the rolling direction. The width-direction strain and thickness-direction strain of each of the test specimens were determined when a uniaxial tensile strain of 15% was applied to each specimen, and the r value of each specimen in each of the directions was determined from the following ratio of width-direction strain to thickness-direction strain:

$$r=ln(w/w0)/ln(t/t0)$$

(wherein w0 and t0 represent the width and thickness of a specimen before the test, and w and t represent the width and thickness of a specimen after the test).

The mean value was determined by the following equation:

$$rmean=(rL+2rD+rD)/4$$

wherein rL represents the r value in the rolling direction (L direction), rd represents the r value in the direction (D direction) at 45° with the rolling direction, and rL represents the r value in the direction (C direction) at 90° with the rolling direction. In order to improve the precision of experiment, calculation was made by using changes in elongation strain and strain in the width direction on the assumption that the volume was constant.

(7) Aging Properties

A test specimen of JIS No. 5 was obtained from each of cold-rolled annealed steel sheets in the rolling direction, and then subjected to aging at 50° C. for 200 hours, followed by a tensile test. The difference in yield elongation ΔY−El between before and after aging was determined from the obtained results to evaluate aging properties at normal temperature. When ΔY−El was zero, it was evaluated that the specimen has non-aging properties and excellent natural aging resistance.

(8) Tensile Strength after Forming and Heat Treatment

A test specimen of JIS No. 5 was obtained from each of produced sheets in the rolling direction, and then a pre-strain of 10% was applied thereto. Then, heat treatment was conducted for 20 minutes at a conventional heat treatment temperature of 120° C. and a temperature of 170° C. corresponding to coating and baking, and then tensile strength was determined.

(9) Decrease (ΔEl) in Total Elongation by Natural Aging

The (decrease (ΔEl) in total elongation by natural aging was determined as the difference between the total elongation measured with a specimen of JIS NO 5 obtained from the produced sheet in the rolling direction, and the total elongation measured with a specimen of JIS NO 5 separately obtained from the produced sheet in the rolling direction after accelerated aging (retention at 100° C. for 8 hours) of natural aging.

Example 1

A steel slab having each of the compositions shown in Table 1 was hot-rolled to a hot-rolled sheet having a thickness of 3.5 mm, and then cold-rolled to a cold-rolled sheet having a thickness of 0.7 mm under the conditions shown in Table 2. Then, the cold-rolled sheet was recrystallized, annealed and further galvannealed in a continuous annealing line or a continuous annealing and galvanizing line. Then, the annealed sheet was temper-rolled with a rolling reduction ratio of 1.0% to produce a cold-rolled steel sheet and a galvannealed steel sheet having both sides coated with a weight of 45 g/m$^2$ per side. In Table 2, the finisher deliver temperatures in the hot rolling process of Steel Nos. 3 and 8 are less than the $Ar_3$ transformation point, and the finisher deliver temperatures of the others are the $Ar_3$ transformation point or more.

The thus-obtained cold-rolled steel sheets and the galvannealed steel sheets were measured with respect to tensile strength, the r value, and a change in tensile strength after forming and heat treatment. The results are shown in Table 3.

Table 3 indicates that with all the cold-rolled steel sheets and the galvannealed steel sheets obtained according to the present invention, a high r value and excellent strain age hardenability are obtained, as compared with comparative examples. Particularly, in the suitable examples in which the crystal grain diameter is 20 μm or less, the decrease in elongation due to natural aging is also as low as 2.0% or less.

Example 2

A slab of steel symbol B shown in Table 1 was hot-rolled under the same production conditions as No. 2 shown in Table 2 in which the heating temperature was 1100° C., and the finisher deliver temperature of hot rolling was 900° C., and then coiled at coiling temperature of 550° C. into a coil. The thus-obtained coil was cold-rolled with a reduction ratio of 80%, and then recrystallized and annealed at 840° C. With respect to the product properties of the resultant cold-rolled steel sheet, tensile strength TS was 365 MPa, and the r value was 1.7. A test specimen of JIS No. 5 was obtained from the cold-rolled steel sheet in the rolling direction, and a tensile strain of 10% was applied by a tensile test machine. Then, the specimen was subjected to heat treatment under the heat treatment conditions (temperature and time) shown in Table 4, and a tensile test was again performed. Table 4 also shows the increase in tensile strength (ΔTS) from the tensile strength (TS=365 MPa) of a product before application of strain.

Table 4 indicates that the increase in strength increases as the heat treatment temperature increases, and the heat treatment time increases. However, with the steel sheet of the present invention, a sufficient increase in tensile strength of 82 MPa (85% or more of an increase in heat treatment for 20 minutes) can be obtained even by heat treatment at low temperature of 120° C. for a short retention time of 2 minutes. It is thus found that with the steel sheet of the present invention good strain age hardenability can be obtained even by heat treatment at a low temperature for a short time. In order to obtain the stable effect of increasing strength of an automobile structural member, or the like, heat treatment at a normal temperature for a normal time causes no problem. It was confirmed that with the galvanized steel sheets and the galvannealed steel sheets obtained by hot-dip galvanizing and heat alloying the cold-rolled sheets, the same results as shown in Table 4 are obtained.

Example 3

A steel slab having each of the compositions shown in Table 6 was hot-rolled under the conditions shown Table 7 to form a hot-rolled sheet having a thickness of 3.5 mm. Each of the thus-obtained hot-rolled sheets was cold-rolled under the conditions shown in Table 7 to form a cold-rolled sheet having a thickness of 0.7 mm, and then recrystallized and annealed under the conditions shown in the same table. Some of the annealed sheets were further coated by hot-dip galvanization or alloying hot-dip galvanization under the conditions shown in the same table. The thus-obtained produced sheets were examined with respect to the amount of dissolved N, the microstructure, tensile properties, and strain age hardenability.

The results are shown in Table 8. Table 8 indicates that with the steel sheets of the present invention, TS×r value≧750 MPa (in a combination with at least one of B, Nb, Ti and V, Ts×r value 850 ≧MPa), BH≧80 MPa and ΔTS≧40 MPa are satisfied, while in the comparative examples, at least one of the three properties does not reach the level of the present invention.

Example 4

Examples of the present invention are described below.

Melted steel having each of the compositions shown in Table 9 was formed in an ingot by a converter, and then formed in a steel slab by a, continuous casting method. Each of the resultant steel slabs was heated under the conditions shown in Table 10, and roughly rolled to form a sheet bar. The sheet bar was hot-rolled by the hot rolling step comprising finish rolling under the conditions shown in Table 10 to form a hot-rolled sheet. The $Ar_3$ transformation point was measured by simulating the conditions for hot rolling finish rolling using a processing transformation measuring apparatus (produced by Fuji Denpa Kouki). The results are shown in Table 10.

Each of the thus-obtained hot-rolled sheets was cold-rolled by the cold rolling step under the conditions shown in Table 10 to form a cold-rolled sheet. Then, each of the cold-rolled sheets was continuously annealed under the conditions shown in Table 10. Some of the cold-rolled sheets were further temper-rolled after the cold-rolled sheet annealing step.

The thus-obtained cold-rolled annealed sheets were examined with respect to the amount of dissolved N, the microstructure, tensile properties, the r value, strain age hardenability and aging properties.

The surface of each of the steel sheets of Nos. 4 and 10 was hot-dip galvanized to form a coated steel sheet, and evaluated with respect to the same properties as described above.

The results are shown in Table 11.

All examples of the present invention have excellent ductility, an extremely high BH amount and ΔTS, excellent strain age hardenability, a mean r value of as high as 1.2 or more, and non-aging properties at natural aging (excellent natural aging resistance). With respect to the properties of the coated steel sheets obtained by hot-dip galvanizing the surfaces of the steel sheets of Nos. 4 and 10, the mean r value is decreased by 0.2, and the elongation El is decreased by about 1%, as compared with the cold-rolled steel sheets, because of shrinkage restriction of the coated layer in the width direction. However, strain age hardenability and natural aging resistance are substantially the same as those before coating. On the other hand, in the comparative examples out of the range of the present invention, ductility deteriorates, the BH amount and ΔTS are low, or natural aging deterioration significantly occurs. Therefore, the comparative examples do not have all the intended properties, and thus cannot be said as steel sheets having sufficient properties.

Steel sheet No. 11 contains C, Al, N, and N/Al out of the range of the present invention, and thus the r value, the BH amount, ΔTS and natural aging resistance deteriorate. Steel sheet No. 12 contains B and Nb out of the range of the present invention, and thus the amount of acicular ferrite is greatly deviated from the range of the present invention, deteriorating the BH amount, ΔTS, and natural aging resistance.

Steel sheet No. 13 contains B out of the range of the present invention, and thus the amount of acicular ferrite is greatly deviated from the range of the present invention, deteriorating the r value, the BH amount, ΔTS, and natural aging resistance. Steel sheet No. 14 contains Nb out of the range of the present invention, and thus the amount of dissolved N is greatly lower than the range of the present invention, deteriorating strain age hardenability.

Steel sheet No. 15 contains N out of the range of the present invention, and thus the amount of dissolved N is low, deteriorating strain age hardenability. In Steel Nos. 17 to 20, the hot rolling conditions and the cold-rolled sheet annealing conditions are deviated from the suitable ranges, and thus the microstructure is out of the range of the present invention, decreasing the BH amount and ΔTS and deteriorating strain age hardenability and natural aging resistance.

Example 5

Steel having the composition shown in Table 12 was formed in a slab by the same method as Example 4, and then heated and temper-rolled under the conditions shown in Table 13 to form a sheet bar. The sheet bar was then hot-rolled by the hot rolling step comprising finish rolling under the conditions shown in Table 13 to form a hot-rolled sheet. The adjacent sheet bars on the finisher entrance side after rough rolling were bonded together by a melt welding method and then continuously rolled. The temperatures of the ends of the sheet bar were controlled in the width direction and the length direction by using an induction heating-type sheet bar edge heater and a sheet bar heater.

The thus-obtained hot-rolled sheet was cold-rolled by the cold rolling step comprising pickling and cold rolling under the conditions shown in Table 13 to form a cold-rolled sheet having a thickness of 1.6 mm. Then, the cold-rolled sheet was continuously annealed under the conditions shown in Table 13.

The thus-obtained cold-rolled annealed sheet was examined with respect to the amount of dissolved N, the microstructure, tensile properties, the r value, and strain age hardenability by the same methods as Example 4. The tensile property of each cold-rolled annealed sheet was measured at ten positions in each of the width direction and the long direction to examine variations in yield strength, tensile strength and elongation.

The results are shown in Table 14.

All the examples of the present invention have excellent strain age hardenability and a high r value, and exhibit extremely high stable BH amount, ΔTS and mean value regardless of variations in production conditions. It was also recognized that in the examples of the present invention, by performing continuous rolling and controlling the temperature of the sheet bar in the long direction and the width direction, the thickness precision and the shape of the produced steel sheet are improved, and variations in material properties are decreased to ½. Even when the elongation of temper rolling is changed to 0.5 to 2%, and the elongation of the leveler is changed to 0 to 1%, strain age hardenability does not deteriorate.

Example 6

Examples of the present invention are described below.

Melted steel having each of the compositions shown in Table 15 was formed in an ingot by a converter, and then formed in a slab by a continuous casting method. Each of the steel slabs was heated (in some cases, a hot slab was charged) and roughly rolled under the conditions shown in Table 16 to form a sheet bar. The sheet bar was then hot-rolled by the hot rolling step comprising finish rolling under the conditions shown in Table 16 to form a hot-rolled sheet. With some of the sheet bars, the adjacent sheet bars were bonded by the melt welding method, and then continuously rolled.

Each of the resultant hot-rolled sheets was cold-rolled in the cold rolling step comprising pickling and cold rolling under the conditions shown in Table 16 to form a cold-rolled sheet. Each of the thus-obtained cold-rolled sheet was box-annealed and then continuously annealed under the conditions shown in Table 16. Some of the cold-rolled sheets were temper-rolled after the cold-rolled sheet annealing step. Box annealing may not be carried out. In all cases, the annealing temperature of box annealing was the recrystallization temperature or more.

The thus-obtained cold-rolled annealed sheets were examined with respect to the amount of dissolved N, the microstructure, tensile properties, the r value, strain age hardenability, and the aging property.

The surfaces of the steel sheets of Nos. 17 and 18 were coated-by hot-dip galvanization in an in-line after continuous annealing shown in Table 16 to form coated steel sheets. The coated steel sheets were also examined with respect to the same properties as described above.

The results are shown in Table 17.

All the examples of the present invention have excellent ductility, extremely high stable BH amount and ΔTS, excellent strain age hardenability, a mean r value of as high as 1.2, and natural non-aging properties. The properties of the hot-dip galvanized steel sheets of Nos. 17 and 18 shown in Table 17 are substantially the same as the cold-rolled steel sheets subjected to continuous annealing. On the other hand, in the comparative examples out of the range of the present invention, ductility deteriorates, the BH amount and TS are low, or aging deterioration significantly occurs. Therefore, the comparative examples do not have all the intended properties, and thus cannot be said as steel sheets having sufficient properties.

Steel sheet No. 11 contains C and N in amounts out of the range of the present invention, and has an amount of dissolved N and a martensite amount lower than the range of the present invention. Therefore, the BH amount and ΔTS are decreased, and ΔY−El is increased. Steel sheet No. 12 contains Al, N/Al and N out of the range of-the present invention, and has an amount of dissolved N lower than the range of the present invention, and the average crystal grain diameter of ferrite higher than the range of the present invention. Therefore, the BH amount and ΔTS are decreased, and ΔY−El is increased.

In steel sheet No. 13, the slab heating temperature and finisher delivery temperature FDT are out of the range of the present invention, the amount of dissolved N and the amount of martensite are lower than the range of the present invention, and the average crystal grain diameter of ferrite is higher than the range of the present invention. Therefore, the r value, the BH amount and ΔTS are decreased. In steel sheet No. 14, the coiling temperature after hot rolling is out of the range of the present invention, the amount of dissolved N and the amount of martensite are lower than the range of the present invention, and the average crystal grain diameter of ferrite is higher than the range of the present invention. Therefore, the r value, the BH amount and ΔTS are decreased.

In steel sheet No. 15, the continuous annealing temperature is out of the range of the present invention, martensite is not formed, and the average crystal grain diameter of ferrite is higher than the range of the present invention. Therefore, the BH amount and ΔTS are decreased, and ΔY−El is increased. In steel sheet No. 16, box annealing is not performed to fail to develop the desirable aggregation structure, deteriorating the r value. Also, the average crystal grain diameter of ferrite, and the area ratio of martensite are out of the range of the present invention.

Example 7

Steel having the composition shown in Table 18 was formed in a slab by the same method as Example 1, and then heated and roughly rolled under the conditions shown in Table 19 to form a sheet bar having a thickness of 30 mm. The sheet bar was hot-rolled by the hot rolling step comprising finish rolling under the conditions shown in Table 19 to form a hot-rolled sheet. With some of the sheet bars, the adjacent sheet bars on the finisher entrance side after rough rolling were bonded together by the melt welding method, and then continuously rolled. The temperatures of the ends of the sheet bar were controlled in the width direction and the length direction by using an induction heating-type sheet bar edge heater and a sheet bar heater.

The thus-obtained hot-rolled sheet was cold-rolled by the cold rolling step comprising pickling and cold rolling under the conditions shown in Table 19 to form a cold-rolled sheet having a thickness of 1.6 mm. Then, the cold-rolled sheet was box-annealed and then continuously annealed by a continuous annealing furnace under the conditions shown in Table 19. In all cases, the annealing temperature of box annealing are the recrystallization temperature or more.

The thus-obtained cold-rolled annealed sheet was examined with respect to the amount of dissolved N, the microstructure, tensile properties, the r value, and strain age hardenability by the same methods as Example 1. The tensile property of each cold-rolled annealed sheet was measured at ten positions in each of the width direction and the long direction to examine variations in yield strength, tensile strength and elongation. The variation is shown by a difference between the maxim and minimum of all measurements, for example, δYS=(maximum of YS )−(minimum of YS). The results are shown in Table 20.

All the examples of the present invention have excellent strain age hardenability and a high r value, and exhibit extremely high stable BH amount, ΔTS and mean r value regardless of variations in production conditions. It was also recognized that in the examples of the present invention, by performing continuous rolling and controlling the temperature of the sheet bar in the long direction and the width direction, the thickness precision and the shape of the produced steel sheet are improved, and variations in material properties are decreased.

INDUSTRIAL AVAILABILITY

According to the present invention, a cold rolled steel sheet can be obtained, in which TS is greatly increased by press forming and heat treatment while maintaining excellent deep drawability in press forming. The cold-rolled steel sheet has the excellent effect of industrially producing coated steel sheets by electro-galvanization, hot-dip galvanization, alloying hot-dip galvanization.

TABLE 1

| | Chemical Composition (mass %) | | | | | | | | | Equation | Equation | |
|---|---|---|---|---|---|---|---|---|---|---|---|---|
| Steel | C | N | Si | Mn | B | Al | Nb | P | S | (1)'* | (2)'** | Remarks |
| A | 0.0009 | 0.011 | 0.01 | 0.12 | 0.0009 | 0.010 | 0.016 | 0.009 | 0.005 | 0.0023 | −0.0001 | Suitable example |
| B | 0.0020 | 0.015 | 0.01 | 0.11 | 0.0011 | 0.012 | 0.035 | 0.015 | 0.006 | 0.0021 | −0.0003 | Suitable example |
| C | 0.0005 | 0.009 | 0.01 | 0.09 | 0.0005 | 0.009 | 0.010 | 0.011 | 0.005 | 0.0022 | −0.0001 | Suitable example |
| D | 0.0020 | 0.021 | 0.01 | 0.50 | 0.0015 | 0.020 | 0.035 | 0.030 | 0.004 | 0.0035 | −0.0003 | Suitable example |
| E | 0.0003 | 0.010 | 0.50 | 0.12 | 0.0006 | 0.011 | 0.099 | 0.045 | 0.010 | 0.0022 | −0.0003 | Suitable example |
| F | 0.0011 | 0.030 | 0.80 | 0.80 | 0.0011 | 0.028 | 0.025 | 0.009 | 0.005 | 0.0103 | −0.0005 | Suitable example |
| G | 0.0011 | 0.018 | 0.70 | 0.12 | 0.0008 | 0.012 | 0.018 | 0.008 | 0.005 | 0.0080 | −0.0001 | Suitable example |
| H | 0.0005 | 0.020 | 0.35 | 0.11 | 0.0014 | 0.020 | 0.025 | 0.007 | 0.005 | 0.0041 | −0.0011 | Suitable example |
| I | 0.0098 | 0.002 | 0.01 | 0.12 | 0.0007 | 0.038 | 0.055 | 0.009 | 0.005 | −0.0269 | 0.0027 | Comparative example |
| J | 0.0022 | 0.001 | 0.50 | 0.12 | 0.0008 | 0.012 | 0.001 | 0.008 | 0.005 | −0.0064 | 0.0021 | Comparative example |
| K | 0.0260 | 0.003 | 0.02 | 0.25 | 0.0001 | 0.035 | 0.001 | 0.013 | 0.007 | −0.0154 | 0.0259 | Comparative example |
| L | 0.0027 | 0.011 | 0.01 | 0.12 | 0.0007 | 0.014 | 0.001 | 0.009 | 0.005 | 0.0027 | 0.0026 | Comparative example |

*Equation (1)': N % − (14/93 · Nb % + 14/27 · Al % + 14/11 · B %) (the suitable range of this invention is 0.0015 or more)

**Equation (2)': C % − (0.512/93 · Nb %) (the suitable range of this invention is 0 or less)

TABLE 2

| | | Hot rolling condition | | | | Cold rolling condition | | | | |
|---|---|---|---|---|---|---|---|---|---|---|
| No. | Steel | Slab heating temperature (° C.) | Finisher delivery temperature (° C.) | Cooling condition after finish rolling (s, ° C./s) | Coiling temperature (° C.) | Cold rolling reduction ratio (%) | Heating rate (° C./s) | Recrystallization annealing temperature (° C.) | Presence of alloying hot-dip galvanization | Remarks |
| 1 | A | 1150 | 920 | 0.39, 58 | 600 | 80 | 15 | 840 | Yes | Suitable example |
| 2 | B | 1100 | 900 | 0.32, 53 | 550 | 80 | 15 | 840 | Yes | Suitable example |
| 3 | C | 1130 | 650* | 0.25, 15 | 600 | 80 | 15 | 840 | No | Suitable example |
| 4 | D | 1110 | 900 | 0.35, 59 | 400 | 80 | 15 | 840 | No | Suitable example |
| 5 | E | 1160 | 920 | 0.28, 70 | 650 | 80 | 15 | 840 | Yes | Suitable example |
| 6 | F | 1150 | 910 | 0.39, 65 | 550 | 80 | 15 | 840 | Yes | Suitable example |
| 7 | G | 1150 | 900 | 0.36, 58 | 500 | 80 | 15 | 840 | No | Suitable example |
| 8 | H | 1000 | 680* | 0.26, 20 | 500 | 80 | 15 | 840 | No | Suitable example |
| 9 | A | 1150 | 920 | 1.13, 10 | 600 | 80 | 25 | 840 | Yes | Suitable example |
| 10 | E | 1160 | 920 | 0.67, 15 | 650 | 80 | 25 | 840 | Yes | Suitable example |
| 11 | I | 1140 | 920 | 0.35, 57 | 650 | 80 | 15 | 840 | Yes | Comparative example |
| 12 | J | 1000 | 900 | 0.68, 7 | 550 | 80 | 15 | 840 | Yes | Comparative example |
| 13 | K | 1150 | 880 | 0.38, 61 | 500 | 80 | 15 | 840 | No | Comparative example |
| 14 | L | 1000 | 920 | 1.02, 9 | 600 | 80 | 15 | 940 | No | Comparative example |

*The finisher delivery temperature was lower than $Ar_3$ transformation point. The cooling conditions after finish rolling include the cooling start time(s) and the cooling rate (° C./s).

TABLE 3

| | | Product characteristics | | | | Charge in tensile strength after forming-heat treatment | | | | |
|---|---|---|---|---|---|---|---|---|---|---|
| No. | Steel | Tensile strength T.S. (MPa) | r value | Crystal grain diameter (μm) | ΔE1 (%) | T.S. after heat treatment at 120° C. (MPa) | ΔT.S. after heat treatment at 120° C. (MPa) | T.S. after heat treatment at 170° C. (MPa) | ΔT.S. after heat treatment at 170° C. (MPa) | Remarks |
| 1 | A | 360 | 1.8 | 18 | 1.6 | 435 | 75 | 455 | 95 | Suitable example |
| 2 | B | 365 | 1.7 | 12 | 1.2 | 460 | 95 | 470 | 105 | Suitable example |
| 3 | C | 355 | 2.3 | 19 | 1.8 | 420 | 65 | 440 | 85 | Suitable example |
| 4 | D | 390 | 1.9 | 14 | 1.3 | 480 | 90 | 490 | 100 | Suitable example |
| 5 | E | 430 | 1.8 | 18 | 1.7 | 520 | 90 | 530 | 100 | Suitable example |
| 6 | F | 460 | 1.6 | 18 | 1.7 | 575 | 115 | 595 | 135 | Suitable example |
| 7 | G | 430 | 1.8 | 13 | 1.4 | 540 | 110 | 555 | 125 | Suitable example |
| 8 | H | 390 | 2.1 | 19 | 1.7 | 490 | 100 | 510 | 120 | Suitable example |
| 9 | A | 352 | 1.9 | 22 | 2.4 | 414 | 62 | 440 | 88 | Suitable example |
| 10 | E | 417 | 1.9 | 23 | 2.7 | 489 | 72 | 503 | 86 | Suitable example |
| 11 | I | 370 | 1.9 | 18 | 3.2 | 420 | 50 | 450 | 80 | Comparative example |
| 12 | J | 400 | 1.6 | 22 | 2.4 | 435 | 35 | 460 | 60 | Comparative example |
| 13 | K | 360 | 1.1 | 26 | 3.1 | 390 | 30 | 415 | 55 | Comparative example |
| 14 | L | 360 | 1.2 | 25 | 4.2 | 414 | 54 | 445 | 85 | Comparative example |

TABLE 4

| | | Heat treatment temperature (° C.) | | |
|---|---|---|---|---|
| | | 120 | 200 | 300 |
| Retention time (min.) | 2 | 82 | 114 | 133 |
| | 5 | 86 | 119 | 136 |
| | 10 | 91 | 122 | 138 |
| | 20 | 95 | 125 | 140 |

TABLE 5

| Al % | N/Al | TS x r value MPa | ΔTS MPa |
|---|---|---|---|
| 0.020 | 0.75 | 775 | 58 |
| 0.036 | 0.42 | 762 | 55 |
| 0.049 | 0.31 | 753 | 42 |
| 0.072 | 0.21 | 720 | 25 |
| 0.080 | 0.19 | 719 | 19 |

TABLE 6

| Steel | C % | Si % | Mn % | P % | S % | N % | Al % | Nb % | Ti % | V % | B % | N/(Al + Nb + Ti + V + B)* | $Ar_3$ ° C. |
|---|---|---|---|---|---|---|---|---|---|---|---|---|---|
| A | 0.0013 | 0.01 | 0.15 | 0.009 | 0.005 | 0.0135 | 0.011 | — | — | — | — | 1.23 | 884 |
| B | 0.0012 | 0.50 | 0.50 | 0.011 | 0.004 | 0.0175 | 0.010 | 0.010 | — | — | 0.0010 | 0.83 | 888 |
| C | 0.0008 | 0.01 | 0.01 | 0.009 | 0.003 | 0.0190 | 0.009 | — | 0.015 | 0.015 | 0.0010 | 0.48 | 896 |
| D | 0.0025 | 0.01 | 0.09 | 0.005 | 0.003 | 0.0160 | 0.010 | 0.010 | 0.015 | — | 0.0006 | 0.45 | 876 |
| E | 0.0016 | 0.55 | 0.80 | 0.04 | 0.003 | 0.0195 | 0.015 | 0.009 | — | 0.018 | 0.0012 | 0.45 | 905 |
| F | 0.0011 | 0.75 | 0.75 | 0.02 | 0.002 | 0.0135 | 0.008 | 0.015 | — | — | 0.0010 | 0.56 | 889 |
| G | 0.0032 | 0.01 | 0.14 | 0.009 | 0.003 | 0.0130 | 0.045 | — | — | — | — | 0.29 | 894 |
| H | 0.0019 | 0.45 | 0.45 | 0.04 | 0.005 | 0.0140 | 0.015 | 0.035 | — | — | 0.0012 | 0.27 | 882 |

*The concentrations of Ti, V and B not added are shown by "—", and handled as "0" in calculation of N/(Al + Nb + Ti + V + B).

TABLE 7

| | | Hot rolling | | | | | | | Hot-rolled sheet annealing | |
|---|---|---|---|---|---|---|---|---|---|---|
| | | Rough rolling | | Finish rolling | | | | Coiling | | Process |
| No. | Steel | SET ° C. | RDT ° C. | FET ° C. | Presence of lubrication | FDT ° C. | Reduction ratio % | CT ° C. | Temp. ° C. | Batch Continuous |
| 1 | A | 1150 | 900 | 810 | Yes | 660 | 95 | 510 | 790 | Batch |
| 2 | B | 1150 | 910 | 880 | Yes | 660 | 95 | 510 | 840 | Continuous |
| 3 | C | 1140 | 920 | 840 | Yes | 680 | 95 | 520 | 800 | Batch |
| 4 | D | 1180 | 900 | 820 | Yes | 650 | 95 | 500 | 830 | Continuous |
| 5 | E | 1190 | 930 | 850 | Yes | 690 | 95 | 530 | 810 | Batch |
| 6 | F | 1160 | 920 | 840 | Yes | 670 | 95 | 530 | 810 | Batch |
| 7 | G | 1120 | 910 | 820 | Yes | 670 | 95 | 520 | 800 | Batch |
| 8 | H | 1100 | 900 | 810 | Yes | 650 | 95 | 500 | 790 | Batch |
| 9 | A | 1080 | 900 | 810 | Yes | 660 | 95 | 500 | 790 | Batch |
| 10 | B | 1140 | 910 | 820 | Yes | 670 | 65 | 520 | 790 | Batch |
| 11 | C | 1250 | 1150 | 1070 | Yes | 910 | 95 | 750 | 850 | Continuous |
| 12 | D | 1170 | 900 | 810 | Yes | 660 | 95 | 510 | No processing | |

| | | Cold rolling | Cold-rolled sheet re-crystallization annealing | | Cooling cool rate before plating | Plating | | Alloying | | |
|---|---|---|---|---|---|---|---|---|---|---|
| No. | Steel | Reduction ratio % | Temp. ° C. | Time s | ° C./s | Sheet temp. ° C. | Bath temp. ° C. | Temp. ° C. | Retention time s | Remarks |
| 1 | A | 80.0 | 860 | 40 | 15 | 470 | 465 | — | — | II |
| 2 | B | 80.0 | 860 | 40 | — | — | — | — | — | I |
| 3 | C | 82.5 | 870 | 40 | 30 | 465 | 460 | 460 | 25 | III |
| 4 | D | 82.5 | 850 | 40 | 85 | 470 | 465 | — | — | II |
| 5 | E | 80.0 | 880 | 40 | 25 | 465 | 460 | 460 | 23 | III |
| 6 | F | 82.5 | 880 | 40 | — | — | — | — | — | I |
| 7 | G | 80.0 | 870 | 40 | 50 | 480 | 470 | — | — | II |
| 8 | H | 80.0 | 860 | 40 | 15 | 465 | 470 | 470 | 20 | ⑦ |
| 9 | A | 82.5 | 860 | 40 | 15 | 470 | 465 | — | — | II |
| 10 | B | 82.5 | 860 | 40 | 1 | 470 | 460 | 460 | 20 | III |
| 11 | C | 80.0 | 870 | 40 | 30 | 465 | 460 | 460 | 25 | III |
| 12 | D | 80.0 | 850 | 40 | — | — | — | — | — | I |

SRT = slab heating temperature,
RDT = rough rolling delivery temperature,
FET = finisher entrance temperature,
FDT = finisher delivery temperature,
CT = coiling temperature,
I = cold-rolled steel sheet,
II = hot-dip galvanized steel sheet,
III = alloying hot-dip galvanized steel sheet

TABLE 8

| | | | Tensile property before strain aging | | | | | Strain age hardening property | | |
|---|---|---|---|---|---|---|---|---|---|---|
| No. | Steel | Dissolved N % | YS MPa | TS MPa | El % | r value | TSxr value MPa | BH MPa | ΔTS MPa | Remarks |
| 1 | A | 0.0069 | 225 | 321 | 53 | 2.4 | 770 | 122 | 75 | Example |
| 2 | B | 0.0089 | 274 | 391 | 43 | 2.3 | 899 | 183 | 93 | Example |
| 3 | C | 0.0054 | 221 | 316 | 54 | 2.8 | 885 | 97 | 72 | Example |
| 4 | D | 0.0049 | 221 | 316 | 54 | 2.8 | 885 | 90 | 66 | Example |
| 5 | E | 0.0050 | 304 | 435 | 39 | 2.0 | 870 | 80 | 63 | Example |
| 6 | F | 0.0088 | 304 | 434 | 39 | 2.1 | 911 | 133 | 87 | Example |
| 7 | G | 0.0000 | 224 | 320 | 53 | 2.8 | 896 | 3 | 0 | Comparative example |
| 8 | H | 0.0000 | 284 | 405 | 42 | 2.1 | 851 | 2 | 0 | Comparative example |
| 9 | A | 0.0070 | 215 | 311 | 50 | 2.3 | 715 | 152 | 83 | Comparative example |
| 10 | B | 0.0082 | 274 | 391 | 43 | 1.9 | 743 | 143 | 94 | Comparative example |
| 11 | C | 0.0035 | 236 | 331 | 51 | 2.0 | 662 | 93 | 48 | Comparative example |
| 12 | D | 0.0041 | 241 | 336 | 51 | 2.1 | 706 | 85 | 49 | Comparative example |

TABLE 9

| | Chemical Composition (% by mass) | | | | | | | | | | | |
|---|---|---|---|---|---|---|---|---|---|---|---|---|
| Steel | C | Si | Mn | P | S | Al | N | N/Al | Nb | 12/93 Nb | B | Others |
| A | 0.0025 | 0.15 | 0.85 | 0.050 | 0.002 | 0.005 | 0.0120 | 2.40 | 0.0040 | 0.0005 | 0.0015 | — |
| B | 0.0050 | 0.51 | 1.20 | 0.004 | 0.001 | 0.008 | 0.0150 | 1.88 | 0.0070 | 0.0009 | 0.0009 | — |
| C | 0.0024 | 0.15 | 0.35 | 0.040 | 0.001 | 0.004 | 0.0120 | 3.00 | 0.0050 | 0.0006 | 0.0015 | — |
| D | 0.0150 | 0.15 | 0.88 | 0.010 | 0.002 | 0.010 | 0.0100 | 1.00 | 0.0102 | 0.0013 | 0.0012 | — |
| E | 0.0023 | 0.01 | 1.40 | 0.005 | 0.002 | 0.011 | 0.0120 | 1.09 | 0.0070 | 0.0009 | 0.0010 | — |
| F | 0.0023 | 0.05 | 1.35 | 0.045 | 0.001 | 0.007 | 0.0120 | 1.71 | 0.0080 | 0.0010 | 0.0020 | Mo: 0.15 |
| G | 0.0025 | 0.15 | 1.25 | 0.007 | 0.001 | 0.004 | 0.0110 | 2.75 | 0.0070 | 0.0009 | 0.0015 | Ti: 0.013 |
| H | 0.0025 | 0.25 | 1.25 | 0.008 | 0.001 | 0.011 | 0.0140 | 1.27 | 0.0060 | 0.0008 | 0.0014 | Cu: 0.50, Ni: 0.20 |
| I | 0.0024 | 0.15 | 1.25 | 0.005 | 0.003 | 0.011 | 0.0150 | 1.36 | 0.0089 | 0.0010 | 0.0018 | Ni: 0.05, V: 0.02 |
| J | 0.022 | 0.15 | 1.21 | 0.008 | 0.002 | 0.005 | 0.0120 | 2.40 | 0.0076 | 0.0011 | 0.0020 | Cu: 0.10, Ni: 0.05 |
| K | 0.070 | 0.25 | 1.50 | 0.015 | 0.003 | 0.055 | 0.0040 | 0.07 | 0.0090 | 0.0012 | 0.0021 | — |
| L | 0.0025 | 0.15 | 0.85 | 0.050 | 0.002 | 0.005 | 0.0120 | 2.40 | 0.0001 | 0.0000 | ≤0.0001 | — |
| M | 0.0025 | 0.15 | 0.85 | 0.050 | 0.002 | 0.005 | 0.0120 | 2.40 | 0.0050 | 0.0006 | ≤0.0001 | — |
| O | 0.0025 | 0.17 | 0.81 | 0.008 | 0.001 | 0.007 | 0.0120 | 1.71 | 0.110 | 0.0142 | 0.0015 | — |
| P | 0.0026 | 0.17 | 0.82 | 0.007 | 0.001 | 0.007 | 0.0400 | 5.71 | 0.0070 | 0.0009 | 0.0017 | — |
| Q | 0.0025 | 0.18 | 0.81 | 0.008 | 0.001 | 0.007 | 0.0120 | 1.71 | 0.0080 | 0.0010 | 0.0022 | Ca: 0.0035 |

TABLE 10

| | | Hot rolling step | | | | | | | Cold rolling step | |
|---|---|---|---|---|---|---|---|---|---|---|
| | | Slab | Rough rolling | | Finish rolling | | | Coiling | | Thickness |
| Steel sheet No. | Steel | heating temp. SRT ° C. | Thickness of sheet bar mm | Bonding of sheet bars | $Ar_3$ transformation point ° C. | Finisher temperature FDT ° C. | Thickness of hot-rolled sheet mm | Coiling temperature CT ° C. | Cold rolling reduction ratio % | of cold-rolled sheet mm |
| 1 | A | 1210 | 28 | No | 873 | 900 | 4.0 | 550 | 83 | 0.70 |
| 2 | B | 1230 | 28 | No | 837 | 900 | 4.0 | 530 | 81 | 0.75 |
| 3 | C | 1220 | 28 | No | 908 | 910 | 4.0 | 550 | 83 | 0.70 |
| 4 | D | 1180 | 28 | No | 851 | 890 | 4.0 | 530 | 83 | 0.70 |
| 5 | E | 1190 | 28 | No | 801 | 890 | 4.0 | 520 | 83 | 0.70 |
| 6 | F | 1180 | 25 | No | 827 | 890 | 4.5 | 500 | 78 | 1.00 |
| 7 | G | 1180 | 25 | No | 820 | 890 | 6.0 | 570 | 80 | 1.20 |
| 8 | H | 1180 | 25 | No | 824 | 890 | 4.0 | 610 | 80 | 0.80 |
| 9 | I | 1190 | 28 | No | 819 | 890 | 4.0 | 550 | 84 | 0.65 |
| 10 | J | 1210 | 28 | No | 823 | 870 | 4.0 | 450 | 83 | 0.70 |
| 11 | K | 1200 | 28 | No | 808 | 880 | 4.0 | 520 | 83 | 0.70 |
| 12 | L | 1200 | 28 | No | 873 | 900 | 4.0 | 550 | 83 | 0.70 |
| 13 | M | 1200 | 25 | No | 873 | 900 | 4.0 | 550 | 83 | 0.70 |

TABLE 10-continued

| | | | | | | | | | | |
|---|---|---|---|---|---|---|---|---|---|---|
| 14 | O | 1210 | 25 | No | 856 | 890 | 4.0 | 520 | 83 | 0.70 |
| 15 | P | 1240 | 25 | No | 854 | 880 | 4.0 | 520 | 83 | 0.70 |
| 16 | Q | 1220 | 25 | No | 856 | 900 | 4.0 | 530 | 83 | 0.70 |
| 17 | A | 950 | 25 | No | 870 | 750 | 4.0 | 540 | 83 | 0.70 |
| 18 | A | 1200 | 28 | No | 873 | 900 | 4.0 | 780 | 83 | 0.70 |
| 19 | A | 1190 | 28 | No | 873 | 905 | 4.0 | 540 | 83 | 0.70 |
| 20 | A | 1190 | 28 | No | 873 | 890 | 4.0 | 550 | 83 | 0.70 |

| Steel sheet | | Temperature region | Cold-rolled sheet annealing step Continuous annealing | | | | Temper rolling | | |
|---|---|---|---|---|---|---|---|---|---|
| No. | Steel | of α-γ coexistence ° C. | Annealing temp. ° C. | Retention time s | Cooling rate ° C./s | Cooling stop temp. ° C. | Type | Elongation % | Remarks |
| 1 | A | 860 to 950 | 880 | 35 | 30 | 350 | Skin pass | 0.5 | Example of this invention |
| 2 | B | 835 to 935 | 870 | 30 | 35 | 350 | Skin pass | 0.5 | Example of this invention |
| 3 | C | 865 to 955 | 885 | 25 | 25 | 350 | Skin pass | 0.5 | Example of this invention |
| 4 | D | 845 to 922 | 885 | 40 | 45 | 350 | — | — | Example of this invention |
| 5 | E | 825 to 906 | 875 | 25 | 40 | 450 | Leveler | 0.5 | Example of this invention |
| 6 | F | 855 to 930 | 885 | 30 | 35 | 450 | Skin pass + Leveler | 0.5 | Example of this invention |
| 7 | G | 835 to 918 | 875 | 45 | 30 | 450 | Skin pass + Leveler | 0.7 | Example of this invention |
| 8 | H | 835 to 923 | 880 | 25 | 45 | 450 | Skin pass + Leveler | 0.7 | Example of this invention |
| 9 | I | 830 to 915 | 865 | 25 | 30 | 300 | Skin pass + Leveler | 0.7 | Example of this invention |
| 10 | J | 830 to 910 | 870 | 25 | 30 | 300 | Skin pass + Leveler | 0.7 | Example of this invention |
| 11 | K | 755 to 895 | 870 | 25 | 30 | 300 | Skin pass + Leveler | 0.5 | Comparative example |
| 12 | L | 860 to 950 | 880 | 35 | 30 | 300 | Skin pass + Leveler | 0.5 | Comparative example |
| 13 | M | 860 to 950 | 880 | 35 | 30 | 300 | Skin pass + Leveler | 0.5 | Comparative example |
| 14 | O | 850 to 940 | 890 | 30 | 35 | 300 | Skin pass + Leveler | 0.5 | Comparative example |
| 15 | P | 850 to 940 | 890 | 30 | 35 | 300 | Skin pass | 0.7 | Comparative example |
| 16 | Q | 850 to 940 | 880 | 30 | 35 | 300 | Skin pass | 0.7 | Example of this invention |
| 17 | A | 855 to 950 | 880 | 30 | 30 | 300 | Skin pass | 0.7 | Comparative example |
| 18 | A | 865 to 950 | 870 | 35 | 35 | 300 | Skin pass | 0.7 | Comparative example |
| 19 | A | 860 to 950 | 820 | 25 | 40 | 300 | Skin pass | 0.7 | Comparative example |
| 20 | A | 860 to 950 | 870 | 30 | 5 | 300 | Skin pass | 0.7 | Comprative example |

TABLE 11

| | | | Steel sheet | | | Property of product sheet Tensile property | | | | Strain age hardening property | | | |
|---|---|---|---|---|---|---|---|---|---|---|---|---|---|
| | | Amount | Ferrite | | Second phase | | | | | | | | |
| Steel sheet No. | Steel | of dissolved N % by mass | Area ratio % | Grain diameter μm | AF area ratio % | YS MPa | TS MPa | El % | Mean r value | Amount of BH MPa | ΔTS MPa | Aging resistance ΔY-El % | Remarks |
| 1 | A | 0.0090 | 92 | 1 | 8 | 315 | 448 | 38 | 1.8 | 85 | 75 | 0.0 | Example of this invention |
| 2 | B | 0.0100 | 95 | 8 | 5 | 355 | 510 | 34 | 1.7 | 90 | 80 | 0.0 | Example of this invention |
| 3 | C | 0.0085 | 92 | 7 | 8 | 295 | 420 | 41 | 1.8 | 80 | 75 | 0.0 | Example of this invention |
| 4 | D | 0.0095 | 92 | 6 | 8 | 334 | 475 | 36 | 1.4 | 95 | 80 | 0.0 | Example of this invention** |
| 5 | E | 0.0100 | 93 | 7 | 7 | 325 | 465 | 37 | 1.7 | 88 | 75 | 0.0 | Example of this invention |
| 6 | F | 0.0105 | 90 | 7 | 10 | 385 | 550 | 35 | 1.5 | 102 | 75 | 0.0 | Example of this invention |
| 7 | G | 0.0105 | 88 | 6 | 12 | 315 | 455 | 39 | 1.8 | 88 | 72 | 0.0 | Example of this invention |
| 8 | H | 0.0095 | 92 | 10 | 8 | 325 | 460 | 37 | 1.8 | 98 | 75 | 0.0 | Example of this invention |
| 9 | I | 0.0090 | 90 | 5 | 10 | 320 | 465 | 37 | 1.8 | 97 | 85 | 0.0 | Example of this invention |
| 10 | J | 0.0105 | 88 | 5 | 12 | 420 | 595 | 29 | 1.4 | 105 | 85 | 0.0 | Example of this invention** |
| 11 | K | 0.0002 | 75 | 7 | 25 | 370 | 545 | 25 | 1.1 | 45 | 34 | 1.5 | Comparative example |
| 12 | L | 0.0080 | 98 | 15 | 2 | 290 | 420 | 35 | 1.3 | 15 | 10 | 1.5 | Comparative example |
| 13 | M | 0.0085 | 97 | 8 | 3 | 290 | 410 | 33 | 1.2 | 15 | 7 | 1.0 | Comparative example |
| 14 | O | 0.0003 | 98 | 6 | 2 | 320 | 455 | 33 | 1.1 | 5 | 15 | 0.8 | Comparative example |
| 15 | P | 0.0190 | 95 | 7 | 5 | 310 | 440 | 37 | 1.6 | 90 | 70 | 2.8 | Comparative example |
| 16 | Q | 0.0098 | 92 | 7 | 8 | 315 | 450 | 39 | 1.7 | 90 | 70 | 0 | Example of this invention |
| 17 | A | 0.0009 | 98 | 22 | 2 | 275 | 420 | 33 | 1.1 | 0 | 15 | 0.5 | Comparative example |
| 18 | | 0.0040 | 95 | 25 | 5 | 275 | 410 | 34 | 1.3 | 30 | 10 | 0.5 | Comparative example |
| 19 | | 0.0050 | 100 | 12 | 0 | 270 | 380 | 33 | 1.3 | 25 | 12 | 0.8 | Comparative example |
| 20 | | 0.0030 | 99 | 22 | 1 | 265 | 385 | 31 | 1.3 | 20 | 10 | 0.9 | Comparative example |

AF: Acicular ferrite
**Hot-dip galvanization

TABLE 12

| | Chemical Composition (% by mass) | | | | | | | | | | | |
|---|---|---|---|---|---|---|---|---|---|---|---|---|
| Steel | C | Si | Mn | P | S | Al | N | N/Al | Nb | 12/93 Nb | B | Others |
| N | 0.0085 | 0.005 | 0.55 | 0.009 | 0.005 | 0.015 | 0.0126 | 0.84 | 0.008 | 0.0010 | 0.0015 | — |

TABLE 13

| | | Hot rolling step | | | | | | | Cold rolling step | |
|---|---|---|---|---|---|---|---|---|---|---|
| | | Slab | Rough rolling | | Finish rolling | | Coiling | | | |
| Steel sheet No. | Steel | heating temp. SRT ° C. | Thickness of sheet bar mm | Bonding of sheet bars | $Ar_3$ transformation point ° C. | Finisher temperature FDT ° C. | Thickness of hot-rolled sheet mm | Coiling temperature CT ° C. | Cold rolling reduction ratio % | Thickness of cold-rolled sheet mm |
| 2-1 | N | 1250 | 25 | Yes* | 870 | 890 | 4.5 | 570 | 69 | 1.4 |
| 2-2 | | 1230 | 25 | Yes* | 870 | 890 | 4.5 | 560 | 69 | 1.4 |
| 2-3 | | 1240 | 25 | Yes** | 870 | 890 | 4.5 | 560 | 69 | 1.4 |

| | | | Cold-rolled sheet annealing step Continuous annealing | | | | Temper rolling | | |
|---|---|---|---|---|---|---|---|---|---|
| Steel sheet No. | Steel | Temperature region of α-γ coexistence ° C. | Annealing temp. ° C. | Retention times | Cooling rate ° C./s | Cooling stop temp. ° C. | Type | Elongation % | Remarks |
| 2-1 | N | 840 to 900 | 880 | 30 | 45 | 300 | Skin pass | 0.5 | Example of this invention |
| 2-2 | | 840 to 900 | 880 | 35 | 45 | 310 | Skin pass | 0.5 | Example of this invention |
| 2-3 | | 840 to 900 | 880 | 30 | 45 | 310 | Skin pass | 0.5 | Example of this invention |

*Lubrication rolling
**Lubrication rolling, using a sheet bar heater and an edge heater

TABLE 14

| | | Steel sheet | | | | Property of product sheet | | | | Property of product sheet Variation in tensile property* | | | Strain age hardening property | | | |
|---|---|---|---|---|---|---|---|---|---|---|---|---|---|---|---|---|
| | | Amount of | Ferrite | | Second phase | Tensile property | | | | | | | Amount of | | Aging | |
| Steel sheet No. | Steel | dissolved N % by mass | Area ratio % | Grain diameter μm | AF area ratio % | YS MPa | TS MPa | El % | Mean r value | δYS MPa | δTS MPa | δEl % | BH MPa | ΔTS MPa | resistance ΔY-El % | Remarks |
| 2-1 | N | 0.0120 | 91 | 7 | 9 | 315 | 445 | 37 | 1.6 | 10 | 10 | 5 | 15 | 15 | 0 | Example of this invention |
| 2-2 | N | 0.0120 | 91 | 7 | 9 | 319 | 447 | 37 | 1.6 | 5 | 5 | 2 | 7 | 6 | 0 | Example of this invention |

TABLE 14-continued

| Steel sheet No. | Steel | Steel sheet: Amount of dissolved N % by mass | Steel sheet: Ferrite Area ratio % | Steel sheet: Ferrite Grain diameter μm | Steel sheet: Second phase AF area ratio % | Property of product sheet: Tensile property YS MPa | TS MPa | El % | Mean r value | Property of product sheet Variation in tensile property*: δYS MPa | δTS MPa | δEl % | Strain age hardening property: Amount of BH MPa | ΔTS MPa | Aging resistance ΔY-El % | Remarks |
|---|---|---|---|---|---|---|---|---|---|---|---|---|---|---|---|---|
| 2-3 | N | 0.0125 | 92 | 7 | 8 | 318 | 450 | 38 | 1.5 | 3 | 5 | 1 | 8 | 5 | 0 | Example of this invention |

*δYS, δTS, δEl: = (Maximum − Minimum)
**AF: Acicular ferrite, M: Martensite, B: Bainite, P: Pearlite

TABLE 15

| Steel | Chemical composition (% by mass): C | Si | Mn | P | S | Al | N | N/Al | Others | Transformation point (° C.): $Ac_1$ | $Ac_3$ |
|---|---|---|---|---|---|---|---|---|---|---|---|
| A | 0.050 | 0.01 | 0.55 | 0.040 | 0.001 | 0.004 | 0.0120 | 3.00 | — | 735 | 858 |
| B | 0.080 | 0.02 | 0.30 | 0.060 | 0.001 | 0.008 | 0.0153 | 1.91 | — | 749 | 866 |
| C | 0.070 | 0.15 | 0.45 | 0.040 | 0.001 | 0.002 | 0.0118 | 5.90 | REM: 0.0015 | 740 | 862 |
| D | 0.055 | 0.15 | 0.88 | 0.050 | 0.002 | 0.006 | 0.0095 | 1.58 | Ca: 0.0020 | 739 | 863 |
| E | 0.030 | 0.01 | 1.40 | 0.005 | 0.002 | 0.011 | 0.0120 | 1.09 | Ca: 0.0025, REM: 0.0020 | 706 | 832 |
| F | 0.050 | 0.05 | 0.55 | 0.045 | 0.001 | 0.007 | 0.0123 | 1.76 | Mo: 0.02 | 739 | 862 |
| G | 0.065 | 0.02 | 0.75 | 0.045 | 0.001 | 0.004 | 0.0114 | 2.85 | Ti: 0.013, B: 0.0005 | 735 | 855 |
| H | 0.050 | 0.01 | 0.85 | 0.008 | 0.001 | 0.008 | 0.0138 | 1.73 | Cu: 0.50, Ni: 0.20, Cr: 0.20 | 717 | 834 |
| I | 0.040 | 0.01 | 0.55 | 0.005 | 0.003 | 0.011 | 0.0151 | 1.37 | Ni: 0.05, V: 0.02 | 717 | 842 |
| J | 0.120 | 0.15 | 0.95 | 0.008 | 0.002 | 0.005 | 0.0118 | 2.36 | Cu: 0.10, Ni: 0.05, Nb: 0.007 | 719 | 830 |
| K | 0.010 | 0.25 | 0.96 | 0.015 | 0.003 | 0.002 | 0.0042 | 2.10 | — | 723 | 857 |
| L | 0.080 | 0.15 | 0.85 | 0.050 | 0.002 | 0.045 | 0.0040 | 0.09 | — | 739 | 859 |

TABLE 16

| Steel sheet No. | Steel | Hot rolling step: Slab heating temp. SRT ° C. | Rough rolling: Thickness of sheet bar mm | Rough rolling: Bonding of sheet bars | Finish rolling: Finisher temperature FDT ° C. | Finish rolling: Thickness of hot-rolled sheet mm | Cooling after rolling: Starting time Δts | Cooling after rolling: Cooling rate V ° C./s | Coiling: Coiling temperature CT ° C. | Cold rolling step: Cold rolling reduction ratio % | Cold rolling step: Thickness of cold-rolled sheet mm |
|---|---|---|---|---|---|---|---|---|---|---|---|
| 1 | A | 1210 | 30 | No | 850 | 4.0 | 0.2 | 50 | 550 | 83 | 0.70 |
| 2 | B | 1230 | 30 | No | 870 | 4.0 | 0.2 | 50 | 530 | 81 | 0.75 |
| 3 | C | 1220 | 30 | No | 840 | 4.0 | 0.1 | 50 | 550 | 83 | 0.70 |
| 4 | D | 1180 | 30 | No | 850 | 4.0 | 0.5 | 50 | 530 | 83 | 0.70 |
| 5 | E | 1190 | 30 | No | 850 | 4.0 | 0.2 | 45 | 520 | 83 | 0.70 |
| 6 | F | 1180** | 35 | No | 864 | 4.5 | 0.2 | 45 | 500 | 78 | 1.00 |
| 7 | G | 1180 | 35 | No | 860 | 6.0 | 1.2 | 45 | 570 | 80 | 1.20 |
| 8 | H | 1180 | 35 | No | 830 | 4.0 | 0.3 | 45 | 610 | 80 | 0.80 |
| 9 | I | 1190 | 30 | Yes | 840 | 4.0* | 0.3 | 45 | 550 | 84 | 0.65 |
| 10 | J | 1210 | 30 | No | 840 | 4.0 | 0.3 | 50 | 450 | 83 | 0.70 |
| 11 | K | 1200 | 30 | No | 850 | 4.0 | 0.3 | 50 | 520 | 83 | 0.70 |
| 12 | L | 1200 | 30 | No | 880 | 4.0 | 0.2 | 50 | 550 | 83 | 0.70 |

TABLE 16-continued

| | | | | | | | | | | | |
|---|---|---|---|---|---|---|---|---|---|---|---|
| 13 | A | 950 | 35 | No | 750 | 4.0 | 0.5 | 50 | 540 | 83 | 0.70 |
| 14 | A | 1200 | 35 | No | 880 | 4.0 | 0.3 | 50 | 780 | 83 | 0.70 |
| 15 | A | 1190 | 35 | No | 870 | 4.0 | 0.2 | 50 | 540 | 83 | 0.70 |
| 16 | A | 1200 | 35 | No | 880 | 4.0 | 0.2 | 50 | 550 | 83 | 0.70 |
| 17 | B | 1190 | 30 | No | 840 | 4.0 | 0.3 | 50 | 520 | 83 | 0.70 |
| 18 | G | 1180 | 30 | No | 850 | 4.0 | 0.3 | 50 | 520 | 83 | 0.70 |

| | | Box annealing | Cold-rolled sheet annealing step | | | | | |
|---|---|---|---|---|---|---|---|---|
| | | | Continuous annealing | | | | Over aging | |
| Steel sheet No. | Steel | Annealing temp. ° C. | Annealing temp. ° C. | Retention times | Cooling rate ° C./s | Cooling stop temp. ° C. | Residence time in temperature region of 350° C. or higher ** s | Temper rolling Elongation % |
| 1 | A | 700 | 790 | 40 | 45 | 270 | — | 0.2 |
| 2 | B | 680 | 780 | 30 | 50 | 270 | — | 0.2 |
| 3 | C | 700 | 800 | 30 | 55 | 270 | — | 0.2 |
| 4 | D | 690 | 800 | 45 | 45 | 250 | — | 0.2 |
| 5 | E | 720 | 770 | 25 | 45 | 200 | — | 0.5 |
| 6 | F | 700 | 780 | 35 | 55 | 200 | — | — |
| 7 | G | 700 | 830 | 50 | 60 | 300 | — | 0.5 |
| 8 | H | 700 | 810 | 25 | 50 | 400 | 50 | 0.5 |
| 9 | I | 700 | 790 | 25 | 45 | 250 | — | 0.5 |
| 10 | J | 700 | 770 | 25 | 30 | 250 | — | 0.5 |
| 11 | K | 700 | 800 | 25 | 30 | 250 | — | 0.5 |
| 12 | L | 700 | 790 | 35 | 30 | 270 | — | 0.7 |
| 13 | A | 700 | 800 | 30 | 30 | 270 | — | 0.7 |
| 14 | A | 700 | 830 | 35 | 35 | 250 | — | 0.7 |
| 15 | A | 700 | 680 | 25 | 40 | 250 | — | 0.5 |
| 16 | A | — | 820 | 29 | 35 | 250 | — | 0.5 |
| 17 | B | 710 | 780 | 35 | 70 | 450 | — | **** |
| 18 | G | 720 | 780 | 40 | 60 | 450 | — | **** |

*Lubrication rolling
**Residence time at 350° C. to the cooling stop temperature
***Charging of hot slab
****Temper rolling with an elongation of 0.5% after hot-dip galvanization

TABLE 17

| | | | Steel sheet | | | | | | | | Strain age hardening property | | | |
|---|---|---|---|---|---|---|---|---|---|---|---|---|---|---|
| | | Amount of | Ferrite | | Second phase | | Property of product sheet | | | | Amount of | | Aging resistance | |
| | | | | | | | Tensile property | | | | | | | |
| Steel sheet No. | Steel | N % by mass | Area ratio % | Grain diameter μm | AF area ratio % | Other phase: type | YS MPa | TS MPa | El % | Mean r value | BH MPa | ΔTS MPa | ΔY-El % | Remarks |
| 1 | A | 0.0075 | 86 | 7 | 12 | B | 290 | 550 | 35 | 1.6 | 80 | 80 | 0.0 | Example of this invention |
| 2 | B | 0.0055 | 92 | 8 | 7 | P | 295 | 556 | 35 | 1.5 | 90 | 85 | 0.0 | Example of this invention |
| 3 | C | 0.0055 | 90 | 7 | 10 | — | 285 | 555 | 34 | 1.6 | 85 | 75 | 0.0 | Example of this invention |
| 4 | D | 0.0075 | 89 | 6 | 10 | B | 295 | 565 | 34 | 1.6 | 95 | 80 | 0.0 | Example of this invention |
| 5 | E | 0.0110 | 91 | 7 | 9 | — | 315 | 605 | 33 | 1.7 | 85 | 75 | 0.0 | Example of this invention |
| 6 | F | 0.0110 | 90 | 7 | 10 | — | 309 | 595 | 35 | 1.6 | 100 | 75 | 0.0 | Example of this invention |
| 7 | G | 0.0095 | 85 | 6 | 14 | B | 314 | 605 | 35 | 1.6 | 85 | 70 | 0.0 | Example of this invention |
| 8 | H | 0.0078 | 87 | 10 | 12 | B | 318 | 615 | 33 | 1.6 | 96 | 75 | 0.0 | Example of this invention |
| 9 | I | 0.0086 | 86 | 5 | 12 | P | 276 | 525 | 37 | 1.5 | 90 | 80 | 0.0 | Example of this invention |
| 10 | J | 0.0095 | 84 | 5 | 15 | P | 324 | 620 | 33 | 1.5 | 102 | 90 | 0.0 | Example of this invention |
| 11 | K | 0.0003 | 98 | 7 | 1 | P | 235 | 3550 | 38 | 1.4 | 45 | 34 | 1.5 | Comparative example |
| 12 | L | 0.0005 | 93 | 15 | 7 | — | 241 | 370 | 39 | 1.3 | 15 | 10 | 1.5 | Comparative example |
| 13 | A | 0.0009 | 98 | 22 | 0.5 | P | 285 | 430 | 32 | 1.1 | 0 | 15 | 0.5 | Comparative example |
| 14 | | 0.0009 | 95 | 25 | 5 | — | 285 | 445 | 32 | 1.2 | 30 | 10 | 0.5 | Comparative example |

TABLE 17-continued

| Steel sheet No. | Steel | Steel sheet: Amount of dissolved N % by mass | Steel sheet: Ferrite Area ratio % | Steel sheet: Ferrite Grain diameter μm | Steel sheet: Second phase AF area ratio % | Steel sheet: Second phase Other phase: type | Property of product sheet: Tensile property YS MPa | TS MPa | El % | Mean r value | Strain age hardening property: Amount of BH MPa | ΔTS MPa | Aging resistance ΔY-El % | Remarks |
|---|---|---|---|---|---|---|---|---|---|---|---|---|---|---|
| 15 | | 0.0010 | 100 | 12 | 0 | — | 315 | 480 | 34 | 1.4 | 25 | 12 | 0.8 | Comparative example |
| 16 | | 0.0020 | 99 | 22 | 1 | — | 350 | 545 | 25 | 1.0 | 20 | 10 | 0.9 | Comparative example |
| 17 | B | 0.0060 | 92 | 8 | 7 | P | 297 | 555 | 35 | 1.5 | 92 | 85 | 0 | Example of this invention |
| 18 | G | 0.0055 | 92 | 8 | 7 | P | 296 | 557 | 34 | 1.5 | 90 | 85 | 0 | Example of this invention |

M: Martensite,
B: Bainite,
P: Pearlite

TABLE 18

| Steel | Chemical Composition (% by mass): C | Si | Mn | P | S | Al | N | N/Al | Other | Transformation point (° C.): $Ac_1$ | $Ac_3$ |
|---|---|---|---|---|---|---|---|---|---|---|---|
| M | 0.052 | 0.01 | 0.60 | 0.035 | 0.001 | 0.002 | 0.0125 | 6.25 | — | 735 | 855 |

TABLE 19

| Steel sheet No. | Steel | Hot rolling step: Slab heating temp. SRT ° C. | Rough rolling: Thickness of sheet bar mm | Rough rolling: Bonding of sheet bars | Finish rolling: Finisher temperature FDT ° C. | Finish rolling: Thickness of hot-rolled sheet mm | Cooling after rolling: Starting time Δts | Cooling after rolling: Cooling rate V ° C./s | Coiling: Coiling temperature CT ° C. | Cold rolling step: Cold rolling reduction ratio % | Cold rolling step: Thickness of cold-rolled sheet mm |
|---|---|---|---|---|---|---|---|---|---|---|---|
| 2-1 | M | 1180 | 30 | No | 850 | 4.5 | 0.3 | 45 | 540 | 64 | 1.6 |
| 2-2 | | 1200 | 30 | Yes* | 850 | 4.5 | 0.3 | 45 | 540 | 64 | 1.6 |
| 2-3 | | 1190 | 30 | Yes** | 855 | 4.5 | 0.3 | 45 | 540 | 64 | 1.6 |

| Steel sheet No. | Steel | Cold-rolled sheet annealing step: Box annealing Annealing temp. ° C. | Continuous annealing: Annealing temp. ° C. | Continuous annealing: Retention times | Continuous annealing: Cooling rate ° C./s | Continuous annealing: Cooling stop temp. ° C. | Over aging Residence time in temperature region of 350° C. or higher ** s | Temper rolling Elongation % | Remarks |
|---|---|---|---|---|---|---|---|---|---|
| 2-1 | M | 700 | 790 | 40 | 45 | 270 | — | 0.2 | Example of this invention |
| 2-2 | | 700 | 790 | 40 | 45 | 270 | — | 0.2 | Example of this |
| 2-3 | | 700 | 790 | 40 | 45 | 270 | — | 0.2 | Example of this invention |

*Lubrication rolling
**Using a sheet bar heater, an edge heater

TABLE 20

| Steel sheet No. | Steel | Amount of dissolved N % by mass | Steel sheet: Ferrite Area ratio % | Steel sheet: Ferrite Grain diameter μm | Steel sheet: Second phase AF area ratio % | Steel sheet: Second phase Other phases: type** | Property of product sheet: Tensile property YS MPa | TS MPa | El % | Mean r value | Property of product sheet Variation in tensile property *: δYS MPa | δTS MPa | δEl % | Strain age hardening property: Amount of BH MPa | ΔTS MPa | Aging resistance ΔY-El % | Remarks |
|---|---|---|---|---|---|---|---|---|---|---|---|---|---|---|---|---|---|
| 2-1 | M | 0.0075 | 85 | 7 | 12 | B | 295 | 551 | 35 | 1.6 | 25 | 15 | 2 | 80 | 80 | 0 | Example of this invention |
| 2-2 | M | 0.0075 | 85 | 7 | 12 | B | 295 | 552 | 35 | 1.6 | 20 | 10 | 1 | 80 | 80 | 0 | Example of this invention |
| 2-3 | M | 0.0075 | 85 | 7 | 12 | B | 292 | 553 | 35 | 1.6 | 15 | 8 | 1 | 80 | 80 | 0 | Example of this invention |

*δYS, δTS, δEl: = (Maximum − Minimum)
**M: Martensite, B: Bainite, P: Pearlite

What is claimed is:

1. A high-tensile-strength cold-rolled steel sheet having a high r value and excellent strain age hardenability and natural aging resistance comprising a composition, by mass %, comprising:

C: 0.025 to 0.15%;

of Si: 1.0% or less;

Mn: 2.0% or less;

P: 0.08% or less;

S: 0.02% or less;

Al: 0.02% or less; and

N: 0.0050 to 0.0250%;

wherein N/Al is 0.30 or more, the amount of dissolved N is 0.0010% or more, the balance is composed of Fe and inevitable impurities, the structure is composed of a ferrite phase having an average crystal grain diameter of 10 μm or less at an area ratio of 80% or more and a martensite phase as a second phase at an area ratio of 2% or more, and the r value is 1.2 or more.

2. A high-tensile-strength cold-rolled steel sheet according to claim 1, wherein the composition further comprises at least one of the following groups d to g:

Group d: at least one of Cu, Ni, Cr and Mo in a total of 1.0% or less;

Group e: at least one of Nb, Ti and V in a total of 0.1% or less;

Group f: 0.0030% or less of B; and

Group g: one or both of Ca and REM in a total of 0.0010 to 0.010%.

* * * * *

UNITED STATES PATENT AND TRADEMARK OFFICE

CERTIFICATE OF CORRECTION

PATENT NO. : 7,101,445 B2
APPLICATION NO. : 10/654775
DATED : September 5, 2006
INVENTOR(S) : Kami et al.

It is certified that error appears in the above-identified patent and that said Letters Patent is hereby corrected as shown below:

Column 12 at line 59:

Please change "Nb: 0.0021 to 0.050%;" to --Nb: 0.002 to 0.050%;--.

Signed and Sealed this

Seventeenth Day of April, 2007

JON W. DUDAS
*Director of the United States Patent and Trademark Office*